US006331050B1

(12) United States Patent
Nakata et al.

(10) Patent No.: US 6,331,050 B1
(45) **Date of Patent: *Dec. 18, 2001**

(54) LIQUID EJECTING HEAD AND METHOD IN WHICH A MOVABLE MEMBER IS PROVIDED BETWEEN FLOW PATHS, ONE PATH JOINING A COMMON CHAMBER AND EJECTION ORIFICE, THE OTHER, HAVING A HEAT GENERATING ELEMENT

(75) Inventors: Yoshie Nakata, Kawasaki; Hiroshi Sugitani, Machida; Tadayoshi Inamoto, Hachioji; Makiko Kimura, Sagamihara; Shuji Koyama, Kawasaki, all of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/632,667

(22) Filed: Apr. 15, 1996

(30) Foreign Application Priority Data

| | | |
|---|---|---|
| Apr. 14, 1995 | (JP) | 7-089058 |
| Jun. 8, 1995 | (JP) | 7-142214 |
| Jun. 22, 1995 | (JP) | 7-156536 |
| Apr. 11, 1996 | (JP) | 8-089826 |

(51) Int. Cl.[7] ..... B41J 2/05; B41J 2/18; B41J 2/19

(52) U.S. Cl. ..... 347/65; 347/89; 347/92

(58) Field of Search ..... 347/65, 63, 89, 347/94, 54, 84, 92

(56) References Cited

U.S. PATENT DOCUMENTS

| | | | | |
|---|---|---|---|---|
| 4,317,124 | * | 2/1982 | Shirato | 347/67 |
| 4,380,018 | * | 4/1983 | Andoh | 347/68 |
| 4,429,321 | * | 1/1984 | Matsumoto | 347/59 |

(List continued on next page.)

FOREIGN PATENT DOCUMENTS

| | | | | |
|---|---|---|---|---|
| 0436047 | | 7/1991 | (EP) . | |
| 436047 | * | 7/1991 | (EP) | B41J/2/055 |
| 0443798 | | 8/1991 | (EP) | B41J/2/14 |
| 0496533 | | 7/1992 | (EP) | B41J/2/055 |
| 0538147 | | 4/1993 | (EP) | B41J/2/195 |
| 61-59914 | | 2/1980 | (JP) | B41J/3/04 |
| 55-81172 | | 6/1980 | (JP) | B41J/3/04 |
| 58-188685 | * | 11/1983 | (JP) | B41J/27/00 |
| 61-69467 | | 4/1986 | (JP) | B41J/3/04 |
| 61-110557 | | 5/1986 | (JP) | B41J/3/04 |
| 62-37163 | * | 2/1987 | (JP) | B41J/3/04 |
| 62-151349 | * | 7/1987 | (JP) | B41J/3/04 |
| 62-156969 | | 7/1987 | (JP) | B41J/3/04 |
| 62-48585 | | 10/1987 | (JP) | B41J/3/04 |
| 63-197652 | | 8/1988 | (JP) | B41J/3/04 |
| 63-199972 | | 8/1988 | (JP) | B41J/3/04 |

(List continued on next page.)

*Primary Examiner*—John Barlow
*Assistant Examiner*—Juanita Stephens
(74) *Attorney, Agent, or Firm*—Fitzpatrick, Cella, Harper & Scinto

(57) ABSTRACT

A liquid ejecting head ejects liquid by generating a bubble. The head includes a first liquid flow path for direct fluid communication between a first common liquid chamber and an ejection outlet, a second liquid flow path having a heat generating element for applying heat to the liquid to generate a bubble in the liquid, and a supply path for supplying the liquid to above the heat generating element from an upstream side of the heat generating element in a direction along the heat generating element. A movable member is disposed between the first and second flow paths, faces the heat generating element, and is displaced to a side of the first liquid flow path because of pressure generated when the heat generating element is driven, and has a fulcrum and a free end located downstream of the fulcrum. A guide path is provided in which the liquid flows above the heat generating element in the second liquid flow path.

118 Claims, 30 Drawing Sheets

U.S. PATENT DOCUMENTS

| | | | | |
|---|---|---|---|---|
| 4,442,459 | * | 4/1984 | Fukui | 347/18 X |
| 4,480,259 | | 10/1984 | Kruger et al. | 317/63 |
| 4,496,960 | | 1/1985 | Fischbeck | 347/94 X |
| 4,509,063 | | 4/1985 | Sugitani et al. | 347/65 |
| 4,558,333 | | 12/1985 | Sugitani et al. | 347/65 |
| 4,568,953 | * | 2/1986 | Aoki | 347/65 |
| 4,611,219 | | 9/1986 | Sugitani et al. | 347/40 |
| 4,698,645 | | 10/1987 | Inamoto | 347/65 |
| 4,723,129 | | 2/1988 | Endo et al. | 347/56 |
| 4,723,136 | * | 2/1988 | Suzumura | 347/65 |
| 5,053,787 | * | 10/1991 | Terasawa | 347/56 X |
| 5,262,802 | | 11/1993 | Karita et al. | 347/802 |
| 5,278,585 | | 1/1994 | Karz et al. | 347/65 |
| 5,296,875 | * | 3/1994 | Suda | 347/89 X |
| 5,389,957 | | 2/1995 | Kimura et al. | 347/20 |
| 5,485,184 | | 1/1996 | Nakagomi et al. | 347/63 |
| 5,621,446 | * | 4/1997 | Tanaka | 347/85 |

FOREIGN PATENT DOCUMENTS

| | | | | |
|---|---|---|---|---|
| 2-113950 | | 4/1990 | (JP) | B41J/2/175 |
| 3-81155 | | 4/1991 | (JP) | B41J/2/05 |
| 5-124189 | | 5/1993 | (JP) | B41J/2/05 |
| 5-169663 | * | 7/1993 | (JP) | B41J/2/05 |
| 6-31918 | | 2/1994 | (JP) | B41J/2/05 |
| 6-87214 | | 3/1994 | (JP) | B41J/2/05 |

* cited by examiner

LIQUID EJECTING HEAD AND METHOD IN WHICH A MOVABLE MEMBER IS PROVIDED BETWEEN FLOW PATHS, ONE PATH JOINING A COMMON CHAMBER AND EJECTION ORIFICE, THE OTHER, HAVING A HEAT GENERATING ELEMENT

BACKGROUND OF THE INVENTION

1. Field of the Invention

The present invention relates to a liquid ejecting head for ejecting desired liquid using generation of a bubble by applying thermal energy to the liquid, a head cartridge using the liquid ejecting head, a liquid ejecting device using the same, a liquid ejecting method, and a recording method. It further relates to an ink jet head kit containing the liquid ejection head.

More particularly, it relates to a liquid ejecting head having a movable member displacable by generation of a bubble, and a head cartridge using the liquid ejecting head, and liquid ejecting device using the same. It further relates to a liquid ejecting method and recording method for ejection the liquid by moving the movable member using the generation of the bubble.

The present invention is applicable to equipment such as a printer, a copying machine, a facsimile machine having a communication system, a word processor having a printer portion or the like, and an industrial recording device combined with various processing device or processing devices, in which the recording is effected on a recording material such as paper, thread, fiber, textile, leather, metal, plastic resin material, glass, wood, ceramic and so on.

In this specification, "recording" means not only forming an image of letter, figure or the like having specific meanings, but also includes forming an image of a pattern not having a specific meaning.

2. Related Background Art

An ink jet recording method of so-called bubble jet type is known in which an instantaneous state change resulting in an instantaneous volume change (bubble generation) is caused by application of energy such as heat to the ink, so as to eject the ink through the ejection outlet by the force resulted from the state change by which the ink is ejected to and deposited on the recording material to form an image formation. As disclosed in U.S. Pat. No. 4,723,129, a recording device using the bubble jet recording method generally comprises an ejection outlet for ejecting the ink, an ink flow path in fluid communication with the ejection outlet, and an electrothermal transducer as energy generating means disposed in the ink flow path.

With such a recording method is advantageous in that, a high quality image, can be recorded at high speed and with low noise, and a plurality of such ejection outlets can be located at high density, and therefore, small size recording apparatus capable of providing a high resolution can be provided, and color images can be easily formed. Therefore, the bubble jet recording method is now widely used in printers, copying machines, facsimile machines or another office equipment, and for industrial systems such as textile printing device or the like.

With the increase of the wide needs for the bubble jet technique, various demands are imposed thereon, recently.

For example, an improvement in energy use efficiency is demanded. To meet the demand, the optimization of the heat generating element such as adjustment of the thickness of the protecting film is investigated. This method is effective in that a propagation efficiency of the generated heat to the liquid is improved.

In order to provide high image quality images, driving conditions have been proposed by which the ink ejection speed is increased, and/or the bubble generation is stabilized to accomplish better ink ejection. As another example, from the standpoint of increasing the recording speed, flow passage configuration improvements have been proposed by which the speed of liquid filling (refilling) into the liquid flow path is increased.

Among the configurations of the flow path Japanese Laid-Open Patent Application No. 63-199972 discloses an arrangement of the flow path as shown in FIGS. 1A and 1B. According to the arrangement of the flow path and a method for manufacturing a head as disclosed in the reference it hits on a back wave caused by generation of bubbles (the pressure in a direction opposite to a direction to the ejection outlet, namely to the liquid chamber 12). The back wave is know as an energy loss since the wave is not directed to the ejection direction.

The arrangement as shown in FIGS. 1A and 1B includes a valve 10 located at a position which is spaced apart from a bubble generation region formed by the heat generating element 2 and opposite to the ejection outlet 11 with respect to the heat generating element 2.

In FIG. 1B the valve 10 has an initial position as if it is adhered to a ceiling of a flow path 3 by a method using a plate-like material and the valve 10 depends down into the flow path 3 upon the generation of the bubble. According to the arrangement, a part of the back wave is controlled by the valve 10 so that the energy loss is controlled.

However, considering the generation of the bubble in the flow path 3 for keeping the liquid to be ejected, it is not practical to control the part of the back wave for the liquid ejection.

The back wave itself is not directly concerned with the ejection. When the back wave is generated in the flow path 3, the pressure of the bubble which is directly concerned with the ejection causes the liquid to be ejected from the flow path 3 as shown in FIG. 1A. Accordingly, even the back wave or the part thereof is controlled ejection outlet, the ejection is not greatly influenced.

On the other hand, in the bubble jet recording method, the heating is repeated with the heat generating element contacted with the ink, and therefore, a burnt material is deposited on the surface of the heat generating element due to kogation of the ink. However, the amount of the deposition may be large depending on the materials of the ink. If this occurs, the ink ejection becomes unstable. Additionally, even when the liquid to be ejected is the one easily deteriorated by heat or even when the liquid is the one with which the bubble generation is not sufficient, the liquid is desired to be ejected in good order without property change.

Japanese Laid-Open Patent Application No. 61-69467, Japanese Laid-Open Patent Application No. 55-81172 and U.S. Pat. No. 4,480,259 disclose that different liquids are used for the liquid generating the bubble by the heat (bubble generating liquid) and for the liquid to be ejected (ejection liquid). In these publications, the ink as the ejection liquid and the bubble generation liquid are completely separated by a flexible film of silicone rubber or the like so as to prevent direct contact of the ejection liquid to the heat generating element while propagating the pressure resulting from the bubble generation of the bubble generation liquid to the ejection liquid by the deformation of the flexible film. The prevention of the deposition of the material on the surface of the heat generating element and the increase of the selection latitude of the ejection liquid are accomplished, by such a structure.

However, with this structure in which the ejection liquid and the bubble generation liquid are completely separated, the pressure by the bubble generation is propagated to the ejection liquid through the expansion-contraction deformation of the flexible film, and therefore, the pressure is absorbed by the flexible film to a quite high degree. In addition, the deformation of the flexible film is not so large, and therefore, the energy use efficiency and the ejection force are deteriorated although the some effect is provided by the provision between the ejection liquid and the bubble generation liquid.

SUMMARY OF THE INVENTION

Under the above circumstances, returning to the principle of ejection of a liquid droplet in the bubble jet technology, the inventors intensively and extensively studied it in order to provide a novel liquid ejecting method and a head using the method, utilizing growth of bubble. As a result of the study, the inventors found out that the ejection force, ejection efficiency, and so on could be greatly improved by controlling the direction of growth of bubble by a movable member provided in the liquid flow path and further that such arrangement permitted good ejection of even a liquid that was hardly ejected by the conventional technology.

In addition to the above epoch-making effects, the inventors reached a very high level, including ejection stability and an improvement in recording speed in the bubble jet technology as well as an improvement in durability of the movable member and heat generating element by controlling a liquid flow above the heat generating element in the novel ejection principle as discussed above.

Principal objects of the present invention are as follows.

A first object of the present invention is to improve the durability of the movable member and heat generating member as also improving the ejection efficiency and ejection pressure, based on a novel liquid ejecting method for controlling the growing direction of a bubble generated, and on a novel liquid ejecting head.

A second object of the present invention is to provide a liquid ejecting method, a liquid ejecting head, and so on, improved in the durability as discussed above.

A third object of the present invention is to provide a liquid ejecting method, a liquid ejecting head, and so on, realizing stabilized ejection of liquid and improved recording speed.

A fourth object of the present invention is to provide a liquid ejecting method and a liquid ejecting head realizing good quality of recording image without unstable ejection or ejection failure by removing a bubble separating out in a bubble generation liquid path.

Typical features of the present invention for achieving the above objects are as follows.

According to an aspect of the present invention, there is provided a liquid ejecting head comprising:

a first liquid flow path in fluid communication with an ejection outlet;

a second liquid flow path having a heat generating element for applying heat to a liquid to generate a bubble in the liquid, and a supply path for supplying the liquid to above said heat generating element from an upstream side of said heat generating element in a direction along said heat generating element;

a movable member disposed as facing the heat generating element, displaced to a side of said first liquid flow path, based on a pressure generated when said heat generating element is driven, and having a free end; and a guide path for flowing the liquid above said heat generating element in said second liquid flow path.

According to another aspect of the present invention, there is provided a liquid ejecting head comprising:

a first liquid flow path in fluid communication with an ejection outlet; a second liquid flow path provided with energy generating means for generating a bubble for ejecting a liquid;

a movable member disposed as facing a bubble generation region of said energy generating means, displaced to a side of said first liquid flow path, based on a pressure of the bubble, and having a free end; and a guide path for flowing the liquid in said bubble generation region in said second liquid flow path.

According to a further aspect of the present invention, there is provided a liquid droplet ejecting head for ejecting a liquid droplet through an ejection outlet, based on a bubble generated by film boiling, comprising:

a first liquid flow path in direct fluid communication with the ejection outlet;

a second liquid flow path having a bubble generation region;

a movable member having a free end displaced by at least a bubble portion having a pressure component directly acting for ejection of a liquid droplet and guiding the bubble portion of the bubble having said pressure component toward said ejection outlet by displacement of the free end; and a guide path for flowing the liquid in the bubble generation region in said second liquid flow path.

According to a further aspect of the present invention, there is provided a liquid ejecting head for ejecting a liquid by generation of a bubble, comprising:

a first liquid flow path in fluid communication with an ejection outlet;

a second liquid flow path having a heat generating element for applying heat to the liquid to generate a bubble in said liquid, and a supply path for supplying the liquid to above said heat generating element from an upstream side of the heat generating element in a direction along said heat generating element;

a movable member disposed as facing the heat generating element, displaced to a side of said first liquid flow path, based on a pressure generated when said heat generating element is driven, and having a free end; and a guide path for circulating the liquid above said heat generating element in said second liquid flow path.

According to a further aspect of the present invention, there is provided a liquid ejecting method, using a head having a first liquid flow path in fluid communication with an ejection outlet, a second liquid flow path having a heat generating element for applying heat to a liquid to generate a bubble in the liquid, and a supply path for supplying the liquid to above said heat generating element from an upstream side of said heat generating element in a direction along said heat generating element, and a movable member disposed as facing the heat generating element and having a free end, comprising:

flowing the liquid above said heat generating element in said second liquid flow path, using a guide path in fluid communication with said second liquid flow path; and displacing said movable member to a side of said first liquid flow path, based on a pressure generated when said heat generating element is driven, thereby ejecting the liquid.

According to a further aspect of the present invention, there is a liquid ejecting method, using a liquid ejecting head having a first liquid flow path in direct fluid communication with an ejection outlet, a second liquid flow path having a bubble generating region, and a movable member disposed as facing said bubble generation region, comprising: displacing the movable member provided with a free end displaceable by at least a bubble portion having a pressure component directly acting for ejection of a liquid droplet, thereby guiding the bubble portion of said bubble having said pressure component toward said ejection outlet; and flowing the liquid in the bubble generation region in said second liquid flow path, using a guide path in fluid communication with said second liquid flow path.

According to a further aspect of the present invention, there is provided a liquid ejection recording method, using a head having a first liquid flow path in fluid communication with an ejection outlet, a second liquid flow path having a heat generating element for applying heat to a liquid to generate a bubble in the liquid, and a supply path for supplying the liquid to above said heat generating element from an upstream side of the heat generating element in a direction along said heat generating element, and a movable member disposed as facing the heat generating element and having a free end, comprising: flowing the liquid above said heat generating element in said second liquid flow path, using a guide path in fluid communication with said second liquid flow path; and displacing said movable member to a side of said first liquid flow path, based on a pressure generated when said heat generating element is driven, thereby ejecting a recording liquid.

According to a further aspect of the present invention, there is provided a head cartridge having either one of the foregoing liquid ejecting heads and a liquid container for containing a liquid to be supplied to the liquid ejecting head.

According to a further aspect of the present invention, there is provided a liquid ejecting apparatus having either one of the foregoing liquid ejecting heads, and driving signal supply means for supplying a driving signal for ejecting a liquid from said liquid ejecting head.

According to a further aspect of the present invention, there is provided a liquid ejecting apparatus having either one of the foregoing liquid ejecting heads, and recording medium carrying means for carrying a recording medium for receiving a liquid ejected from said liquid ejecting head.

According to a further aspect of the present invention, there is provided a system having the above liquid ejecting apparatus, and a pre-processing or post-processing apparatus for promoting fixation of said liquid on the recording medium after recorded.

According to a further aspect of the present invention, there is provided a head kit incorporating either one of the above liquid ejecting heads, and a liquid container for containing a liquid to be supplied to said liquid ejecting head.

The present invention attained the following effects by the structures and methods as described above.

First, the invention remarkably enhanced the ejection effect in the conventional bubble jet technology and improved the durability of the movable member.

Second, the invention achieved the considerable durability against a breaking mode of the heat generating element due to cavitation in the conventional bubble jet technology.

Third, the invention achieved a great improvement in response frequency by improving the principle of the drive frequency limit in the conventional bubble jet technology.

Fourth, the invention achieved suppressing a temperature rise of the head, which could be a factor to make ejection of liquid unstable, by high drive frequency with multiple nozzles ready for high-speed recording.

Fifth, the invention achieved a great improvement in reliability of liquid ejection by effectively removing a bubble separating out in the liquid path, and possibly causing ejection failure of liquid or unstable ejection.

The other effects of the present invention will be understood from the description of the preferred embodiments.

In the specification, the terms "upstream" and "downstream" are defined with respect to a general liquid flow from a liquid supply source through the liquid flow paths through the bubble generation region (or the movable member) to the ejection outlet or are expressed as expressions as to the direction in this structure.

Further, a "downstream side" portion of the bubble itself represents an ejection-outlet-side portion of the bubble which directly functions mainly to eject a liquid droplet. More particularly, it means a downstream portion of the bubble in the above flow direction or in the direction of the above structure with respect to the center of the bubble, or a bubble appearing in the downstream region from the center of the area of the heat generating element.

In this specification, "substantially sealed" generally means a sealed state in such a degree that when a bubble grows, the bubble does not escape through a gap (slit) around the movable member before motion of the movable member.

In this specification, a "partition wall" may mean a wall (which may include the movable member) interposed to separate the region in direct fluid communication with the ejection outlet from the bubble generation region, and more specifically means a wall separating the liquid flow path including the bubble generation region from the liquid flow path in direct fluid communication with the ejection outlet, thereby preventing mixture of the liquids in the respective liquid flow paths.

In the specification, a "free end portion" of the movable member means a portion including a free end, which is a downstream-side end of the movable member, and neighboring regions, and also including a portion near the downstream corners of the movable member.

Further, a "free end region" of the movable member means the free end itself of the downstream side end of the movable member, a region including the side ends of the free end, or a region including both the free end and the side ends.

DESCRIPTION OF THE PREFERRED EMBODIMENTS

Explanation of the Principle

The ejection principle applicable to the present invention will be explained with reference to the drawings.

Figure 1A:
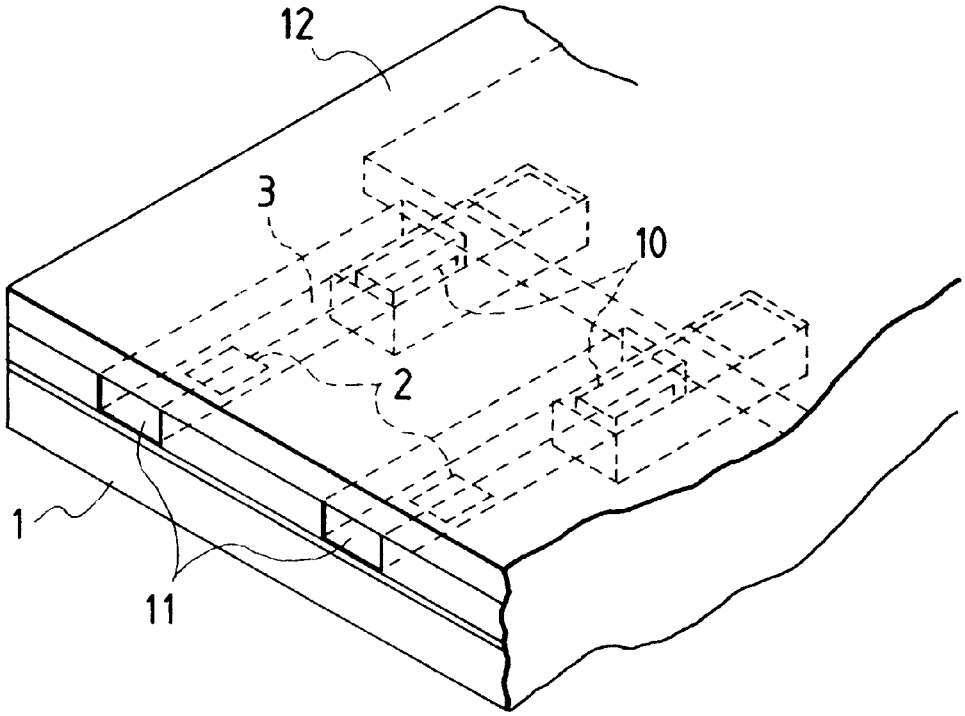
FIG. 1A PRIOR ART
FIGS. 1A and 1B are drawings for explaining a liquid flow path structure of the conventional liquid ejecting head.
Figure 1B:
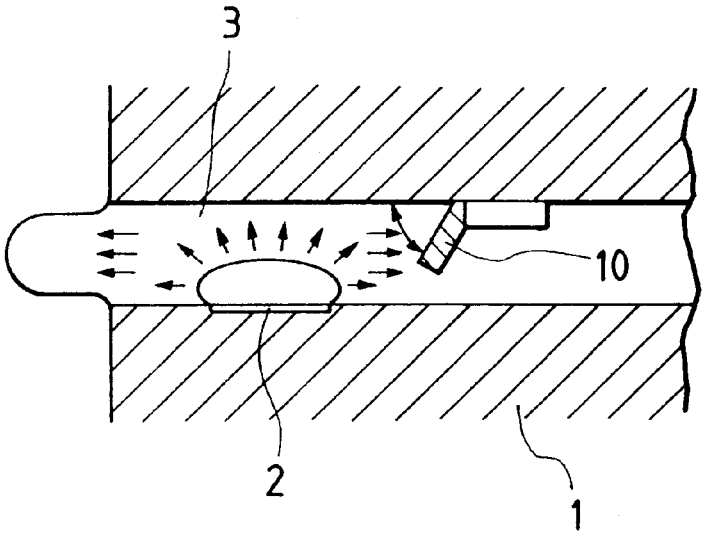
FIG. 1B PRIOR ART
Figure 2A:
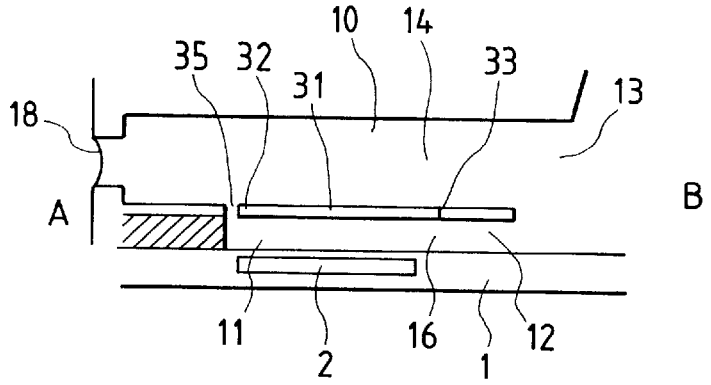
FIGS. 2A to 2D are drawings for explaining the liquid ejection principle as a basis of the present invention.
Figure 2B:
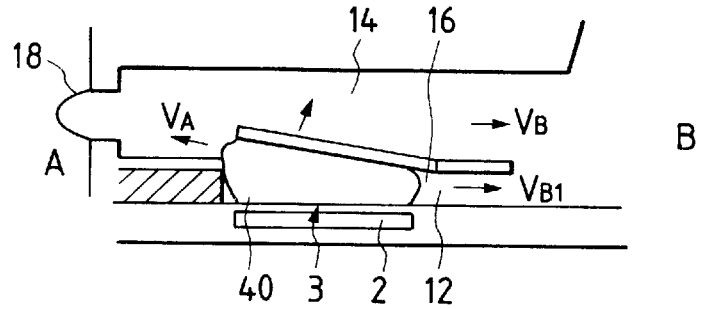
Figure 2C:
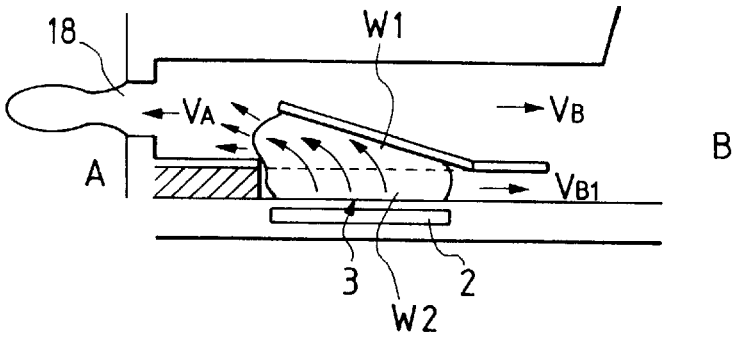
Figure 2D:
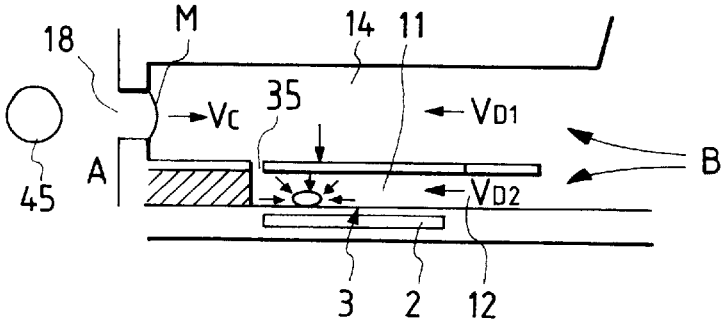
Figure 3:
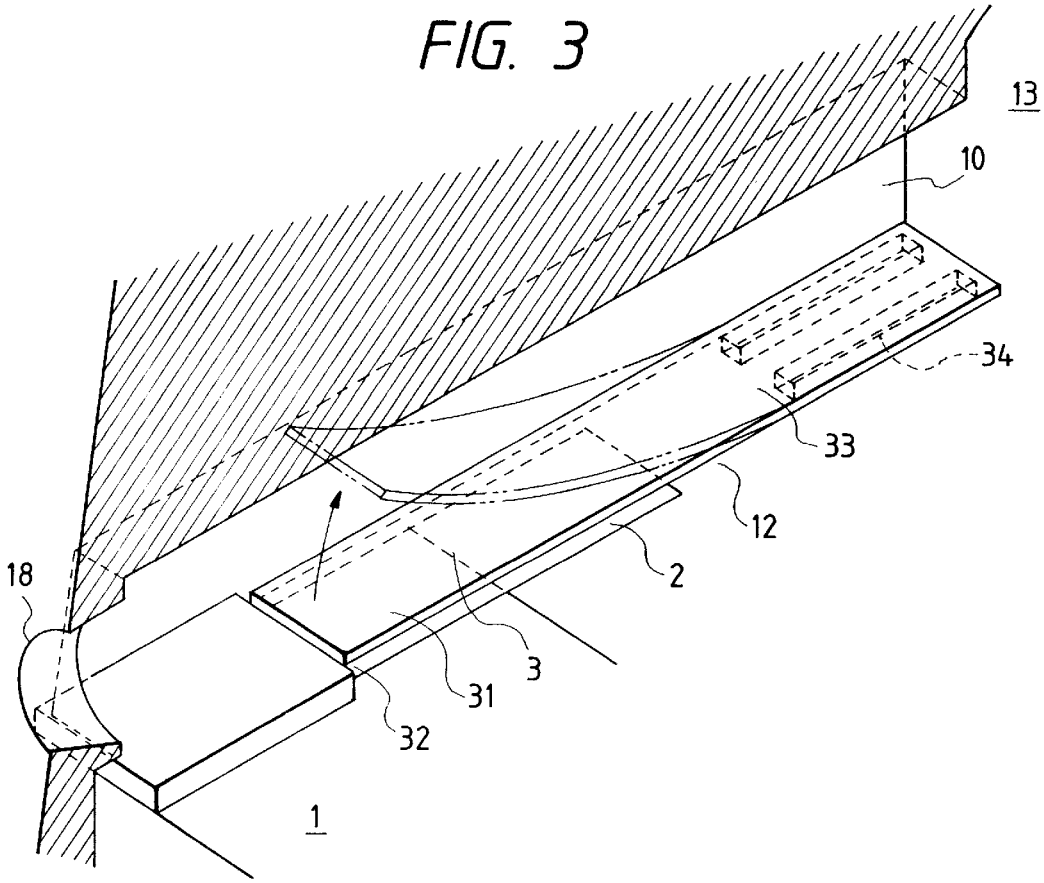
FIG. 3 is a partly broken perspective view of a liquid ejecting head of FIGS. 2A and 2B.

FIGS. 2A to 2D are schematic cross-sectional views of the liquid discharge head taken along the direction of the liquid flow path and FIG. 3 is a partially broken perspective view of the liquid head.

The liquid ejecting head as shown in FIGS. 2A to 2D comprises a heat generating element 2 provided on an element substrate 1 (a heat generating resistor of 40 $\mu$m×105 $\mu$m in FIG. 3) as the ejection energy generating element for supplying thermal energy to the liquid to eject the liquid, and a liquid flow path 10 formed above the element substrate 1 correspondingly to the heat generating element 2. The liquid flow path 10 is in fluid communication with a discharge port 18 and a common liquid chamber 13 for supplying the liquid to a plurality of such liquid flow paths 10 which is in fluid communication with a plurality of the ejection outlets 18.

Above the element substrate 1 in the liquid flow path 10, a movable member or plate 31 having a planer portion in the form of a cantilever of an elastic material such as metal is provided faced to the heat generating element 2. One end of the movable member 31 is fixed to a foundation (supporting member) 34 or the like provided by patterning of photosensitivity resin material on the wall of the liquid flow path 10 or the element substrate 1. By this structure, the movable member 31 is supported, and a fulcrum 33 (fulcrum portion) is constituted.

The movable member 31 is so positioned that it has a fulcrum 33 (fulcrum portion which is a fixed end) in an upstream side with respect to a great flow of the liquid from the common liquid chamber 13 toward the ejection outlet 18 through the movable member 31 caused by the ejecting operation and that it has a free end (free end portion) 32 in a downstream side of the fulcrum 33. Accordingly, the movable member 31 is faced to the heat generating element 2 with a gap of 15 $\mu$m approx so that it covers the heat generating element 2. A bubble generation region is constituted between the heat generating element and movable member. The type, configuration or position of the heat generating element or the movable member is not limited to the ones described above, but may be changed as long as the growth of the bubble and the propagation of the pressure can be controlled. For the purpose of easy understanding of the flow of the liquid which will be described hereinafter, the liquid flow path 10 is divided by the movable member 31 into a first liquid flow path 14 which is directly in communication with the ejection outlet 18 and a second liquid flow path 16 having the bubble generation region 11 and the liquid supply port 12.

By causing heat generation of the heat generating element 2, the heat is applied to the liquid in the bubble generation region 11 between the movable member 31 and the heat generating element 2, by which a bubble is generated in the liquid by the film boiling phenomenon as disclosed in U.S. Pat. No. 4,723,129. The bubble and the pressure caused by the generation of the bubble act mainly on the movable member, so that the movable member 31 moves or displaces to widely open toward the ejection outlet side about the fulcrum 33, as shown in FIGS. 2B and 2C or in FIG. 3. By the displacement of the movable member 31 or the state after the displacement, the propagation of the pressure caused by the generation of the bubble and the growth of the bubble per se are directed toward the ejection outlet.

Here, one of the fundamental ejection principles applicable to the present invention will be described. One of important principles of this invention is that the movable member disposed faced to the bubble is displaced from the normal first position to the displaced second position on the basis of the pressure of the bubble generation or the bubble per se, and the displacing or displaced movable member 31 is effective to direct the pressure produced by the generation of the bubble and/or the growth of the bubble per se toward the downstream in which the ejection outlet 18 is located.

Figure 4:
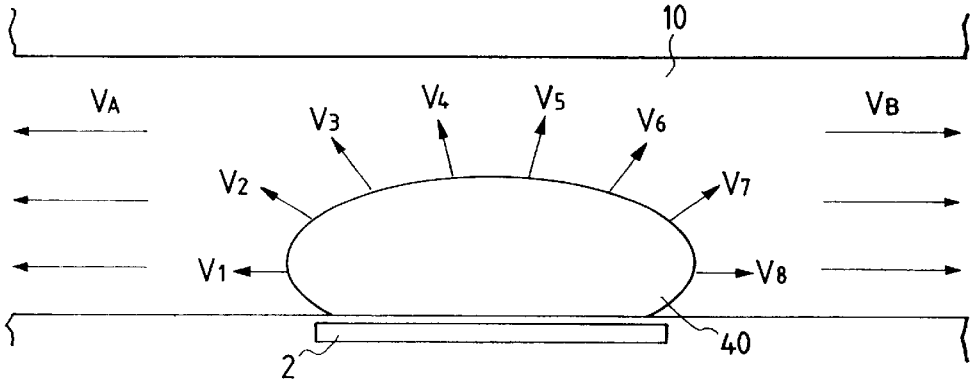
FIG. 4 PRIOR ART
FIG. 4 is a drawing for explaining pressure propagation from a bubble in the conventional liquid ejecting head.
Figure 5:
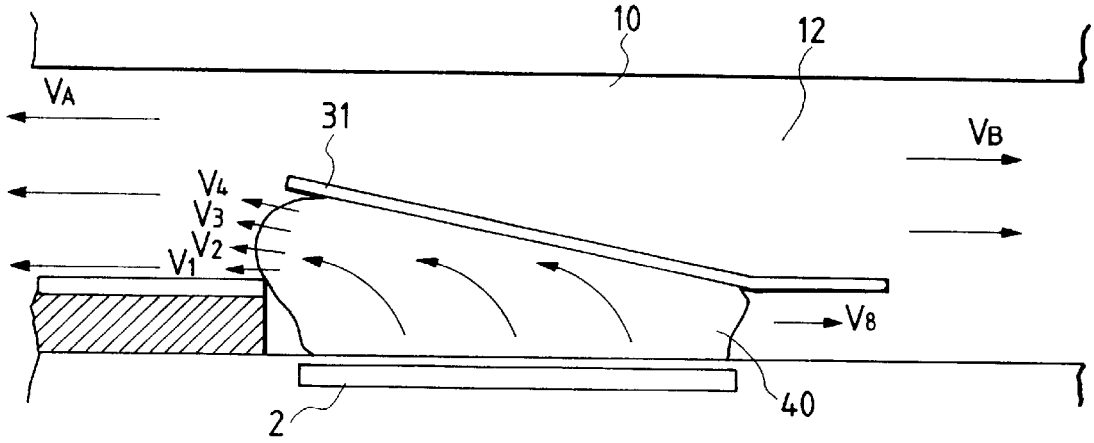
FIG. 5 is a drawing for explaining pressure propagation from a bubble in the liquid ejection principle as a basis of the present invention.
Figure 6:
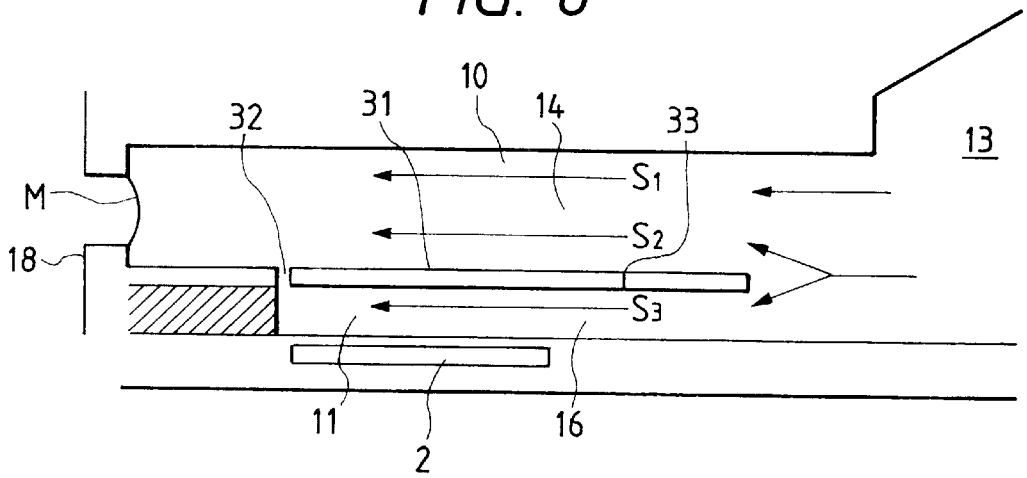
FIG. 6 is a drawing for explaining a flow of a liquid in the liquid ejection principle as a basis of the present invention.

More detailed description will be made with comparison between the conventional liquid flow passage structure not using the movable member (FIG. 4) and the present invention (FIG. 5). Here, the direction of propagation of the pressure toward the ejection outlet is indicated by VA, and the direction of propagation of the pressure toward the upstream is indicated by VB.

In a conventional head as shown in FIG. 4, there is not any structural element effective to regulate the direction of the propagation of the pressure produced by the bubble 40 generation. Therefore, the direction of the pressure propagation of the bubble 40 is normal to the surface of the bubble as indicated by V1–V8, and therefore, is widely directed in the passage. Among these directions, those of the pressure propagation from the half portion of the bubble closer to the ejection outlet (V1–V4) have the pressure components in the VA direction which is most effective for the liquid ejection. This portion is important since it directly contributable to the liquid ejection efficiency, the liquid ejection pressure and the ejection speed. Furthermore, the component V1 is closest to the direction of VA which is the ejection direction, and therefore, is most effective, and the V4 has a relatively small component in the direction VA.

On the other hand, in the case of the present invention, shown in FIG. 5, the movable member 31 is effective to direct, to the downstream (ejection outlet side), the pressure propagation directions V1–V4 of the bubble which otherwise are toward various directions as shown in FIG. 4 and to direct to the pressure propagation direction VA so that the pressure of the bubble 40 is directly and efficiently contributable to the ejection.

Further, the growth direction per se of the bubble is directed downstream similarly to the pressure propagation directions V1–V4, and bubbles grow more in the downstream side than in the upstream side. Thus, the growth direction per se of the bubble is controlled by the movable member, and the pressure propagation direction from the bubble is controlled thereby, so that the ejection efficiency, ejection force and ejection speed or the like are fundamentally improved.

Referring back to FIGS. 2A to 2D, the ejecting operation of the liquid ejecting head applicable to the present invention will be described in detail.

FIG. 2A shows a state before the energy such as electric energy is applied to the heat generating element 2, and therefore, no heat has yet been generated. It should be noted that the movable member 31 is so positioned as to be faced at least to the downstream portion of the bubble generated by the heat generation of the heat generating element. In other words, in order that the downstream portion of the bubble acts on the movable member, the liquid flow passage structure is such that the movable member 31 extends at least to the position downstream (downstream of a line passing through the center 3 of the area of the heat generating element and perpendicular to the length of the flow path) of the center 3 of the area of the heat generating element.

FIG. 2B shows a state wherein the heat generation of heat generating element 2 occurs by the application of the electric energy to the heat generating element 2, and a part of the liquid filled in the bubble generation region 11 is heated by the thus generated heat so that a bubble is generated as a result of film boiling.

At this time, the movable member 31 is displaced from the first position to the second position by the pressure produced by the generation of the bubble 40 so as to guide the propagation of the pressure of the bubble 40 toward the ejection outlet. It should be noted that, as described hereinbefore, the free end 32 of the movable member 31 is disposed in the downstream side (ejection outlet side), and the fulcrum 33 is disposed in the upstream side (common liquid chamber side), so that at least a part of the movable member is faced to the downstream portion of the bubble, that is, the downstream portion of the heat generating element.

FIG. 2C shows a state in which the bubble 40 has further grown. By the pressure resulting from the bubble 40 generation, the movable member 31 is displaced further. The generated bubble grows more downstream than upstream, and it expands greatly beyond a first position (broken line position) of the movable member. Thus, it is understood that in accordance with the growth of the bubble 40, the movable member 31 gradually displaces, by which the pressure propagation direction of the bubble 40, the direction in which the volume movement is easy, namely, the growth direction of the bubble, are directed uniformly toward the ejection outlet, so that the ejection efficiency is increased. When the movable member guides the bubble and the bubble generation pressure toward the ejection outlet, it hardly obstructs propagation and growth, and can efficiently control the propagation direction of the pressure and the growth direction of the bubble in accordance with the degree of the pressure.

FIG. 2D shows a state wherein the bubble 40 contracts and extincts by the decrease of the pressure in the bubble, after the film boiling.

The movable member 31 having been displaced to the second position returns to the initial position (first position) of FIG. 2A by the restoring force provided by the spring property of the movable member per se and the negative pressure due to the contraction of the bubble. Upon the collapse of bubble, the liquid flows back from the upstream (B), namely the common liquid chamber side as indicated by VD1 and VD2 and from the ejection outlet side as indicated by Vc so as to compensate for the volume reduction of the bubble in the bubble generation region 11 and to compensate for the volume of the ejected liquid.

In the foregoing, the description has been made as to the operation of the movable member with the generation of the bubble and the ejecting operation of the liquid. Now, the description will be made as to the refilling of the liquid in the liquid ejecting head of the present invention.

When the bubble 40 enters the bubble collapsing process after the maximum volume after the state of FIG. 2C, a volume of the liquid enough to compensate for the collapsing bubbling volume flows into the bubble generation region from the ejection outlet 18 side of the first liquid flow path 14 and from the common liquid chamber 13 of the second liquid flow path 16.

In the case of conventional liquid flow passage structure not having the movable member 31, the amount of the liquid from the ejection outlet side to the bubble collapse position and the amount of the liquid from the common liquid chamber, are based on the flow resistance of the portion closer to the ejection outlet than the bubble generation region and the portion closer to the common liquid chamber. (Based on the flow resistance and the inertia of the liquid.)

Therefore, when the flow resistance at the supply port side is smaller than the other side, a large amount of the liquid flows into the bubble collapse position from the ejection outlet side with the result that the meniscus retraction is large. With the reduction of the flow resistance in the ejection outlet for the purpose of increasing the ejection efficiency, the meniscus M retraction increases upon the collapse of bubble with the result of longer refilling time period, thus making high speed printing difficult.

According to this arrangement, because of the provision of the movable member 31, the meniscus retraction stops at the time when the movable member returns to the initial position upon the collapse of bubble, and thereafter, the supply of the liquid to fill a volume W2 is accomplished by the flow VD2 through the second flow path 16 (W1 is a volume of an upper side of the bubble volume W beyond the first position of the movable member 31, and W2 is a volume of a bubble generation region 11 side thereof). In the prior art, a half of the volume of the bubble volume W is the volume of the meniscus retraction, but according to this arrangement, only about one half (W1) is the volume of the meniscus retraction.

Additionally, the liquid supply for the volume W2 is forced to be effected mainly from the upstream (VD2) of the second liquid flow path along the surface of the heat generating element side of the movable member 31 using the pressure upon the collapse of bubble, and therefore, more speedy refilling action is accomplished.

When the refilling using the pressure upon the collapse of bubble is carried out in a conventional head, the vibration of the meniscus is expanded with the result of the deterioration of the image quality. However, in high-speed refilling according to this arrangement, the flows of the liquid in the first liquid flow path 14 at the ejection outlet side and the ejection outlet side of the bubble generation region 11 are suppressed, so that the vibration of the meniscus is extremely reduced.

Thus, according to this arrangement applicable to the present application, the high speed refilling is accomplished by the forced refilling to the bubble generation region through the liquid supply passage 12 of the second flow path 16 and by the suppression of the meniscus retraction and vibration. Therefore, the stabilization of ejection and high speed repeated ejections are accomplished, and when the embodiment is used in the field of recording, the improvement in the image quality and in the recording speed can be accomplished.

The arrangement provides the following effective function. It is a suppression of the propagation of the pressure to the upstream side (back wave) produced by the generation of the bubble. The pressure due to the common liquid chamber 13 side (upstream) of the bubble generated on the heat generating element 2 mostly has resulted in force which pushes the liquid back to the upstream side (back wave). The back wave deteriorates the refilling of the liquid into the liquid flow path by the pressure at the upstream side, the resulting motion of the liquid and the inertia force. In this arrangement, these actions to the upstream side are suppressed by the movable member 431, so that the refilling performance is further improved.

The description will be made as to a further characterizing feature and the advantageous effect.

The second liquid flow path 16 of this arrangement has a liquid supply passage 12 having an internal wall substantially flush with the heat generating element 2 (the surface of the heat generating element is not greatly stepped down) at the upstream side of the heat generating element 2. With this structure, the supply of the liquid to the surface of the heat generating element 2 and the bubble generation region 11 occurs along the surface of the movable member 31 at the position closer to the bubble generation region 11 as indicated by VD2. Accordingly, stagnation of the liquid on the surface of the heat generating element 2 is suppressed, so that precipitation of the gas dissolved in the liquid is suppressed, and the residual bubbles not extincted are removed without difficulty, and in addition, the heat accumulation in the liquid is not too much. Therefore, the stabilized bubble generation can be repeated at a high speed. In this arrangement, the liquid supply passage 12 has a substantially flat internal wall, but this is not limiting, and the liquid supply passage is satisfactory if it has an internal wall with such a configuration smoothly extended from the surface of the heat generating element that the stagnation of the liquid occurs on the heat generating element, and eddy flow is not significantly caused in the supply of the liquid.

The supply of the liquid into the bubble generation region may occur through a gap at a side portion of the movable member (slit 35) as indicated by VD1. In order to direct the pressure upon the bubble generation further effectively to the ejection outlet, a large movable member covering the entirety of the bubble generation region (covering the surface of the heat generating element) may be used, as shown in FIGS. 20A to 20D. Then, the flow resistance for the liquid between the bubble generation region 11 and the region of the first liquid flow path 14 close to the ejection outlet is increased by the restoration of the movable member 31 to the first position, so that the flow of the liquid to the bubble generation region 11 from VD1 can be prevented. However, according to the head structure of this arrangement, there is a flow effective to supply the liquid to the bubble generation region, the supply performance of the liquid is greatly increased, and therefore, even if the movable member 31 covers the bubble generation region 11 to improve the ejection efficiency, the supply performance of the liquid is not deteriorated.

Figure 23:
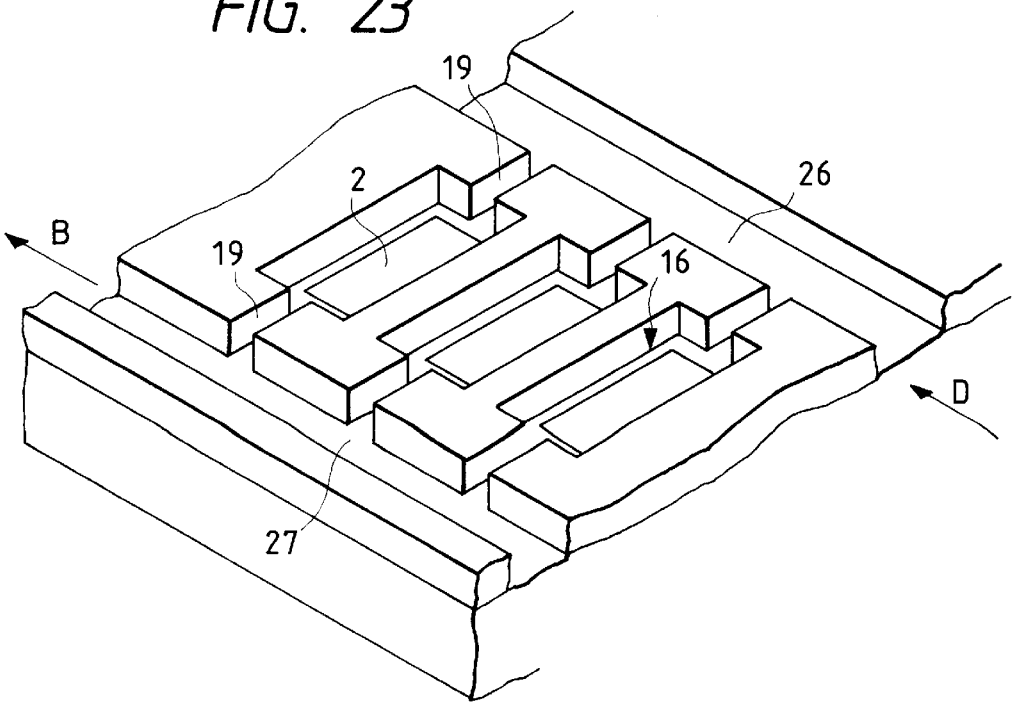
FIG. 23 is a perspective view for explaining a configuration of the second liquid flow paths.

The positional relation between the free end 32 and the fulcrum 33 of the movable member 31 is such that the free end is at a downstream position of the fulcrum as indicated in FIG. 23, for example. With this structure, the function and effect of guiding the pressure propagation direction and the direction of the growth of the bubble to the ejection outlet side or the like can be efficiently assured upon the bubble generation. Additionally, the positional relation is effective to accomplish not only the function or effect relating to the ejection but also the reduction of the flow resistance through the liquid flow path 10 upon the supply of the liquid thus permitting the high speed refilling. When the meniscus M retracted by the ejection as shown in FIG. 23, returns to the ejection outlet 18 by capillary force or when the liquid supply is effected to compensate for the collapse of bubble, the positions of the free end and the fulcrum 33 are such that the flows S1, S2 and S3 through the liquid flow path 10 including the first liquid flow path 14 and the second liquid flow path 16, are not impeded.

More particularly, in this arrangement, as described hereinbefore, the free end 32 of the movable member 31 is faced to a downstream position of the center 3 of the area which divides the heat generating element 2 into an upstream region and a downstream region (the line passing through the center (central portion) of the area of the heat generating element and perpendicular to a direction of the length of the liquid flow path). The movable member 31 receives the pressure and the bubble which are greatly contributable to the ejection of the liquid at the downstream side of the area center position 3 of the heat generating element, and it guides the force to the ejection outlet side, thus fundamentally improving the ejection efficiency or the ejection force.

Further advantageous effects are provided using the upstream side of the bubble, as described hereinbefore.

Furthermore, it is considered that in the structure of this embodiment, the instantaneous mechanical movement of the free end of the movable member 31, contributes to the ejection of the liquid.

The embodiments of the present invention will be explained in detail with reference to the accompanying drawings.

Embodiment 1

The description will be made as to the arrangement of the liquid ejection head according to the present invention.

The ejection principle for the liquid in this embodiment is the same as in the foregoing explanation of the ejection principle. The liquid flow path has a multi-passage structure, and the liquid (bubble generation liquid) for bubble generation by the heat, and the liquid (ejection liquid) mainly ejected, are separated.

Figure 7:
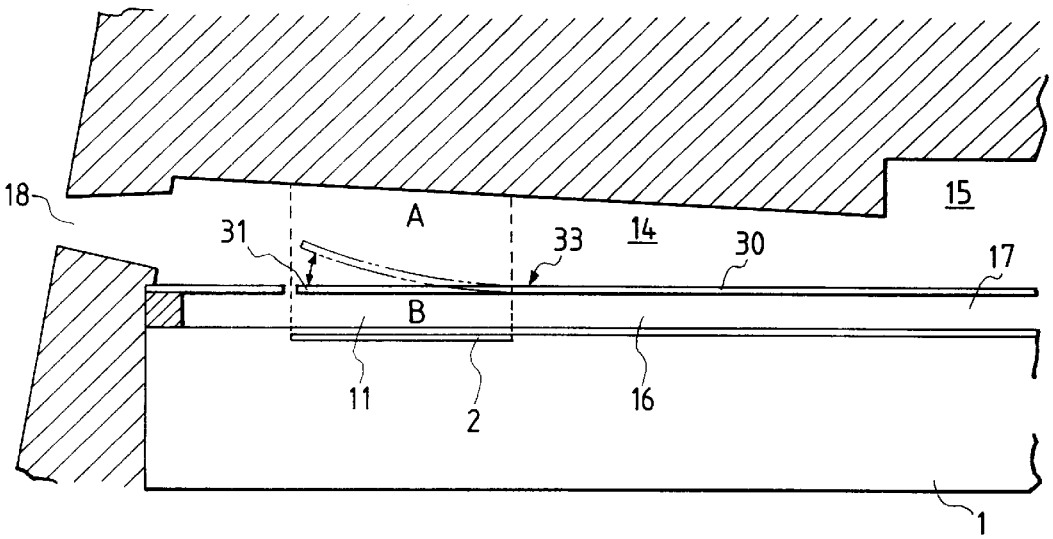
FIG. 7 is a sectional view of a liquid ejecting head according to an embodiment of the present invention.
Figure 8:
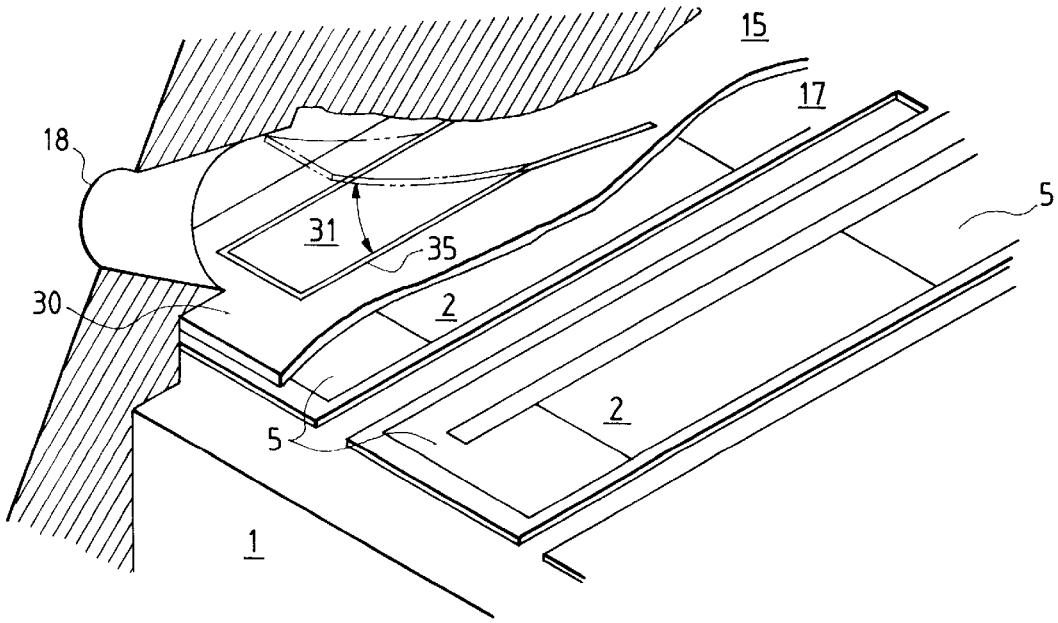
FIG. 8 is a partially broken perspective view of a liquid ejecting head according to an embodiment of the present invention.

FIG. 7 is a sectional schematic view in a direction along the flow path of the liquid ejecting head of this embodiment. FIG. 8 is a partially broken perspective view of the liquid ejection head.

In the liquid ejecting head of this embodiment, a second liquid flow path 16 for the bubble generation is provided on the element substrate 1 which is provided with a heat generation resistance portion as a heat generating element 2 for supplying thermal energy for generating the bubble in the liquid and an electrode wiring for supplying an electrical signal to the heat generation resistance portion, and a first liquid flow path 14 for the ejection liquid in direct communication with the ejection outlet 18 is formed thereabove.

The upstream side of the first liquid flow path is in fluid communication with a first common liquid chamber 15 for supplying the ejection liquid into a plurality of first liquid flow paths, and the upstream side of the second liquid flow path is in fluid communication with the second common liquid chamber for supplying the bubble generation liquid to a plurality of second liquid flow paths.

However, only one common liquid chamber may be provided in case the bubble generation liquid and the ejection liquid are the same.

Between the first and second liquid flow paths, there is a separation wall 30 of an elastic material such as metal so that the first flow path and the second flow path are separated. In the case that mixing of the bubble generation liquid and the ejection liquid should be minimum, the first liquid flow path 14 and the second liquid flow path 16 are preferably isolated by the partition wall. However, when the mixing to a certain extent is permissible, the complete isolation is not inevitable.

A portion of the partition wall in the upward projection space of the heat generating element (ejection pressure generation region including A and B (bubble generation region 11) in FIG. 7), is in the form of a cantilever movable member 31, formed by slits 35, having a fulcrum 33 at the common liquid chamber (15 and 17) side and free end at the ejection outlet side (downstream with respect to the general flow of the liquid). The movable member 31 is faced to the bubble generation region 11B, and therefore, it operates to open toward the ejection outlet side of the first liquid flow path upon the bubble generation of the bubble generation liquid (direction of the arrow in the FIG. 7). The movable member is easiler movable at the fulcrum side than the free end so that the free end may be followed the growth of the bubble and the bubble can be directed to the ejection outlet without any loss. In an example of FIG. 8, too, a partition wall 30 is disposed, with a space for constituting a second liquid flow path, above an element substrate 1 provided with a heat generating resistor portion as the heat generating element 2 and wiring electrodes 5 for applying an electric signal to the heat generating resistor portion.

As for the positional relation among the fulcrum 33 and the free end 32 of the movable member 31 and the heat generating element, are the same as in the previous example.

In the previous example, the description has been made as to the relation between the structures of the liquid supply passage 12 and the heat generating element 2. The relation between the second liquid flow path 16 and the heat generating element 2 is the same in this embodiment.

Figure 9:
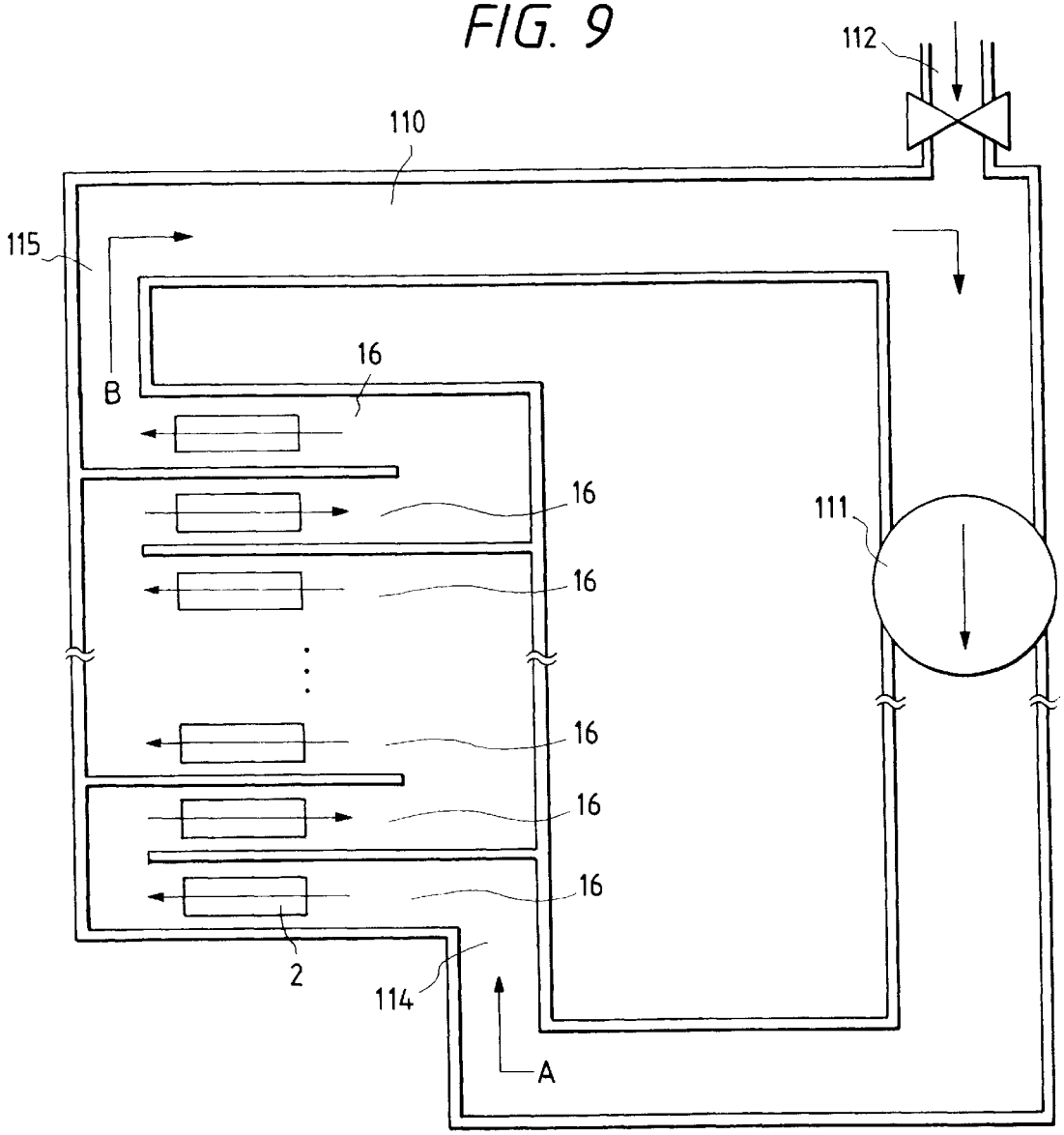
FIG. 9 is a sectional view for explaining a circulation path in which second liquid flow paths of the present invention are connected in series.

FIG. 9 shows the structure of the second flow paths in the two-flow path structure of the present embodiment.

Figure 10:
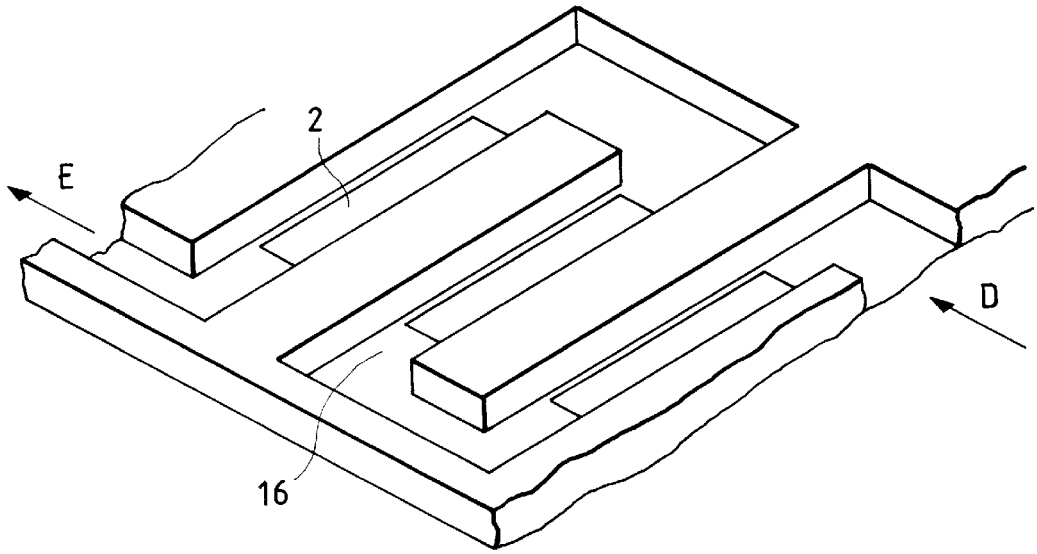
FIG. 10 is a schematic drawing to show a series connection state of the second liquid flow paths.

FIG. 10 is a perspective view to show the structure near the heat generating elements in the second flow paths shown in FIG. 9. The movable members and first liquid flow paths are positioned in correspondence to their associated heat generating elements, as described above.

In FIG. 9 showing the present embodiment, the second liquid flow paths 16 provided with respective heat generating elements 2 are connected in series to form a zigzag line of liquid flow path.

A first inlet/outlet path 114 and a second inlet/outlet path (a guide path for guiding the liquid out in this embodiment) 115 at the both ends of the liquid flow path are connected by a circulation passage 110, thereby constituting a loop liquid circulation path. In the present embodiment the first liquid inlet/outlet path 114, the second liquid inlet/outlet path 115, and the circulation passage 110 compose a guide path. On the way of the circulation passage 110 there is provided a pump 111 as forcible flow means for flowing the liquid in the circulation passage and flowing the liquid in the second liquid flow paths 16.

This pump 111 feeds the liquid flowing in the direction A from the circulation passage 110 through the first liquid inlet/outlet path 114 to the second liquid flow paths 16. The liquid flows in a zigzag line in the second liquid flow paths 16 in order and proceeds to the second inlet/outlet path 115 to return through the circulation passage 110 to the pump. Here, the liquid circulation path may be constructed so as to pass via a second common liquid chamber 17 as described hereinlater.

Numeral 112 designates a second liquid supply portion for refilling of liquid to the second liquid flow paths 16 on the way of the circulation passage 110 or in the second common liquid chamber 17, whereby the liquid can be supplied in a necessary amount into the second flow paths 16 if the liquid is consumed by a slight amount in ejecting the liquid in the first liquid flow paths.

When the liquid in the first liquid flow paths 14 is the same as the liquid in the second liquid flow paths 16, for example as shown in FIG. 7, a communicating portion (not shown) piercing at least a part of the partition wall 30 may be formed instead of the second liquid supply portion 112.

The present embodiment will be explained in further detail.

Figure 11A:
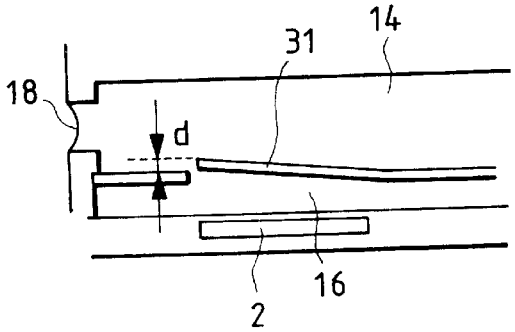
FIGS. 11A and 11B are schematic drawings for explaining the operation of the present invention.
Figure 11B:
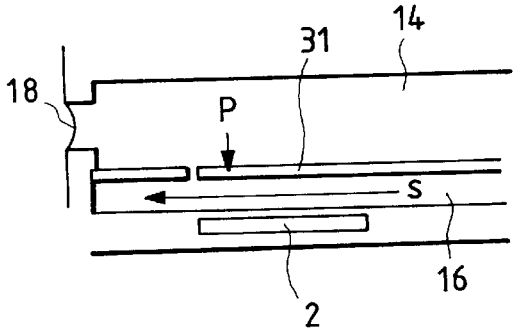

FIGS. 11A and 11B are sectional views of a liquid ejecting nozzle and neighboring portions in FIG. 9 showing the present embodiment.

The basic structure is the same as that in FIGS. 2A and 2B in the description of the operational principle, but the second liquid flow paths 16 of FIGS. 11A and 11B are constructed in the structure of FIG. 9 as connected on the upstream side and on the downstream side so as to form a circulation system. The movable member 31 is displaced to the side of the first flow path 14 by the bubble, as shown in the description of the previous operational principle. Therefore, when the movable member 31 is repeatedly operated for a long period, the fulcrum 33 of the movable member 31 will have strain d shown in FIG. 11A, though it is small. Since this occurs after long-term operation, it could be a problem only if an extremely-long-life liquid ejecting head is desired.

When the pump 111 of FIG. 9 flows the liquid in the second liquid flow paths 16 like the flow s in FIG. 11B, the pressure in the second liquid flow paths 16 becomes lower than the pressure in the first liquid flow paths 14. This occurs by the same principle as the operational principle of Pitot tube, and the movable member 31 is subject to the force acting in the direction P. This force acts in the direction to correct the strain d.

Accordingly, to flow the liquid in the second liquid flow paths 16 can correct the strain d of the movable members 31 and can maintain stable performance even after long-term use of head.

By setting a cross-sectional area of the circulation passage 110 as a guide path larger than a cross-sectional area of each second liquid flow path 16 and connecting the second liquid flow paths 16 in series in the present embodiment, the flow rate can be increased in the second liquid flow paths 16 so as to effectively demonstrate the effect described above.

Thus, the forcible liquid circulation may be arranged to effect only in the cases where the strain d as discussed occurs.

Embodiment 2

Figure 12:
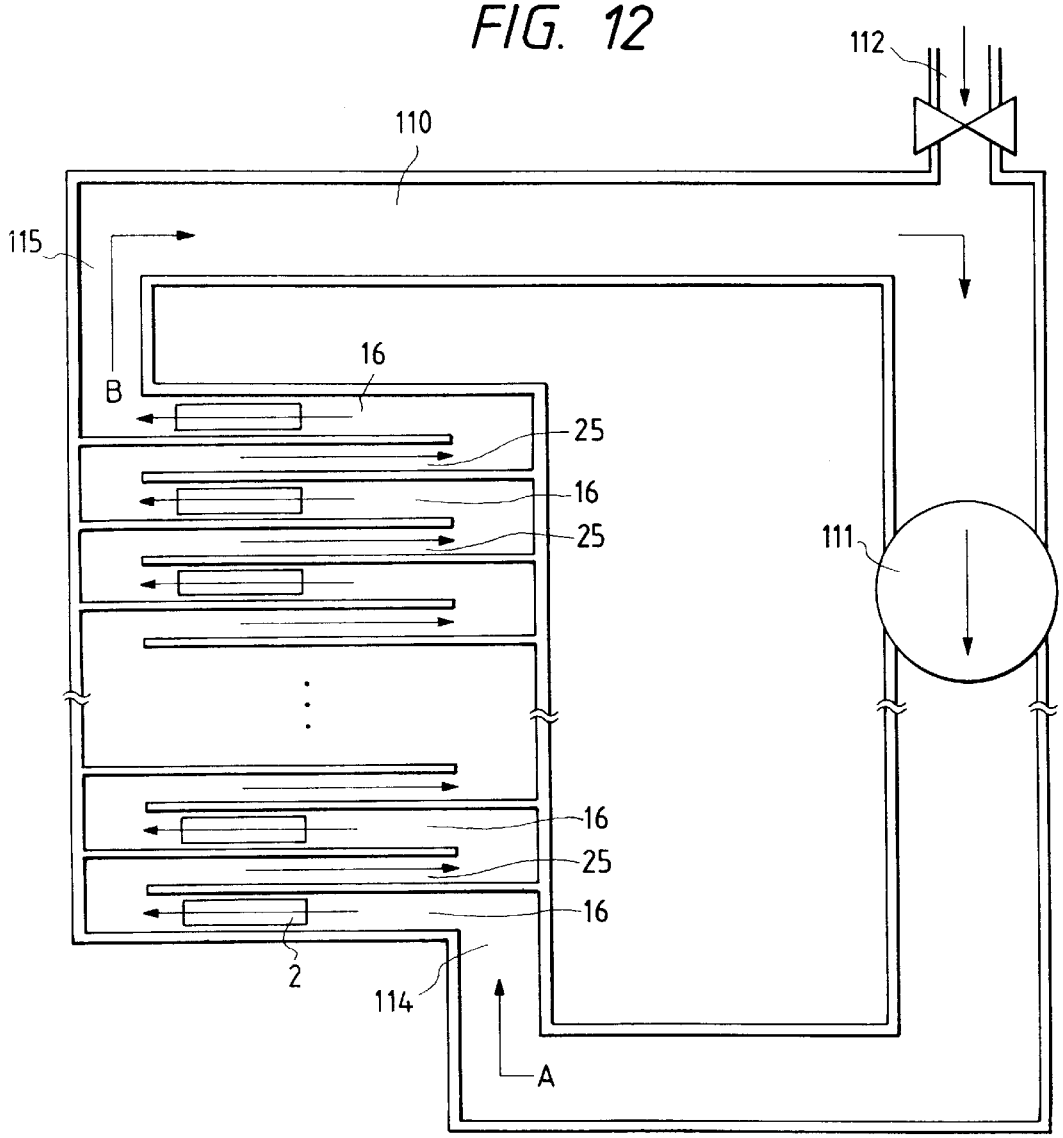
FIG. 12 is a sectional view for explaining another circulation path in which second liquid flow paths of the present invention are connected in series.

FIG. 12 is a drawing to show a modification of the structure of FIG. 9 as to connection of the second liquid flow paths 16, wherein the liquid flows in a same direction in the second liquid flow paths 16 with respect to the positional relation between the free end 32 and the fulcrum 33 of each movable member 31. Also in the present embodiment, the first inlet/outlet path 114, the second inlet/outlet path 115, and the circulation passage 110 compose a guide path.

There are some cases where a pressure difference occurs between in the first liquid flow paths 14 and in the second liquid flow paths 16 when they have opposite flow directions with respect to the positional relation between the free end 32 and the fulcrum 33 of each movable member 31, depending upon the configuration thereof. In contrast, the structure of the present embodiment can effect the same correction for the strain d of each movable member 31 because the liquid flow acts on each movable member 31 under the same condition. This enables to prevent variations in ejection performance between the nozzles.

Embodiment 3

Figure 13:
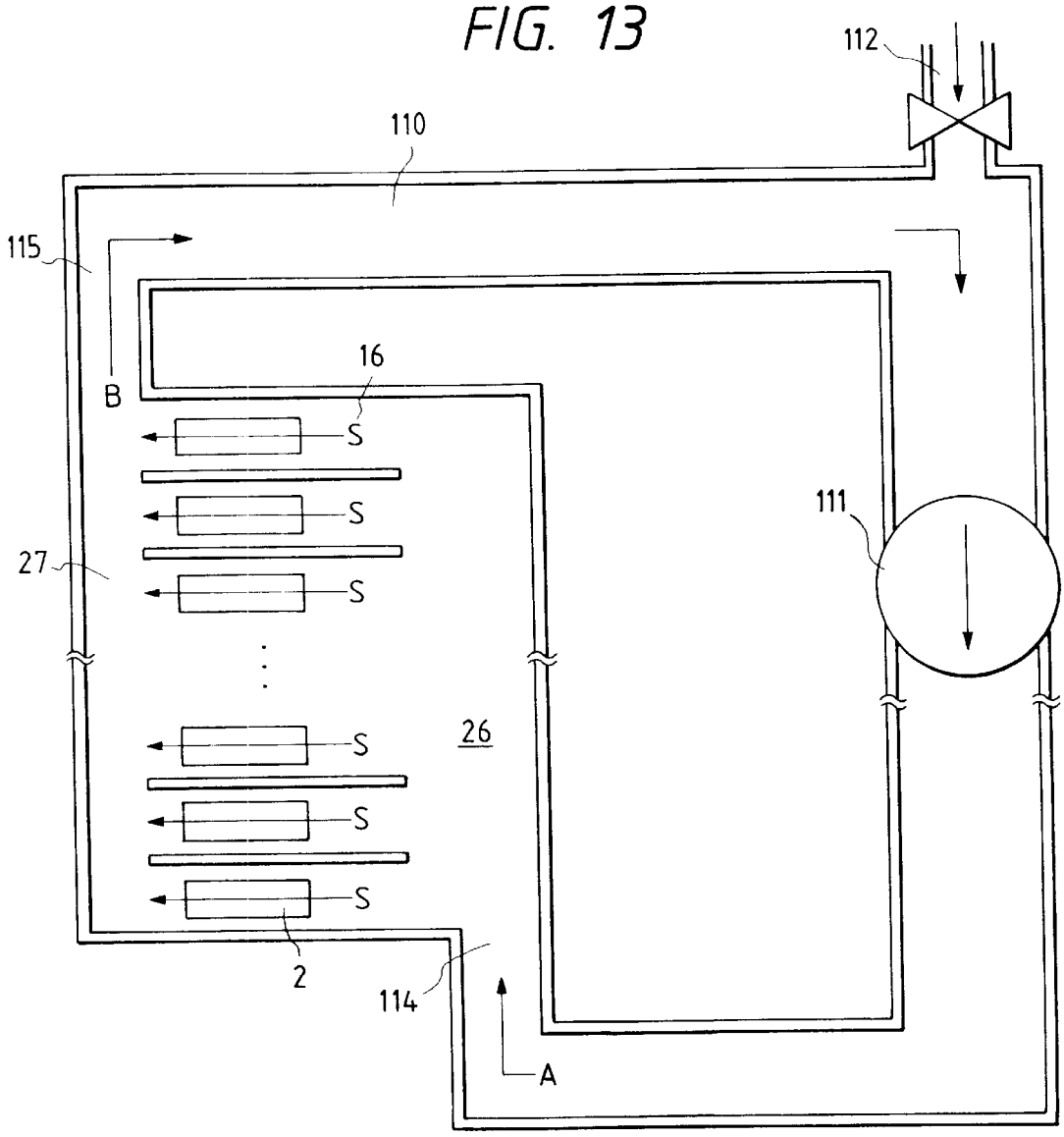
FIG. 13 is a sectional view for explaining a circulation path in which second liquid flow paths of the present invention are connected in parallel.

FIG. 13 shows a modification of the structure of FIG. 9 as to connection of the second liquid flow paths 16.

Figure 14:
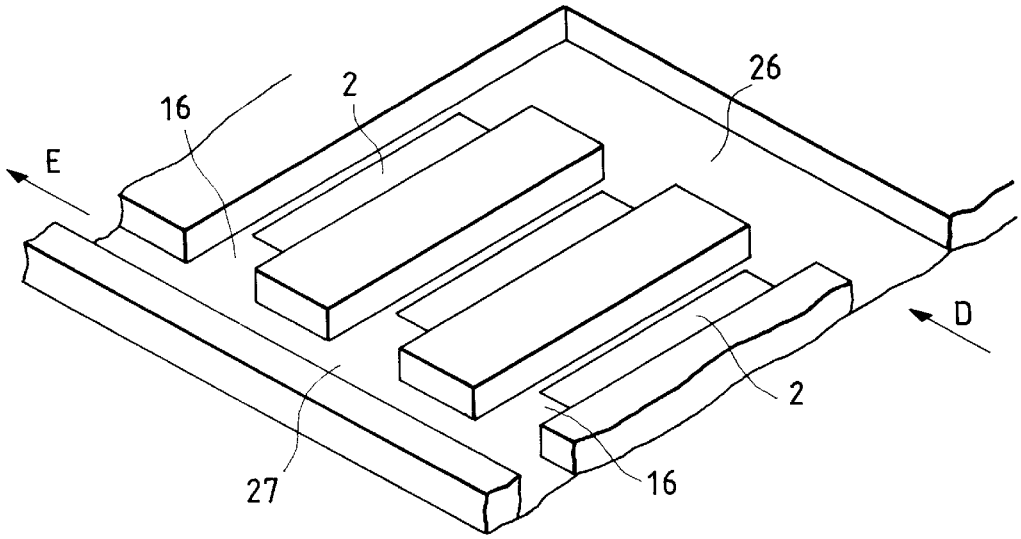
FIG. 14 is a schematic drawing to show a parallel connection state of the second liquid flow paths.

FIG. 14 is a perspective view of the second liquid flow paths near the heat generating elements 2 in FIG. 13. The present embodiment is of a parallel connection structure of a flow path configuration in which the upstream ends of second liquid flow paths are connected to each other and the downstream side ends thereof are also connected to each other with respect to the flow of the liquid toward the ejection outlets in the second liquid flow paths. The other portions are the same as those in the structure of Embodiment 1. A flow path portion connecting the upstream side ends is the first inlet/outlet path 114, which is connected to the circulation passage 110. A flow path portion connecting the downstream side ends is the second inlet/outlet path 115, which is connected to the circulation passage 110. The pump 111 as forcible flow means is provided in the circulation passage 110 to flow the liquid in the second liquid flow paths 16. In the present embodiment, the first inlet/outlet path 26, 114, the second inlet/outlet path 27, 115, and the circulation passage 110 compose a guide path.

The structure of the present embodiment can also achieve the same effects as in the foregoing embodiments, but the present embodiment can obtain particularly effective effect as explained below.

Figure 15A:
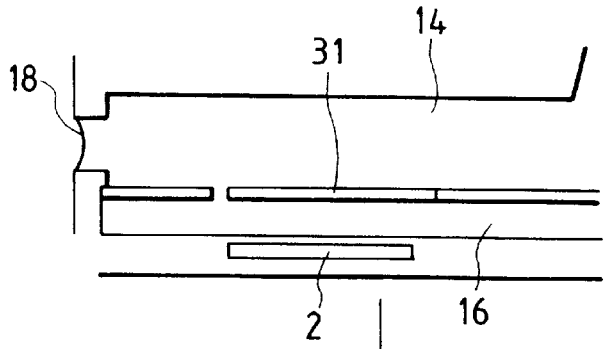
FIGS. 15A to 15D are schematic drawings for explaining the operation of the present invention.
Figure 15B:
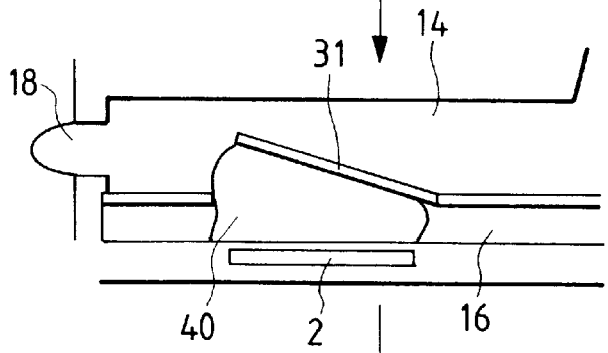
Figure 15C:
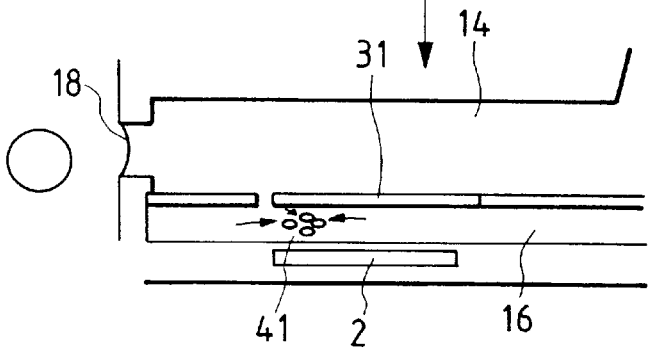
Figure 15D:
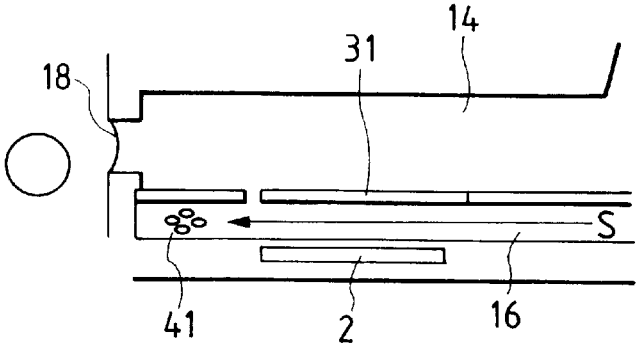

FIGS. 15A to 15D show a cycle between generation and collapse of bubble by the heat generating element 2 in the liquid ejection operation, in which the second flow path 16 exists in the circulation flow path shown in FIG. 13. A period of from generation of bubble to collapse of bubble as shown in FIG. 15C is usually approximately ten and several $\mu$s to several tens $\mu$s, and at the point of FIG. 15C residual bubbles 41 exist near the heat generating element 2. These bubbles also exist similarly in the conventional bubble jet head, and are bubbles or the like separating out when gas solved in the liquid subjected to bubble generation is heated. The time period before these bubbles dissolve again into the liquid ranges from several hundred $\mu$s even to several ms. It is possible to start the next liquid ejection operation while the residual bubbles 41 still exist. It is, however, known that with more residual bubbles 41 there occurs the dispersion in the size of bubble 40 generated with heat by the heat generating element 2 and the residual bubbles 41 absorb the bubble generation pressure of the bubble 40. These phenomena will degrade the ejection stability and ejection efficiency. However, when the liquid in the second liquid flow path is made to flow in the direction s by the circulation liquid path structure and pump of the present invention as shown in FIG. 15D, the residual bubbles 41 above and near the heat generating element 2 can be removed to bring the liquid state into the initial state sooner. Thus, even if the time before start of the next bubble generation operation is shortened, stable ejection performance can be realized. This effect can also be achieved by the structures of the foregoing embodiments, but the structure of the present embodiment is very effective in the sense of freedom of control. The liquid flow in the second liquid flow path 16 may be effected immediately after the time of collapse of bubble in FIG. 15C, but the same effect can be achieved also when it is effected during the liquid ejection operation shown in FIGS. 15B to 15C. Further, the same effect can also be achieved by flowing the liquid in the opposite direction to the flow direction s by operating the pump 111 in the opposite direction.

Particularly, when the flow is made during the liquid ejection operation, the following effect is attained.

Figure 16A:
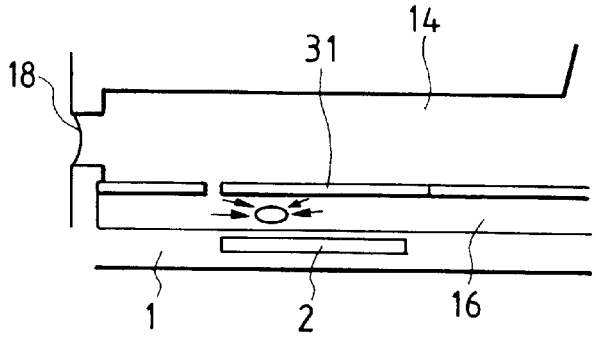
FIGS. 16A to 16D are schematic drawings for explaining the operation of the present invention.
Figure 16B:
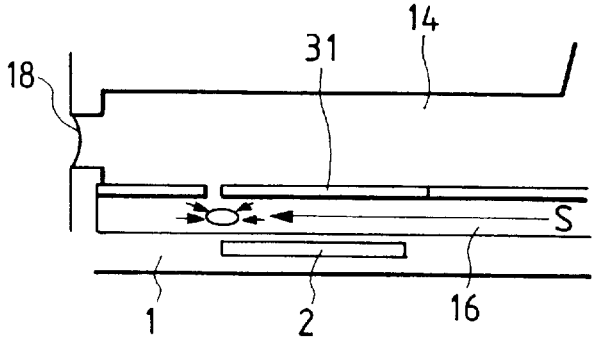
Figure 16C:
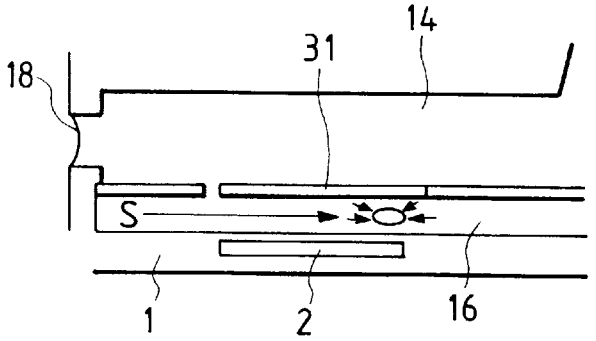
Figure 16D:
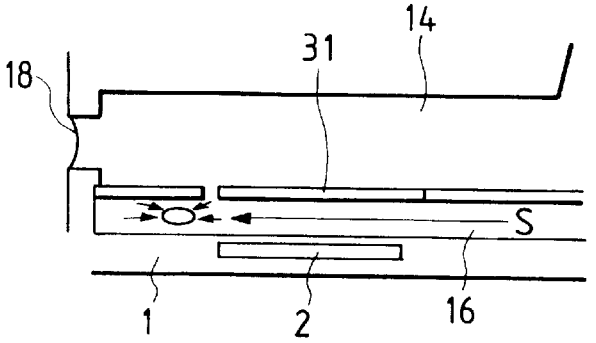

FIGS. 16A to 16D show states at the moment of bubble collapse in the liquid ejection operation cycle. FIG. 16A shows a case in which there is no flow in the second liquid flow path 16 during the liquid ejection operation. In this case, the position of collapse of bubble is not changed and is located above the heat generating element 2 in the nozzle structure of the present embodiment. Accordingly, a damage on the heat generating element 2 due to cavitation occurring upon collapse of bubble occurs nearly at the same place. After long-term operation, the heat generating element 2 or a protection layer thereof will be finally broken at that position. If the liquid in the second liquid flow path 16 is made to flow during the ejection operation by the pump 111 as in FIGS. 16B to 16D, the position of bubble collapse as discussed above can be changed. FIG. 16B shows an example in which the position of bubble collapse is moved to the downstream of the flow in the ejection direction by the flow in the directions, and FIG. 16C shows an example in which the position of bubble collapse is moved to the upstream by the flow in the direction s. As described, the places of bubble collapse can be scattered by flowing the liquid in the second liquid flow path or changing the amount or direction of flow by the circulation passage 110 and pump 111 during the liquid ejection operation, whereby the damage due to cavitation on the heat generating element 2 can be scattered so as to lengthen the life of heat generating element. Further, FIG. 16D shows an example of a larger flow amount to move the position of bubble collapse out of the region above the heat generating element 2, thereby eliminating almost all damage due to cavitation on the heat generating element 2. This decreases the breaking mode of the heat generating element 2 due to the cavitation, thereby greatly extending the life of heat generating element.

Embodiment 4

Figure 17:
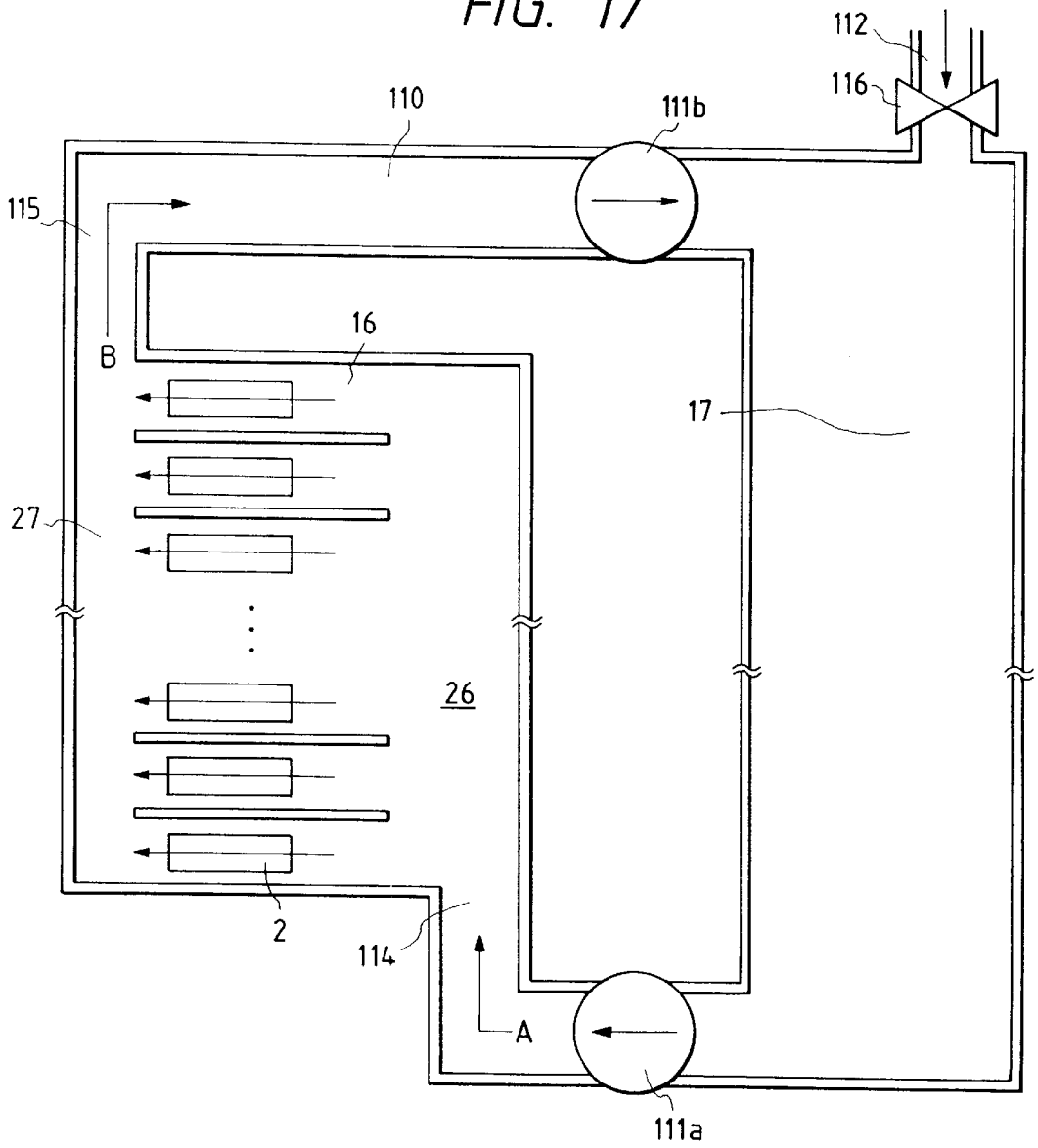
FIG. 17 is a schematic drawing for explaining an example having two pumps in a guide path.

FIG. 17 shows a drawing for explaining Embodiment 4 as another structure of the circulation passage 110. In the present embodiment the circulation passage 110 is routed via the second common liquid chamber 17. There are pump 111*a* and pump 111*b* disposed on the side of the first inlet/outlet path 114 and on the side of the second inlet/outlet path 115, respectively. Since the other structure is the same as that of Embodiment 3, the detailed description thereof is omitted herein. In the present structure, routing of the circulation passage 110 via the second common liquid chamber 17 can make states of the liquid in the second liquid flow paths more uniform. For example, since the heat generating elements are disposed in the second liquid flow paths 16, temperature rise is extreme near the heat generating elements. This temperature rise sometimes changes physical properties including the viscosity or the like of the liquid in the second liquid flow paths 16 so as to make the ejection state nonuniform. When the liquid in the circulation passage 110 is circulated by the pump 111*a* or 111*b*, the state of the entire liquid can be made uniform so as to stabilize the ejection performance, because the volume of the liquid in the second common liquid chamber 17*a* is greater than the volume of the liquid in the second liquid flow paths 16. The circulation liquid path may be located in the head, or may be formed with a tube or the like outside the head.

Embodiment 5

Figure 18:
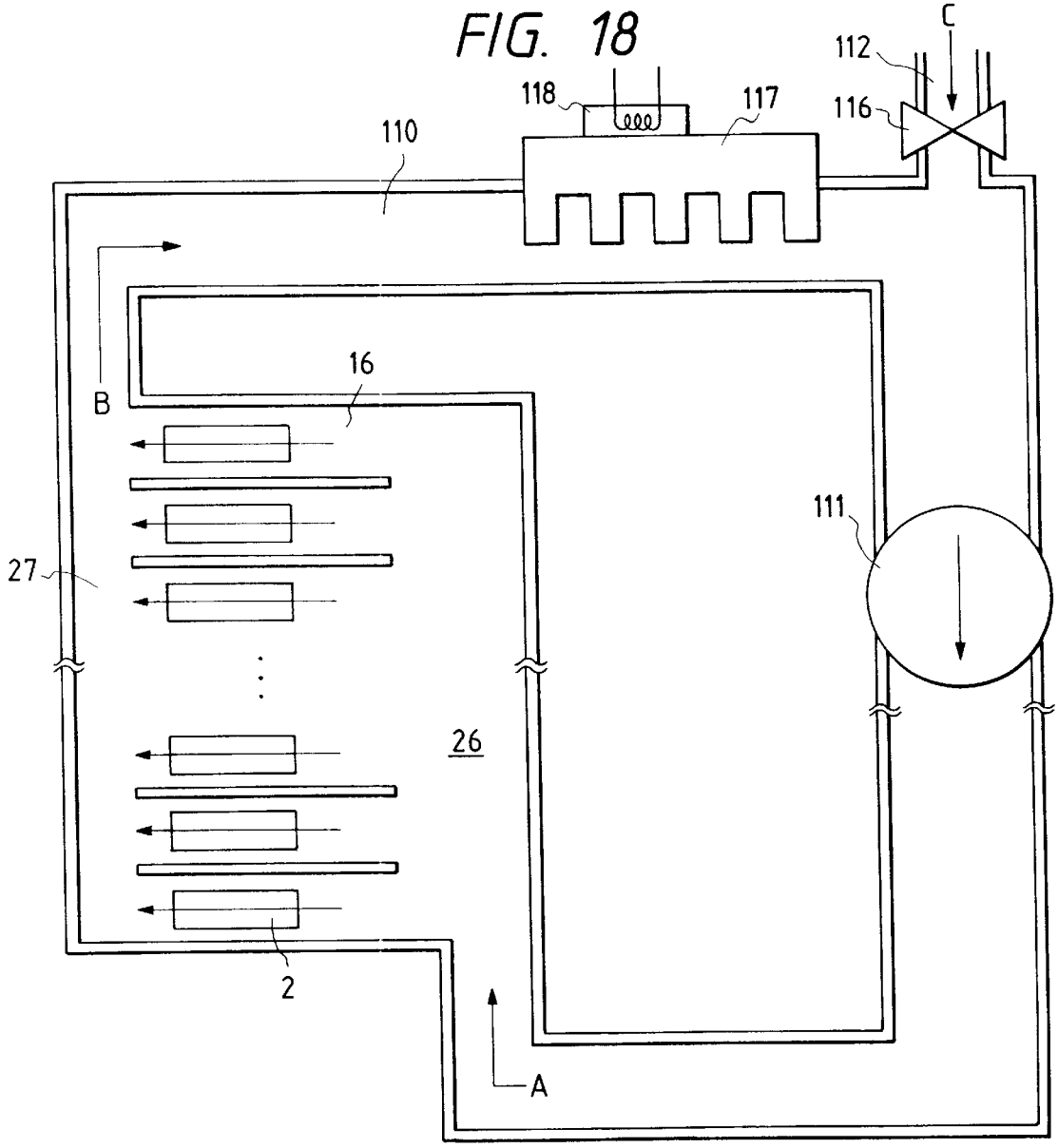
FIG. 18 is a schematic drawing for explaining an example including heat conversion means in a guide path.

FIG. 18 shows the structure of Embodiment 5. In the structure of FIG. 18 a heat conversion means having a heat conversion function is basically provided on the way of the circulation passage 110 or on the way of the structure of the circulation path. Since the other portions are the same as in the structure of FIG. 13, the description thereof is omitted herein.

The present embodiment shows an example of the heat conversion means, which is a fin 117 having the heat radiation effect to radiate the heat of the liquid to the outside. Since the bubble jet head employs the method for heating the liquid to generate a bubble and ejecting the liquid by the bubble generation pressure, the temperature of the heat generating element 2 increases the temperature of the head itself and the temperature of the liquid used for ejection, which could be a factor to degrade the stability of liquid ejection, for example to change the ejection amount. In particular, the recent technological trend is development of multiple nozzle arrangement, high frequency drive, or the like in order to raise the printing speed, which will greatly degrade the stability of liquid ejection. Against such a factor to promote the temperature rise, the present embodiment employs the circulation passage 110 and pump 111 to move the liquid near the heat generating elements 2 during the recording operation or immediately before and after the recording operation, whereby the heat can be efficiently radiated by the fin 117 so as to enhance the stability of liquid ejection. Points to realize the high stability of liquid ejection with very high efficiency in the present embodiment are as follows.

A first point is to move the liquid itself, particularly the liquid near the heat generating elements, which was not easy to radiate heat because of the structure in the conventional heads, directly influencing the ejection characteristics directly to the fin 117 to radiate the heat. Another point is to cool the heat generating elements 2 themselves with the liquid. A further point is to circulate the liquid also during the ejection operation to radiate the heat. Based on these points, the invention established the ejection stabilizing technology by heat radiation with very good efficiency, which was not achieved by the conventional technology.

Incidentally, the foregoing description concerned the technology of heat radiation of the head itself, but the following heating effect can also be achieved by providing the fin 117 in the same structure with a heating heater 118. Namely, when the head is used under a low-temperature environment, there occurs phenomena that the ejection amount decreases on the contrary and a non-ejecting nozzle occurs. In that case, the fin 117 is heated by the heating heater 118 to directly raise the temperature of the liquid directly contributing to the generation of bubble and the liquid can be fed up to the heat generating elements, whereby the same effects can be efficiently attained as the points of effects in the case of heat radiation as described above. In addition, because the heating operation is carried out as circulating the liquid, there occurs no bubble due to a local increase of temperature of the liquid, and the liquid can reach an appropriate temperature within a short time of period.

In the present embodiment as explained above, the fin 117 is arranged in a technique for raising the efficiency, for example in a technique to increase the surface area with fins or with bumps and recesses on the surface in contact with the liquid. For moderately controlling the temperature, the circulation passage 110 or the like may be provided with a temperature detection element (not shown).

Embodiment 6

Figure 19:
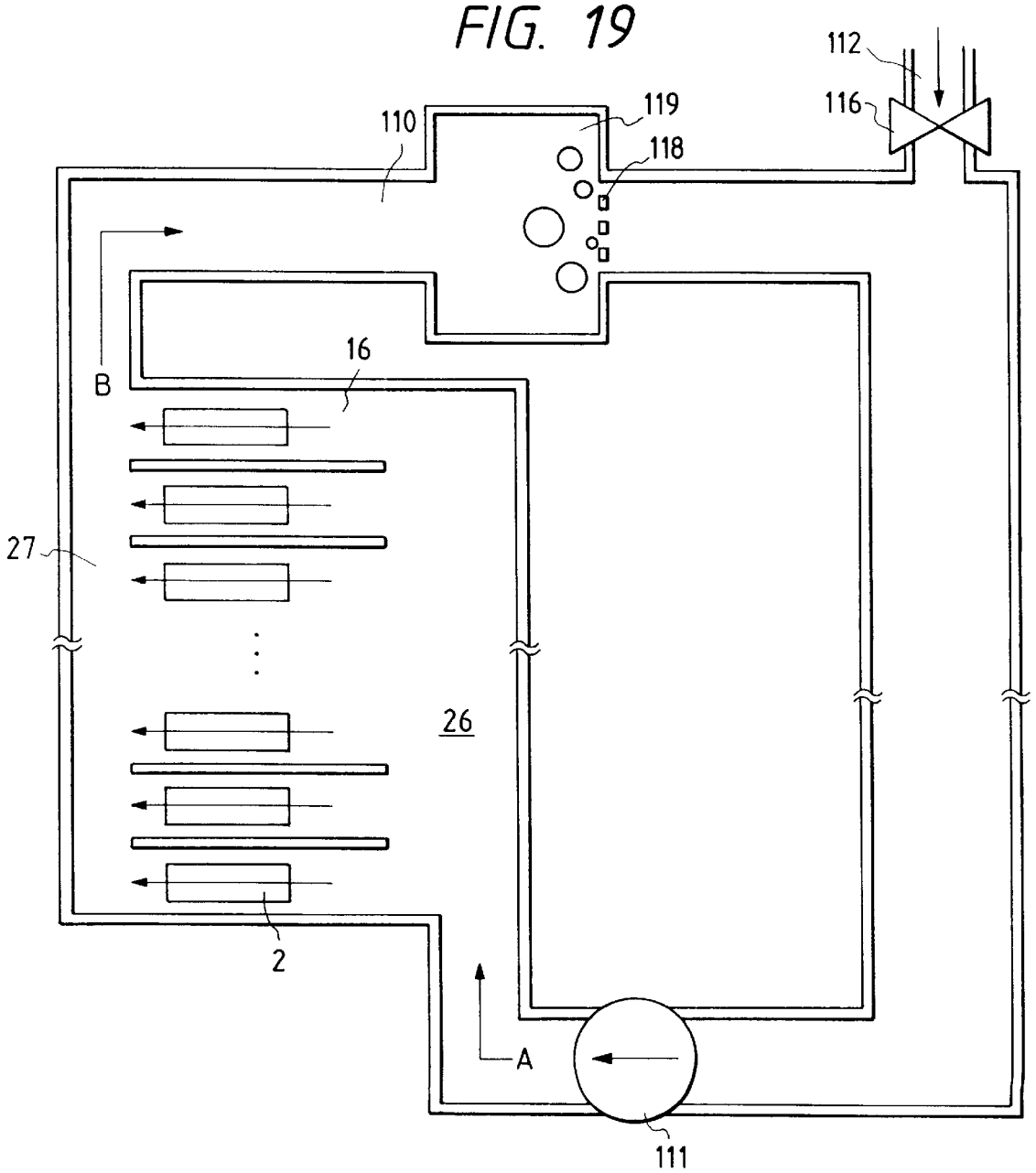
FIG. 19 is a schematic drawing for explaining an example including a bubble reservoir in a guide path.

FIG. 19 shows the structure of Embodiment 6.

The present embodiment is provided with a bubble reservoir 119 and a small-hole portion 118 on the way of the circulation passage 110 in the structure shown in FIG. 13. The portions in the same structure as in FIG. 13 are omitted to explain herein.

Bubbles dissolving in the liquid sometimes separate out after left for a long time or the like in the liquid path, i.e., in the second liquid flow paths 16, the second common liquid chamber 26, or the circulation passage 110. On such occasions, the liquid is circulated in the circulation passage 110 to transport the bubbles separating out to the predetermined place to trap them, which can prevent ejection failure or disturbance of ejection due to the bubbles. The bubble reservoir 119 and small-hole portion 118 (filter) function to trap the bubbles. The bubbles appearing in the second liquid flow paths 16 are circulated by the pump 111 to be transported to the small-hole portion 118. The size of small holes 118 is determined so as not to give an unstable effect on the ejection and so as to let small bubbles pass. Bubbles are trapped in the bubble reservoir 119. The bubbles stored in the bubble reservoir 119 can be taken out of the head by a known method. The present embodiment reduces a number of disposal times to wastefully dispose the liquid as much as possible, and enables to maintain a good ejection state.

Embodiment 7

Figure 20:
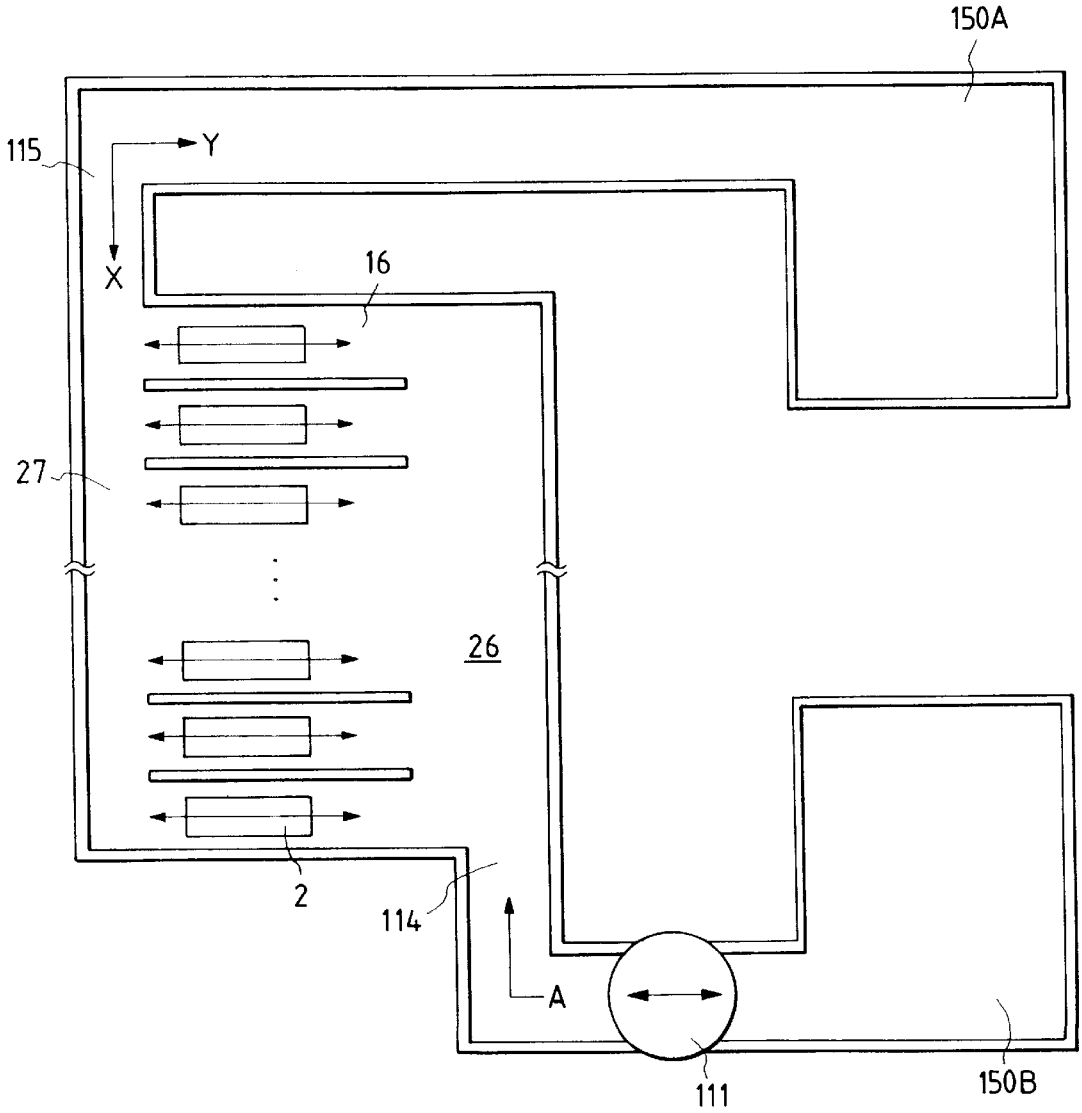
FIG. 20 is a schematic drawing for explaining a configuration having liquid storing portions.

FIG. 20 shows the structure of another embodiment of the present invention.

The present embodiment shows an example for connecting two liquid storing portions 150 to the respective inlet/outlet paths without using a circulation passage. For example, the liquid in the liquid storing portion 150A is first made to flow to the liquid storing portion 150B by the pump 111 as forcible flow means, and at this time the liquid flows in each second liquid flow path 16 from the side of the inlet/outlet path 115, 27 to the side of the inlet/outlet path 26, 114.

When the liquid in the liquid storing portion 150A becomes zero or little, the operation of the pump 111 is switched so as to make the liquid reversely flow from the liquid storing portion 150B toward the liquid storing portion 150A.

Figure 21:
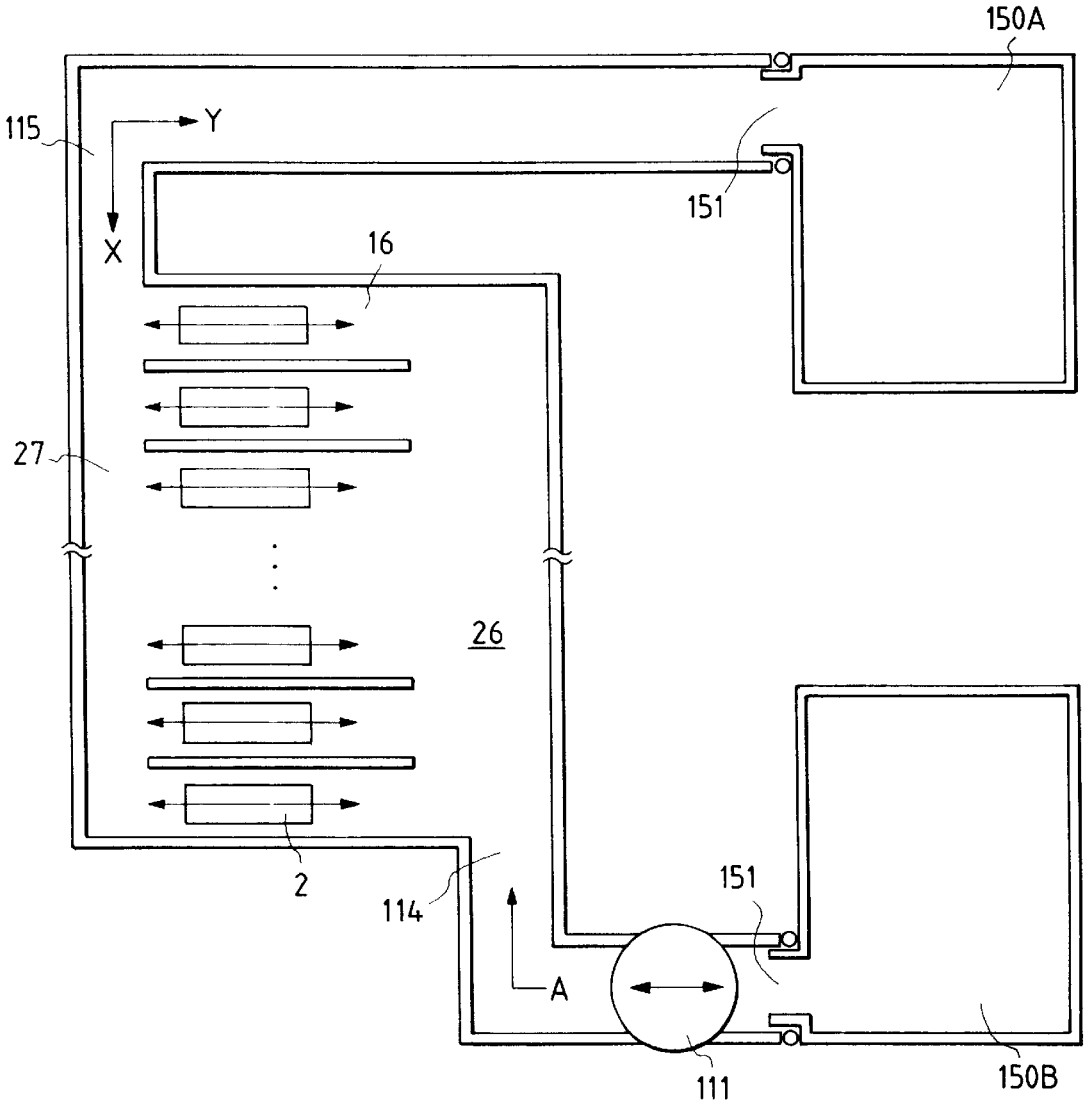
FIG. 21 is a schematic drawing for explaining a configuration in which liquid storing portions are detachable.

FIG. 21 is a drawing to illustrate an improved form of the present embodiment, in which the liquid storing portions 150A and 150B as described above are arranged as detachable from connecting portions 151.

Accordingly, after the liquid in the liquid storing portion 150A is moved to the liquid storing portion 150B, the storing portions 150A, 150B can be detached and exchanged. This arrangement permits the liquid to flow always in one direction.

Examples applicable to the present invention will be explained.

<Configuration of second liquid flow path>

Figure 22A:
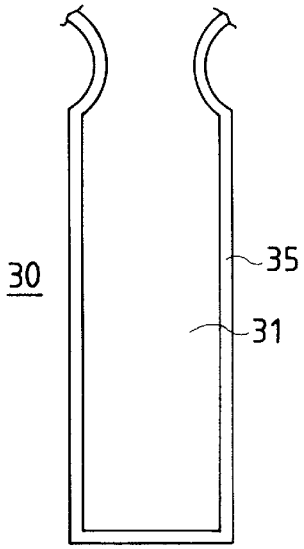
FIGS. 22A to 22C are drawings for explaining a positional relation between a second liquid flow path and a movable member.
Figure 22B:
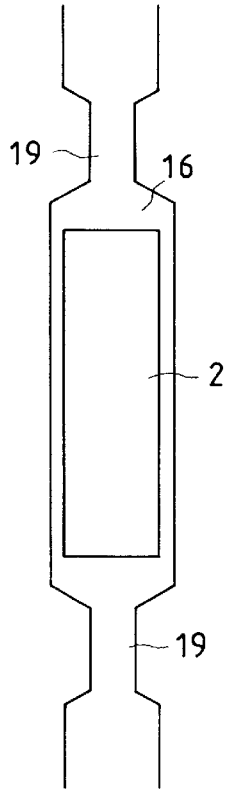
Figure 22C:
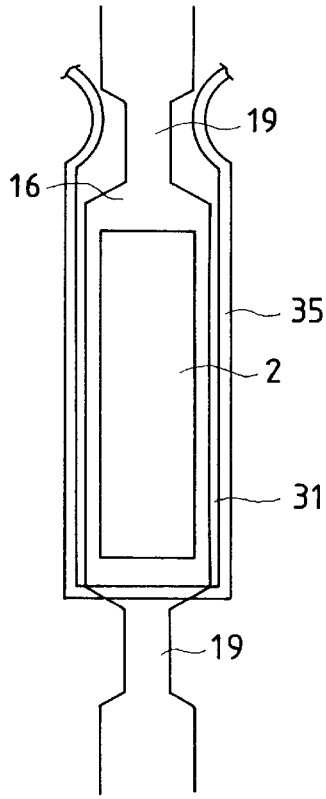

FIGS. 22A to 22C are drawings for explaining the positional relation between the movable member 31 and the second liquid flow path 16 as explained above, wherein FIG. 22A is a top plan view of the partition wall 30, the movable member 31, and their neighborings, FIG. 22B a top plan view of the second liquid flow path 16 when the partition wall is taken away, and FIG. 22C a drawing to schematically show the positional relation between the movable member 6 and the second liquid flow path 16 as overlaid. In either drawing, the bottom side is the front side where the ejection outlet is positioned.

The second liquid flow path 16 of the present embodiment has throat portions 19 near the end of the heat generating element 2 closer to the ejection outlet and near the opposite end thereto, thereby forming such a chamber (bubble generation chamber) structure that the pressure upon generation of bubble can be prevented from readily escaping to the upstream side of the second liquid flow path 16.

In the case of the convention head wherein the flow path where the bubble generation occurred and the flow path from which the liquid was ejected, were the same and wherein a throat portion was provided so as to prevent the pressure generated by the heat generating element toward the liquid chamber from escaping into the common liquid chamber, it was necessary to employ such a structure as the cross-sectional area of a flow path in the throat portion was not too small, taking sufficient refilling of the liquid into consideration.

However, in the case of this embodiment, much or most of the ejected liquid is the ejection liquid in the first liquid flow path, and the bubble generation liquid in the second liquid flow path having the heat generating element is not consumed much, so that the filling amount of the bubble generation liquid to the bubble generation region 11 of the second liquid flow path may be small. Therefore, the clearance at the throat portion 19 can be made very small, for example, as small as several $\mu$m to ten and several $\mu$m, so that the release of the pressure produced in the second liquid flow path upon generation of bubble can be further suppressed and the pressure may be concentrated onto the movable member. The pressure can be used as the ejection pressure through the movable member 31, and therefore, the higher ejection efficiency and ejection force can be accomplished. The configuration of the second liquid flow path 16 is not limited to the one described above, but may be any if the pressure produced by the bubble generation is effectively transmitted to the movable member side.

FIG. 23 is a perspective view to show the structure of throat portions given to the second liquid flow paths constituting the circulation liquid flow path.

Figure 24:
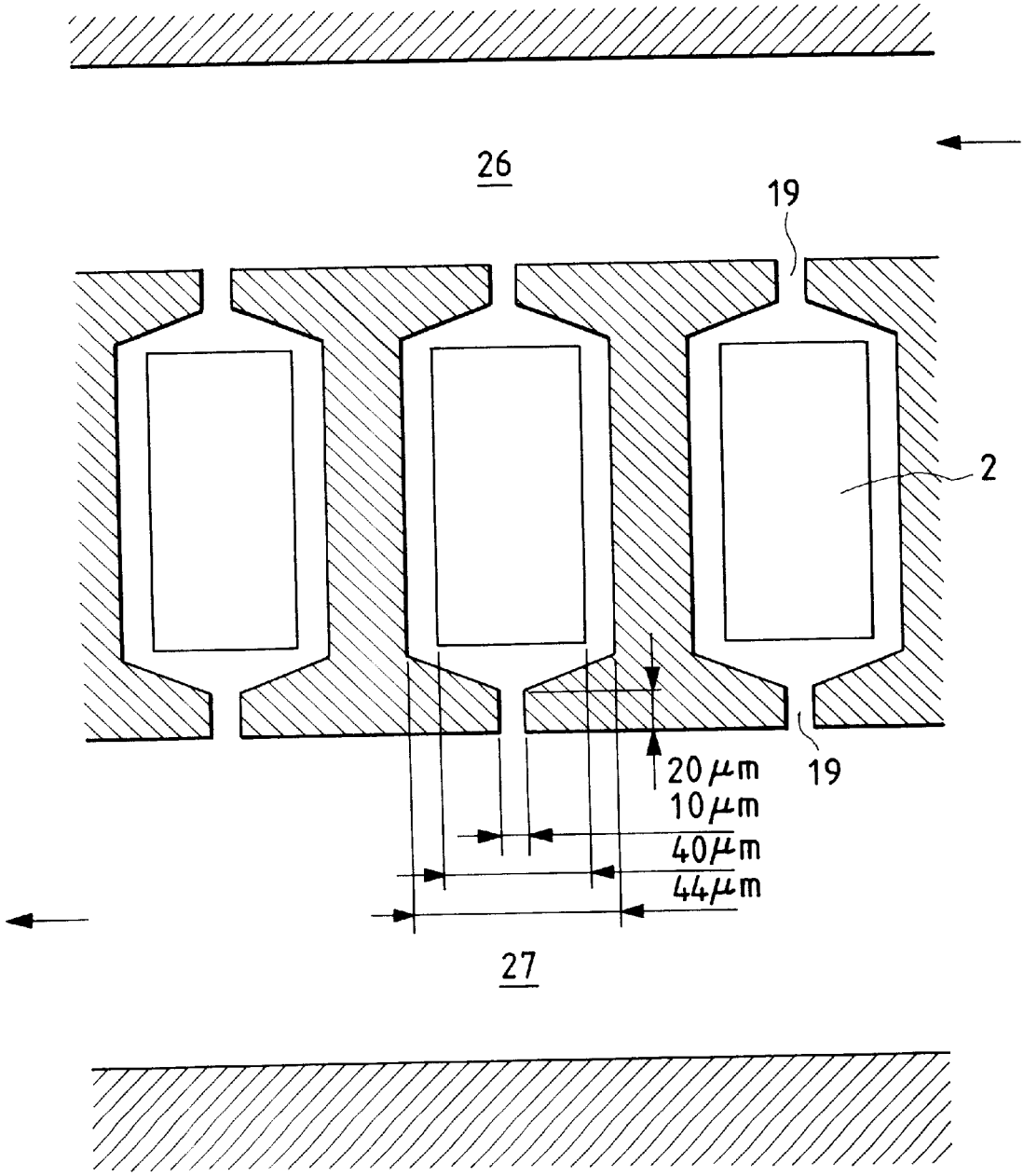
FIG. 24 is a drawing for explaining a configuration of the second liquid flow paths.

FIG. 24 shows an example of dimensions of the heat generating elements and the circulation system, but it should be noted that the dimensions and configuration are not limited to this example. On the contrary, they may be arbitrarily determined as long as the configuration can stop the release of the pressure in the horizontal direction with respect to the surface of heat generating element, can readily transmit the bubble generation pressure in the vertical direction, and can permit easy refilling of the bubble-forming liquid.

For example, portions narrower than the width of the heat generating elements may be tapered on the flow-in side and on the flow-out side of the second liquid flow path so as to facilitate refilling of the bubble-forming liquid, or the configuration inside the second liquid flow path may be so oval as to match with the shape of the bubble.

As explained, because the present embodiment is arranged so that the flow path configuration of the second liquid flow path near the end of the heat generating element 2 closer to the ejection outlet and near the opposite end is narrower than the other portion of the flow path, it becomes easier to transmit the bubble generation pressure to the movable member and possible to raise the ejection efficiency. It is noted that the configuration of the second liquid flow path 16 is not limited to the above structures, but may be any as long as the pressure produced by generation of bubble can effectively be transmitted to the movable member side.

The above throat portions are arranged so as to locate the throat portions 19 narrowed in the arrangement direction, in which the plural bubble generation flow paths are arranged, at the positions corresponding to the vicinity of the start ends and to the vicinity of the terminal ends of ejection flow paths, but they may be located at positions before and after the vicinity of the heat generating elements 2 in the flow path direction. The length of the bubble generation flow paths between the throat portions 19 is desirably approximately 1.5 to 2 times the length of the heat generating elements 2 in the liquid flow direction. Further, a preferred degree of narrowing of the throat portions 19 is approximately a quarter to a half of the width of the bubble generation flow paths. In this embodiment it is 10 $\mu$m, but it is by no means limited to it, of course. Further, the throat portions 19 may be narrowed in the direction perpendicular to the arrangement direction as discussed above.

<Pressure wave absorbing mechanism>

Next explained is an example provided with a pressure wave absorbing mechanism on the upstream side of the second liquid flow path in order to facilitate refilling as suppressing transmission of the pressure produced by generation of bubble in the second liquid flow path to the circulation passage outside the second liquid flow path.

Figure 25:
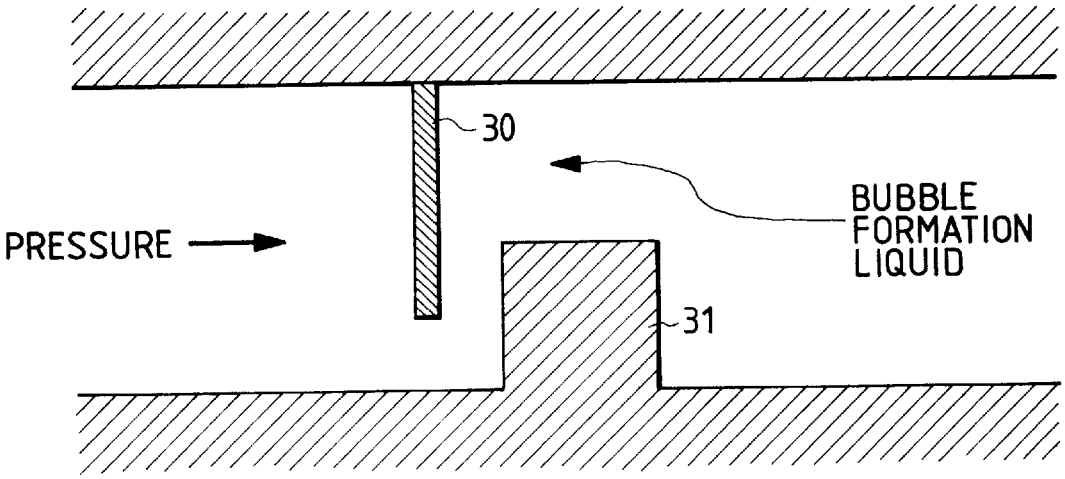
FIG. 25 is a schematic drawing to show an example of a pressure absorbing mechanism.

FIG. 25 is a schematic, sectional view to show an example of the pressure wave absorbing mechanism. In the drawing, the arrow represents a direction of propagation of the pressure. Further, reference numeral 30 designates a valve, and 31 a stopper for stopping the valve from rotating about a fulcrum thereof at the fixed end, located at a predetermined position.

Materials for the above valve 30 and stopper 31 may be selected from any materials with solvent resistance, more specifically materials with some stress resistance for the valve 30 while materials with impact resistance against an impact by the valve for the stopper 31. Specific examples of these materials include nickel, gold, aluminum, silicon, glass, polysulfone, and quartz. Further, a method for producing them should be selected according to the material and configuration out of appropriate methods such as plating, etching, patterning, and so on.

When the valve and stopper are formed in the second liquid circulation system in this manner, they can absorb surplus pressure in the horizontal direction with respect to the surface of heat generating element, which stops influence thereof on the adjacent heat generating elements and on the liquid chamber.

Figure 26:
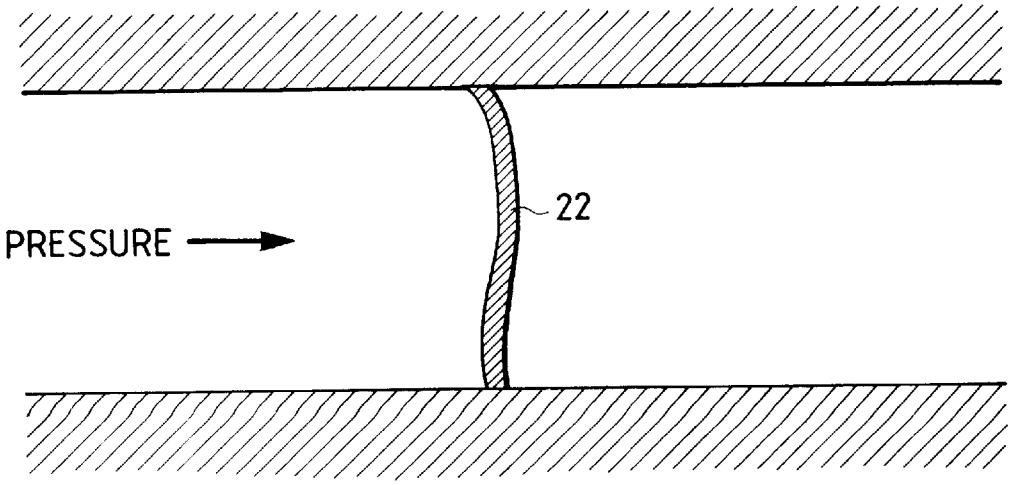
FIG. 26 is a schematic drawing to show another example of the pressure absorbing mechanism.

FIG. 26 is a schematic, sectional view to show another example of the pressure wave absorbing mechanism. In the drawing, the arrow represents the direction of propagation of the pressure. The pressure wave absorbing mechanism of this embodiment is different from the previous embodiment in that a flexible film 32 likely to absorb the pressure partly covers the upstream side of the second liquid flow path with respect to the heat generating element. Specific examples of a material for this film include polycarbonate resin, polyvinyl fluoride resin, polyvinyl chloride resin, polyvinyl fluoride resin, tetrafluoroethylene resin, ethylene-vinyl acetate copolymer resin, polyurethane resin, silicone rubber, natural rubber, SBR, thiol rubber, NBR, chloroprene rubber, neoprene rubber, and so on.

This structure can absorb the surplus pressure in the horizontal direction with respect to the surface of heat generating element and eliminate the influence on the liquid chamber and the adjacent heat generating elements.

<Movable member and partition wall>

Figure 27A:
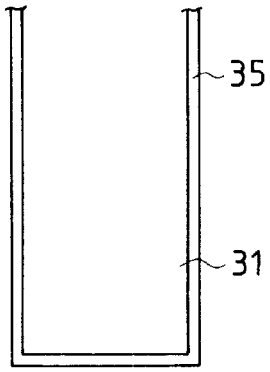
FIGS. 27A to 27C are drawings for explaining configurations of movable members.
Figure 27B:
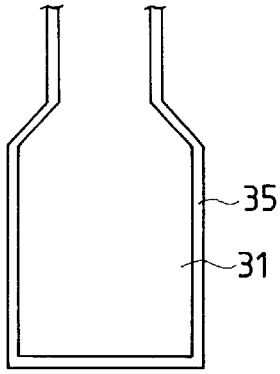
Figure 27C:
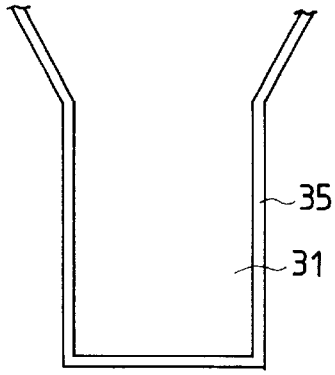

FIGS. 27A to 27C show another examples of the movable member 31, wherein reference numeral 35 designates a slit formed in the partition wall, and the slit is effective to provide the movable member 31. In FIG. 27A, the movable member has a rectangular configuration, and in FIG. 27B, it is narrower in the fulcrum side to permit increased mobility of the movable member, and in FIG. 27C, it has a wider fulcrum side to enhance the durability of the movable member. The configuration narrowed and arcuated at the fulcrum side is desirable as shown in FIG. 22A, since both of easiness of motion and durability are satisfied. However, the configuration of the movable member is not limited to the one described above, but it may be any if it does not enter the second liquid flow path side, and motion is easy with high durability.

In the foregoing embodiments, the plate or film movable member 31 and the separation wall 5 having this movable member was made of a nickel having a thickness of 5 $\mu$m, but this is not limited to this example, but it may be any if it has anti-solvent property against the bubble generation liquid and the ejection liquid, and if the elasticity is enough to permit the operation of the movable member, and if the required fine slit can be formed.

Preferable examples of the materials for the movable member include durable materials such as metal such as silver, nickel, gold, iron, titanium, aluminum, platinum, tantalum, stainless steel, phosphor bronze or the like, alloy thereof, or resin material having nytril group such as acrylonitrile, butadiene, stylene or the like, resin material having amide group such as polyamide or the like, resin material having carboxyl such as polycarbonate or the like, resin material having aldehyde group such as polyacetal or the like, resin material having sulfon group such as polysulfone, resin material such as liquid crystal polymer or the like, or chemical compound thereof; or materials having durability against the ink, such as metal such as gold, tungsten, tantalum, nickel, stainless steel, titanium, alloy thereof, materials coated with such metal, resin material having amide group such as polyamide, resin material having aldehyde group such as polyacetal, resin material having ketone group such as polyetheretherketone, resin material having imide group such as polyimide, resin material having hydroxyl group such as phenolic resin, resin material having ethyl group such as polyethylene, resin material having alkyl group such as polypropylene, resin material having epoxy group such as epoxy resin material, resin material having amino group such as melamine resin material, resin material having methylol group such as xylene resin material, chemical compound thereof, ceramic material such as silicon dioxide or chemical compound thereof.

Preferable examples of partition or division wall include resin material having high heat-resistive, high anti-solvent property and high molding property, more particularly recent engineering plastic resin materials such as polyethylene, polypropylene, polyamide, polyethylene terephthalate, melamine resin material, phenolic resin, epoxy resin material, polybutadiene, polyurethane, polyetheretherketone, polyether sulfone, polyallylate, polyimide, poly-sulfone, liquid crystal polymer (LCP), or chemical compound thereof, or metal such as silicon dioxide, silicon nitride, nickel, gold, stainless steel, alloy thereof, chemical compound thereof, or materials coated with titanium or gold.

The thickness of the separation wall is determined depending on the used, material and configuration from the standpoint of sufficient strength as the wall and sufficient operativity as the movable member, and generally, 0.5 $\mu$m–10 $\mu$m approx. is desirable.

The width of the slit 35 for providing the movable member 31 is 2 μm in the embodiments. When the bubble generation liquid and ejection liquid are different materials, and mixture of the liquids is to be avoided, the gap is determined so as to form a meniscus between the liquids, thus avoiding mixture therebetween. For example, when the bubble generation liquid has a viscosity about 2 cP, and the ejection liquid has a viscosity not less than 100 cP, 5 μm approx. Slit is enough to avoid the liquid mixture, but not more than 3 μm is desirable.

<Element substrate>

The description will be made as to a structure of the element substrate provided with the heat generating element for heating the liquid.

Figure 28A:
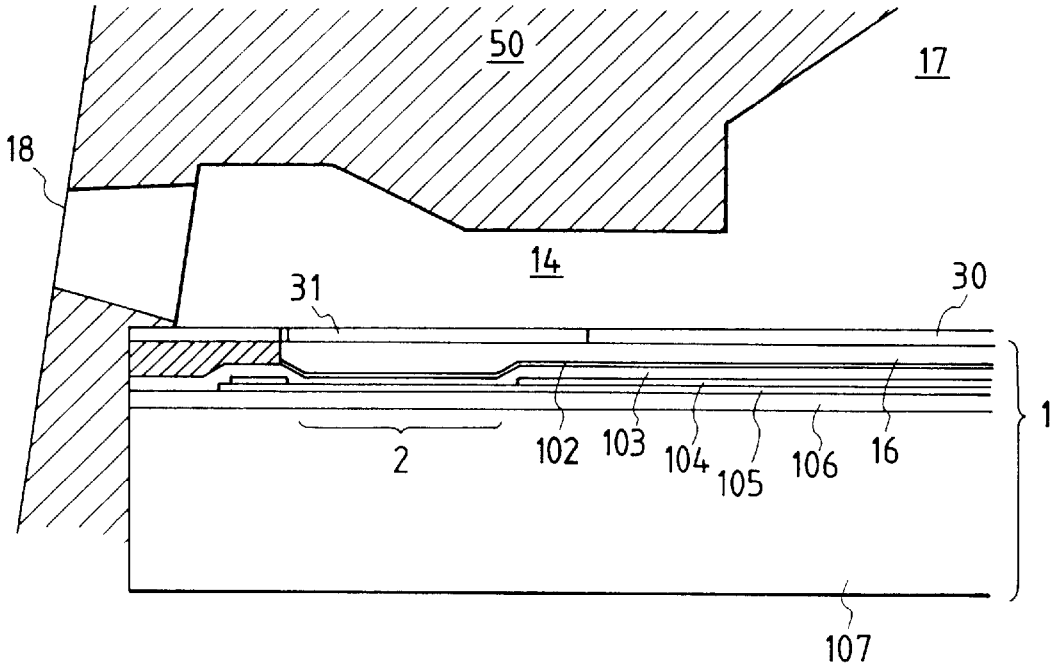
FIGS. 28A and 28B are longitudinal sectional views of a liquid ejecting head according to the present invention.
Figure 28B:
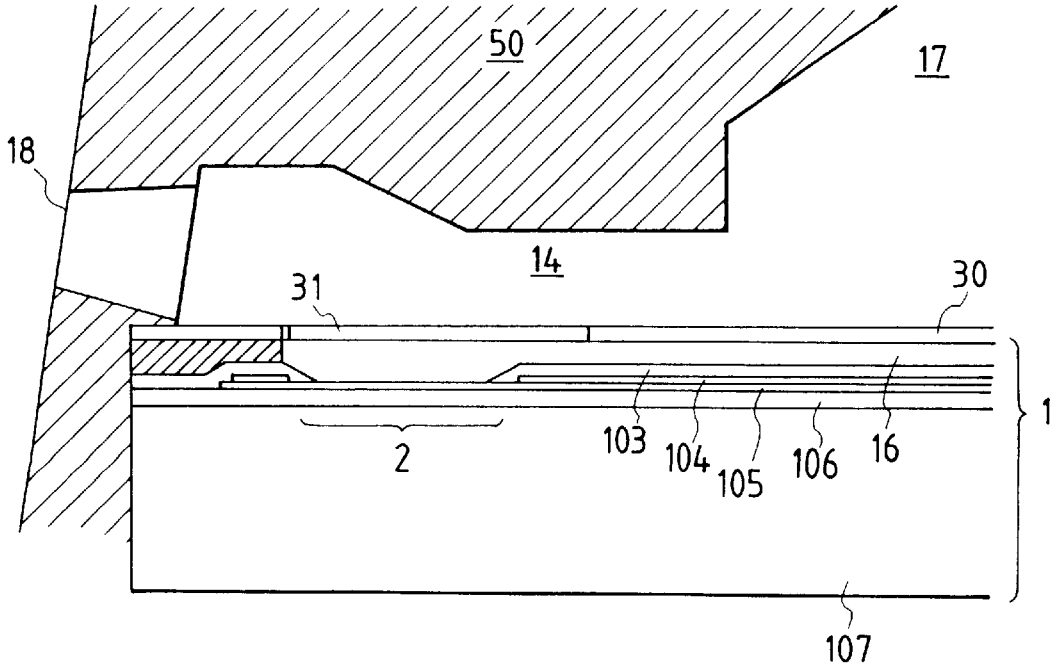

FIGS. 28A and 28B are longitudinal sections of the liquid ejecting head according to an embodiment of the present invention. FIG. 28A shows a head with a protection film and FIG. 28B shows a head without a protection film.

On the element substrate 1, a grooved member 50 is mounted, the member 50 having second liquid flow paths 16, separation walls 30, first liquid flow paths 14 and grooves for constituting the first liquid flow path.

The element substrate 1 has patterned wiring electrode (0.2–1.0 μm thick) of aluminum or the like and patterned electric resistance layer 105 (0.01–0.2 μm thick) of hafnium boride ($HfB_2$), tantalum nitride (TaN), tantalum aluminum (TaAl) or the like constituting the heat generating element on a silicon oxide film or silicon nitride film 106 for insulation and heat accumulation, which in turn is on the substrate 107 of silicon or the like. A voltage is applied to the resistance layer 105 through the two wiring electrodes 104 to flow a current through the resistance layer to effect heat generation. Between the wiring electrode, a protection layer of silicon oxide, silicon nitride or the like of 0.1–2.0 μm thick is provided on the resistance layer, and in addition, an anti-cavitation layer of tantalum or the like (0.1–0.6 μm thick) is formed thereon to protect the resistance layer 105 from various liquid such as ink.

The pressure and shock wave generated upon the bubble generation and collapse is so strong that the durability of the oxide film which is relatively fragile is deteriorated. Therefore, metal material such as tantalum (Ta) or the like is used as the anti-cavitation layer.

The protection layer may be omitted depending on the combination of liquid, liquid flow path structure and resistance material. One of such examples is shown in FIG. 28B. The material of the resistance layer not requiring the protection layer, includes, for example, iridium-tantalum-aluminum alloy or the like.

Thus, the structure of the heat generating element in the foregoing embodiments may include only the resistance layer (heat generation portion) or may include a protection layer for protecting the resistance layer.

In the embodiment, the heat generating element has a heat generation portion having the resistance layer which generates heat in response to the electric signal. This is not limiting, and it will suffice if a bubble enough to eject the ejection liquid is created in the bubble generation liquid. For example, heat generation portion may be in the form of a photothermal transducer which generates heat upon receiving light such as laser, or the one which generates heat upon receiving high frequency wave.

On the element substrate 1, function elements such as a transistor, a diode, a latch, a shift register and so on for selective driving the electrothermal transducer element may also be integrally built in, in addition to the resistance layer 105 constituting the heat generation portion and the electrothermal transducer constituted by the wiring electrode 104 for supplying the electric signal to the resistance layer.

Figure 29:
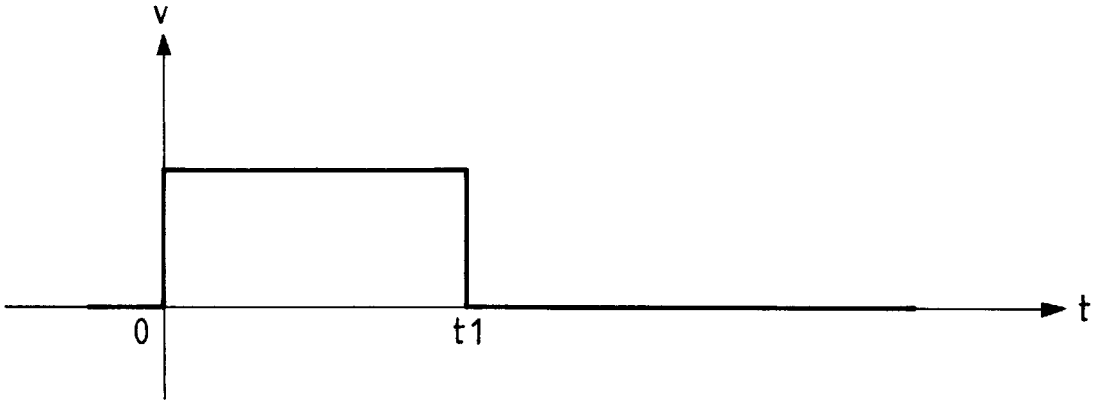
FIG. 29 is a schematic drawing to show a form of drive pulse.

In order to eject the liquid by driving the heat generation portion of the electrothermal transducer on the above-described element substrate 1, the resistance layer 105 is supplied through the wiring electrode 104 with rectangular pulses as shown in FIG. 29 to cause instantaneous heat generation in the resistance layer 105 between the wiring electrode.

In the case of the heads of the foregoing embodiments, the applied energy has a voltage of 24V, a pulse width of 7 μsec, a current of 150 mA and a frequency of 6 kHz to drive the heat generating element, by which the liquid ink is ejected through the ejection outlet through the process described hereinbefore. However, the driving signal conditions are not limited to this, but may be any if the bubble generation liquid is properly capable of bubble generation.

<Head structure of 2 flow path structure>

The description will be made as to a structure of the liquid ejecting head with which different liquids are separately supplied in first and second liquid flow paths, and the number of parts can be reduces so that the manufacturing cost can be reduced.

Figure 30:
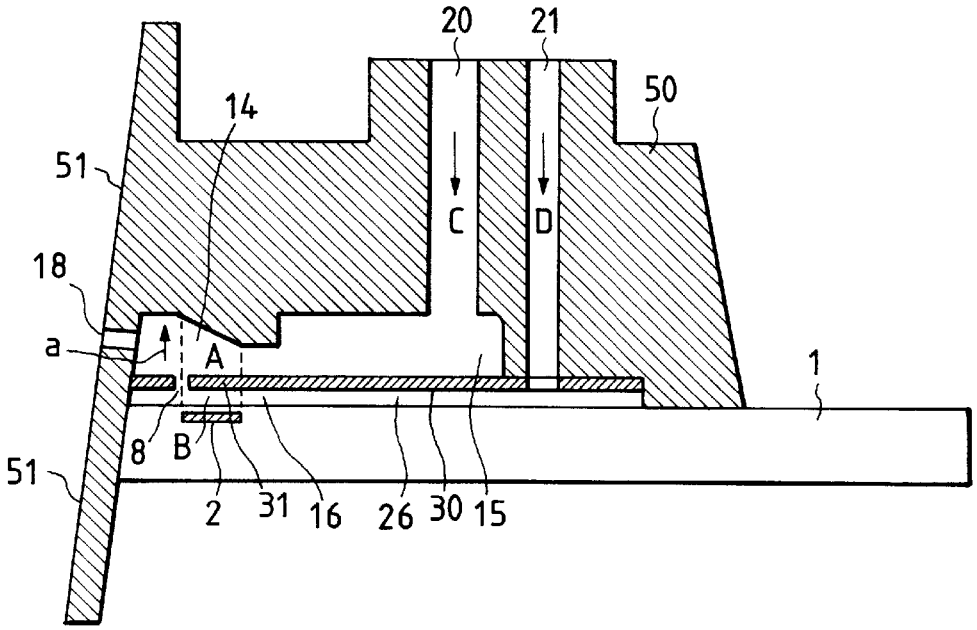
FIG. 30 is a drawing for explaining a supply path of a liquid ejecting head according to the present invention.

FIG. 30 is a schematic view of such a liquid ejecting head. The same reference numerals as in the previous embodiment are assigned to the elements having the corresponding functions, and detailed descriptions thereof are omitted for simplicity.

In this embodiment, a grooved member 50 has an orifice plate 51 (not shown in FIGS. 28A and 28B as removed) having an ejection outlet 18, a plurality of grooves for constituting a plurality of first liquid flow paths 14 and a recess for constituting the first common liquid chamber 15 for supplying the liquid (ejection liquid) to the plurality of liquid flow paths 14.

A separation wall 30 is mounted to the bottom of the grooved member 50 by which plurality of first liquid flow paths 14 are formed. Such a grooved member 50 has a first liquid supply passage 20 extending from an upper position to the first common liquid chamber 15. The grooved member 50 also has a second liquid supply passage 21 extending from an upper position to the second common liquid chamber 17 through the separation wall 30 and a liquid outflow path 28 (not shown in FIG. 30) into which the liquid cerculated through each second liquid path.

As indicated by an arrow C in FIG. 30, the first liquid (ejection liquid) is supplied through the first liquid supply passage 20 and first common liquid chamber 15 to the first liquid flow path 14, and the second liquid (bubble generation liquid) is supplied to each of the second liquid flow path 16 through the second liquid supply passage 21 and the liquid outflow path 29 as indicated by arrow D in FIG. 30.

In this example, the second liquid supply passage 21 and the liquid outlow path 29 are extended in parallel with the first liquid supply passage 20, but this is not limited to the exemplification, but it may be any if the liquid is supplied to the liquid outflow path 29 through the separation wall 30 outside the first common liquid chamber 15.

The thickness (diameter) of the second liquid supply passage 21 and the liquid outflow path are determined in consideration of the supply amount of the second liquid. The configuration thereof is not limited to circular or round but may be rectangular or the like.

Figure 31:
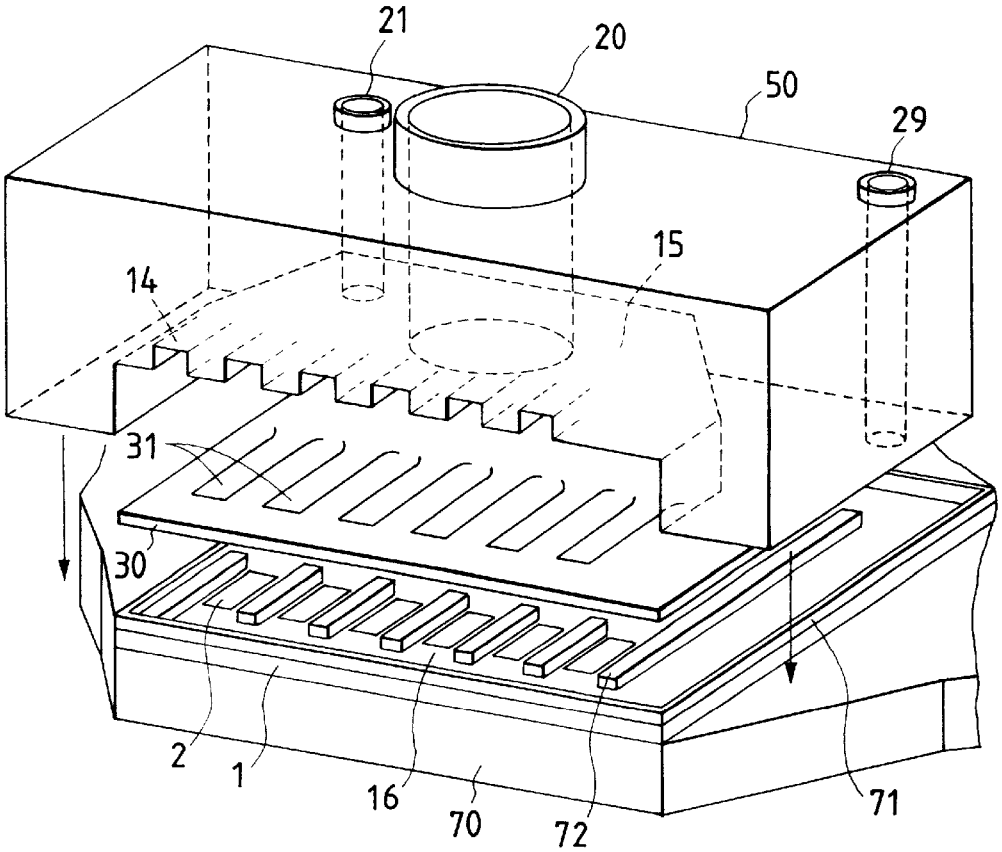
FIG. 31 is an exploded, perspective view of a liquid ejecting head according to the present invention.

As for the method of forming this, as shown in FIG. 31 which is an exploded perspective view, a common liquid chamber frame and a second liquid passage wall are formed of a dry film, and a combination of a grooved member 50 having the separation wall fixed thereto and the element substrate 1 are bonded, thus forming the second common liquid chamber 17 and the second liquid flow path 16.

In this example, the element substrate 1 is constituted by providing the supporting member 70 of metal such as aluminum with a plurality of electrothermal transducer elements as heat generating elements for generating heat for bubble generation from the bubble generation liquid through film boiling.

Above the element substrate 1, there are disposed the plurality of grooves constituting the liquid flow path 16 formed by the second liquid passage walls, the recess for constituting the second common liquid chamber (common bubble generation liquid chamber) 17 which is in fluid communication with the plurality of bubble generation liquid flow paths for supplying the bubble generation liquid to the bubble generation liquid passages, and the separation or dividing walls 30 having the movable walls 31.

Designated by reference numeral 50 is a grooved member. The grooved member is provided with grooves for constituting the ejection liquid flow paths (first liquid flow paths) 14 by mounting the separation walls 30 thereto, a recess for constituting the first common liquid chamber (common ejection liquid chamber) 15 for supplying the ejection liquid to the ejection liquid flow paths, the first supply passage (ejection liquid supply passage) 20 for supplying the ejection liquid to the first common liquid chamber, and the second supply passage (bubble generation liquid supply passage) 21 for supplying the bubble generation liquid to the second supply passage (bubble generation liquid supply passage) 21. The second supply passage 21 is connected with a fluid communication path in fluid communication with the second common liquid chamber 17, penetrating through the separation wall 30 disposed outside of the first common liquid chamber 15. By the provision of the fluid communication path, the bubble generation liquid can be supplied to the second common liquid chamber 15 without mixture with the ejection liquid.

The positional relation among the element substrate 1, separation wall 30, grooved top plate 50 is such that the movable members 31 are arranged corresponding to the heat generating elements on the element substrate 1, and that the ejection liquid flow paths 14 are arranged corresponding to the movable members 31. In this example, one second supply passage is provided for the grooved member, but it may be plural in accordance with the supply amount. The cross-sectional area of the flow path of the ejection liquid supply passage 20 and the bubble generation liquid supply passage 21 may be determined in proportion to the supply amount. By the optimization of the cross-sectional area of the flow path, the parts constituting the grooved member 50 or the like can be downsized.

As described in the foregoing, according to this embodiment, the second supply passage for supplying the second liquid to the second liquid flow path and the first supply passage for supplying the first liquid to the first liquid flow path and liquid outflow path, can be provided by a single grooved top plate, so that the number of parts can be reduced, and therefore, the reduction of the manufacturing steps and therefore the reduction of the manufacturing cost, are accomplished.

Furthermore, the supply of the second liquid to the second common liquid chamber in fluid communication with the second liquid flow path, is effected through the second liquid flow path which penetrates the separation wall for separating the first liquid and the second liquid, and therefore, one bonding step is enough for the bonding of the separation wall, the grooved member and the heat generating element substrate, so that the manufacturing is easy, and the accuracy of the bonding is improved.

Since the second liquid is supplied to the second liquid common liquid chamber, penetrating the separation wall, the supply of the second liquid to the second liquid flow path is assured, and therefore, the supply amount is sufficient so that the stabilized ejection is accomplished.

<Ejection liquid and bubble generation liquid>

As described in the foregoing embodiment, according to the present invention, by the structure having the movable member described above, the liquid can be ejected at higher ejection force or ejection efficiency than the conventional liquid ejecting head. When the same liquid is used for the bubble generation liquid and the ejection liquid, it is possible that the liquid is not deteriorated, and that deposition on the heat generating element due to heating can be reduced. Therefore, a reversible state change is accomplished by repeating the gassification and condensation. So, various liquids are usable, if the liquid is the one not deteriorating the liquid flow passage, movable member or separation wall or the like.

Among such liquids, the one having the ingredient as used in conventional bubble jet device, can be used as a recording liquid.

When the two-flow-path structure of the present invention is used with different ejection liquid and bubble generation liquid, the bubble generation liquid having the above-described property is used, more particularly, the examples includes: methanol, ethanol, n-propyl alcohol, isopropyl alcohol, n-hexane, n-heptane, n-octane, toluene, xylene, methylene dichloride, trichloroethylene, Freon TF, Freon BF, ethyl ether, dioxane, cyclohexane, methyl acetate, ethyl acetate, acetone, methyl ethyl ketone, water, or the like, and a mixture thereof.

As for the ejection liquid, various liquids are usable without paying attention to the degree of bubble generation property or thermal property. The liquids which have not been conventionally usable, because of low bubble generation property and/or easiness of property change due to heat, are usable.

However, it is desired that the ejection liquid by itself or by reaction with the bubble generation liquid, does not impede the ejection, the bubble generation or the operation of the movable member or the like.

As for the recording ejection liquid, high viscous ink or the like is usable. As for another ejection liquid, pharmaceuticals and perfume or the like having a nature easily deteriorated by heat is usable. The ink of the following ingredient was used as the recording liquid usable for both of the ejection liquid and the bubble generation liquid, and the recording operation was carried out. Since the ejection speed of the ink is increased, the shot accuracy of the liquid droplets is improved, and therefore, highly desirable images were recorded.

| Dye ink viscosity of 2 cP | |
|---|---|
| (C.I. food black 2) dye | 3 wt. % |
| diethylene glycol | 10 wt. % |
| Thio diglycol | 5 wt. % |
| Ethanol | 3 wt. % |
| Water | 77 wt. % |

Recording operations were also carried out using the following combination of the liquids for the bubble generation liquid and the ejection liquid. As a result, the liquid having a ten and several cps viscosity, which was unable to be ejected heretofore, was properly ejected, and even 150 cps liquid was properly ejected to provide high quality image.

| | |
|---|---|
| Bubble generation liquid 1: | |
| Ethanol | 40 wt. % |
| Water | 60 wt. % |
| Bubble generation liquid 2: | |
| Water | 100 wt. % |
| Bubble generation liquid 3: | |
| Isopropyl alcoholic | 10 wt. % |
| Water | 90 wt. % |

| | |
|---|---|
| Ejection liquid 1: (Pigment ink approx. viscosity of 15 cP) | |
| Carbon black | 5 wt. % |
| Stylene-acrylate-acrylate ethyl copolymer (oxide 140, weight average molecular weight 8000) | 1 wt. % |
| Mono-ethanol amine | 0.25 wt. % |
| Glycine | 69 wt. % |
| Thiodiglycol | 5 wt. % |
| Ethanol | 3 wt. % |
| Water | 16.75 wt. % |
| Ejection liquid 2 (viscosity of 55 cP): | |
| Polyethylene glycol 200 | 100 wt. % |
| Ejection liquid 3 (viscosity of 150 cP): | |
| Polyethylene glycol 600 | 100 wt. % |

In the case of the liquid which has not been easily ejected, the ejection speed is low, and therefore, the variation in the ejection direction is expanded on the recording paper with the result of poor shot accuracy. Additionally, variation of ejection amount occurs due to the ejection instability, thus preventing the recording of high quality image. However, according to the embodiments, the use of the bubble generation liquid permits sufficient and stabilized generation of the bubble. Thus, the improvement in the shot accuracy of the liquid droplet and the stabilization of the ink ejection amount can be accomplished, thus improving the recorded image quality remarkably.

<Liquid ejection head cartridge>

The description will be made as to a liquid ejection head cartridge having a liquid ejecting head according to an embodiment of the present invention.

Figure 32:
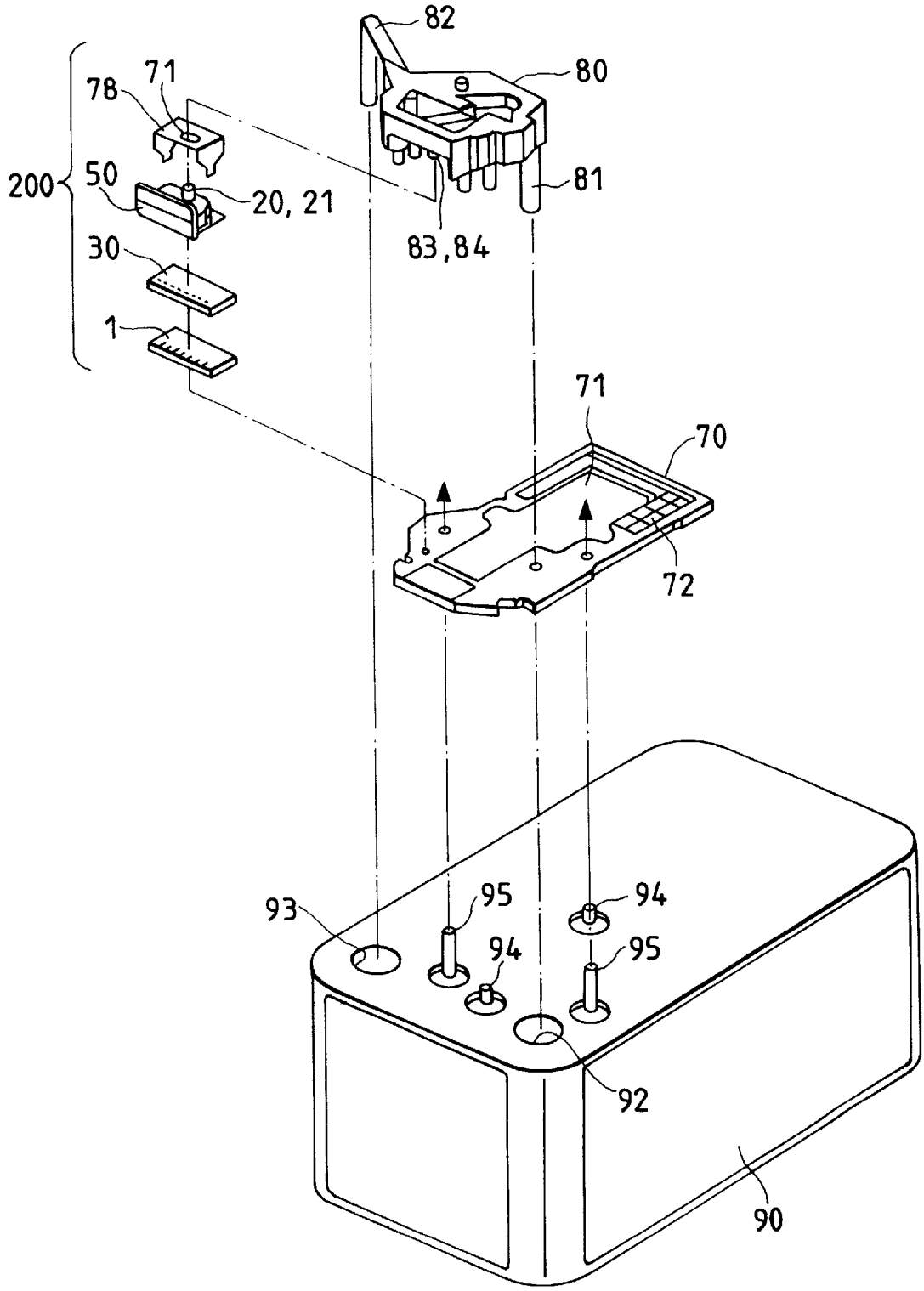
FIG. 32 is a drawing to show a liquid ejecting head cartridge.

FIG. 32 is a schematic exploded perspective view of a liquid ejection head cartridge including the above-described liquid ejecting head, and the liquid ejection head cartridge comprises generally a liquid ejecting head portion 200 and a liquid container 80.

The liquid ejecting head portion 200 comprises an element substrate 1, a separation wall 30, a grooved member 50, a confining spring 78, liquid supply member 90 and a supporting member 70.

The element substrate 1 is provided with a plurality of heat generating resistors for supplying heat to the bubble generation liquid, as described hereinbefore. A bubble generation liquid passage is formed between the element substrate 1 and the separation wall 30 having the movable wall. By the coupling between the separation wall 30 and the grooved top plate 50, an ejection flow path (unshown) for fluid communication with the ejection liquid is formed.

The confining spring 78 functions to urge the grooved member 50 to the element substrate 1, and is effective to properly integrate the element substrate 1, separation wall 30, grooved and the supporting member 70 which will be described hereinafter.

Supporting member 70 functions to support an element substrate 1 or the like, and the supporting member 70 has thereon a circuit board 71, connected to the element substrate 1, for supplying the electric signal thereto, and contact pads 72 for electric signal transfer between the device side when the cartridge is mounted on the apparatus.

The liquid container 90 contains the ejection liquid such as ink to be supplied to the liquid ejecting head and the bubble generation liquid for bubble generation, separately. The outside of the liquid container 90 is provided with a positioning portion 94 for mounting a connecting member for connecting the liquid ejecting head with the liquid container and a fixed shaft 95 for fixing the connection portion. The ejection liquid is supplied to the ejection liquid supply passage 81 of a liquid supply member 80 through a supply passage 81 of the connecting member from the ejection liquid supply passage 92 of the liquid container, and is supplied to a first common liquid chamber through the ejection liquid supply passage 83, supply and 21 of the members. The bubble generation liquid is similarly supplied to the bubble generation liquid supply passage 82 of the liquid supply member 80 through the supply passage of the connecting member from the supply passage 93 of the liquid container, and is supplied to the second liquid chamber through the bubble generation liquid supply passage 84, 71, 22 of the members.

In this embodiment the liquid is circulated within the head.

In such a liquid ejection head cartridge, even if the bubble generation liquid and the ejection liquid are different liquids, the liquids are supplied in good order. In the case that the ejection liquid and the bubble generation liquid are the same, the supply path for the bubble generation liquid and the ejection liquid are not necessarily separated.

After the liquid is used up, the liquid containers may be supplied with the respective liquids. To facilitate this supply, the liquid container is desirably provided with a liquid injection port. The liquid ejecting head and liquid container may be unseparably integral, or may be separable.

<Liquid ejecting device>

Figure 33:
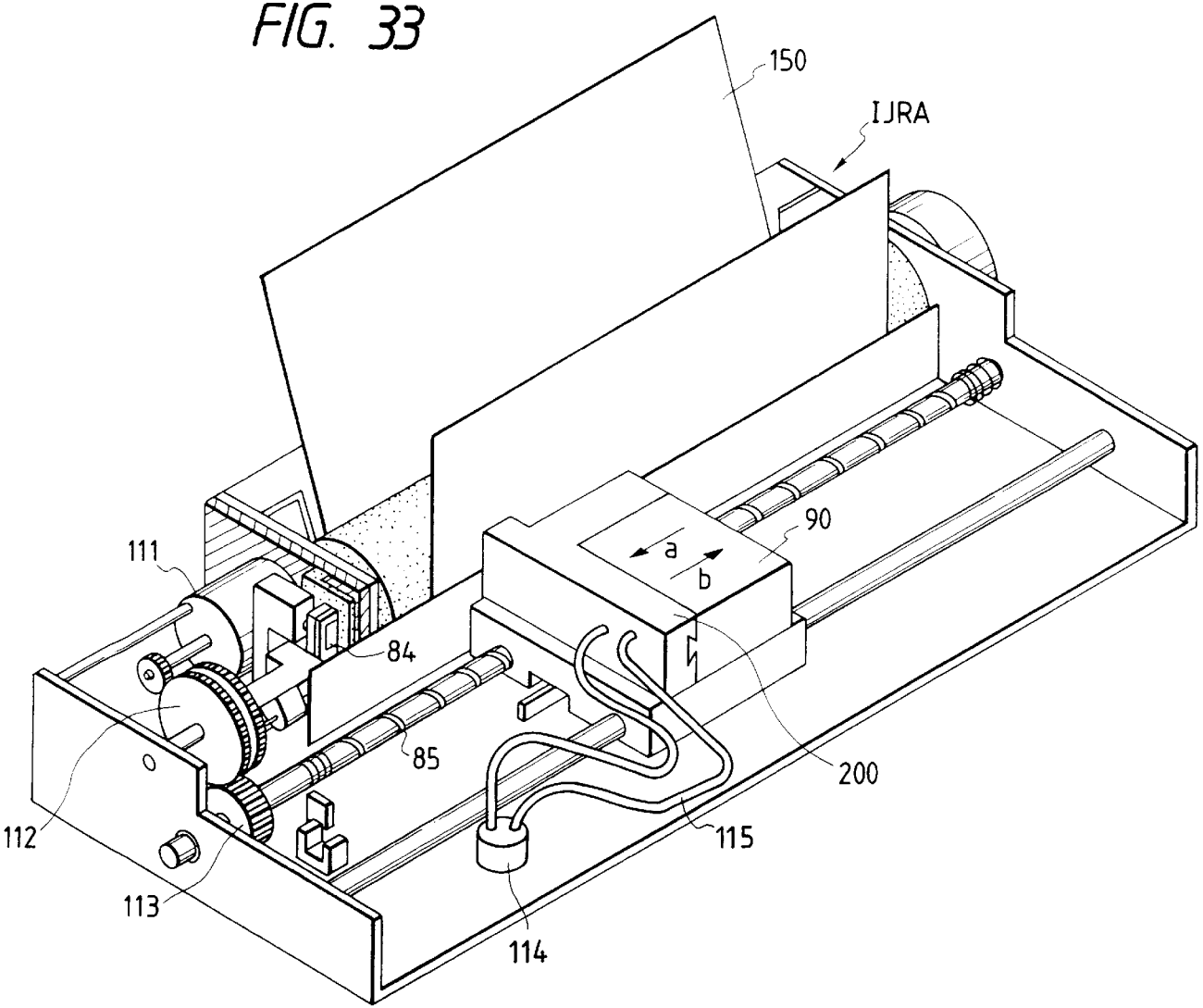
FIG. 33 is a schematic, structural drawing to show a liquid ejecting apparatus.

FIG. 33 is a schematic illustration of a liquid ejecting device used with the above-described liquid ejecting head. In this embodiment, the ejection liquid is ink, and the apparatus is an ink ejection recording apparatus. The liquid ejecting device comprises a carriage HC to which the head cartridge comprising a liquid container portion 90 and liquid ejecting head portion 200 which are detachably connectable with each other, is mountable. The carriage HC is reciprocable in a direction of width of the recording material 150 such as a recording sheet or the like fed by a recording material transporting means.

When a driving signal is supplied to the liquid ejecting means on the carriage from unshown driving signal supply means, the recording liquid is ejected to the recording material from the liquid ejecting head in response to the signal.

The liquid ejecting apparatus of this embodiment comprises a motor 111 as a driving source for driving the recording material transporting means and the carriage, gears 112, 113 for transmitting the power from the driving source to the carriage, and carriage shaft 115 and so on. The device further comprises a circulation pump 114 for supplying the liquid to the head and receiving the liquid from the head to circulate the liquid and a tube 115 for connecting the head and the pump 114. By the recording device and the liquid ejecting method using this recording device, good prints can be provided by ejecting the liquid to the various recording material.

Figure 34:
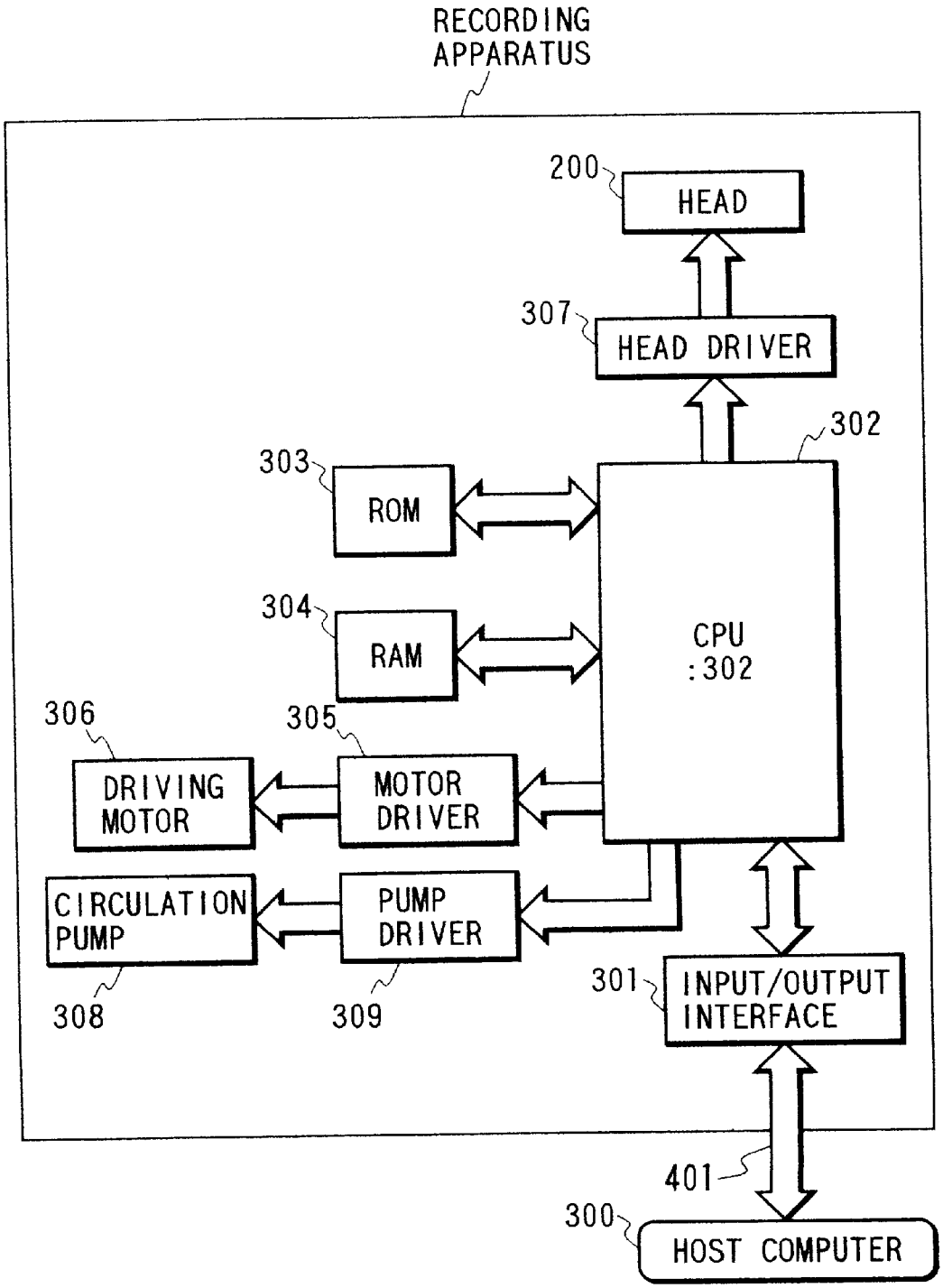
FIG. 34 is a block diagram of an apparatus.

FIG. 34 is a block diagram for describing the general operation of an ink ejection recording apparatus which employs the liquid ejection method, and the liquid ejection head, in accordance with the present invention.

The recording apparatus receives printing data in the form of a control signal from a host computer 300. The printing data is temporarily stored in an input interface 301 of the printing apparatus, and at the same time, is converted into processable data to be inputted to a CPU 302, which doubles as means for supplying a head driving signal. The CPU 302 processes the aforementioned data inputted to the CPU 302, into printable data (image data), by processing them with the use of peripheral units such as RAMs 304 or the like, following control programs stored in an ROM 303.

Further, in order to record the image data onto an appropriate spot on a recording sheet, the CPU 302 generates driving data for driving a driving motor which moves the recording sheet and the recording head in synchronism with the image data. The image data and the motor driving data are transmitted to a head 200 and a driving motor 306 through a head driver 307 and a motor driver 305, respectively, which are controlled with the proper timings for forming an image. The CPU 302 outputs a signal for driving the pump to circulate the liquid to a pump driver 309 and the pump is driven in response to the driving signal to circulate the liquid.

As for recording medium, to which liquid such as ink is adhered, and which is usable with a recording apparatus such as the one described above, the following can be listed; various sheets of paper; OHP sheets; plastic material used for forming compact disks, ornamental plates, or the like; fabric; metallic material such as aluminum, copper, or the like; leather material such as cow hide, pig hide, synthetic leather, or the like; lumber material such as solid wood, plywood, and the like; bamboo material; ceramic material such as tile; and material such as sponge which has a three dimensional structure.

The aforementioned recording apparatus includes a printing apparatus for various sheets of paper or OHP sheet, a recording apparatus for plastic material such as plastic material used for forming a compact disk or the like, a recording apparatus for metallic plate or the like, a recording apparatus for leather material, a recording apparatus for lumber, a recording apparatus for ceramic material, a recording apparatus for three dimensional recording medium such as sponge or the like, a textile printing apparatus for recording images on fabric, and the like recording apparatuses.

As for the liquid to be used with these liquid ejection apparatuses, any liquid is usable as long as it is compatible with the employed recording medium, and the recording conditions.

<Recording System>

Next, an exemplary ink jet recording system will be described, which records images on recording medium, using, as the recording head, the liquid ejection head in accordance with the present invention.

Figure 35:
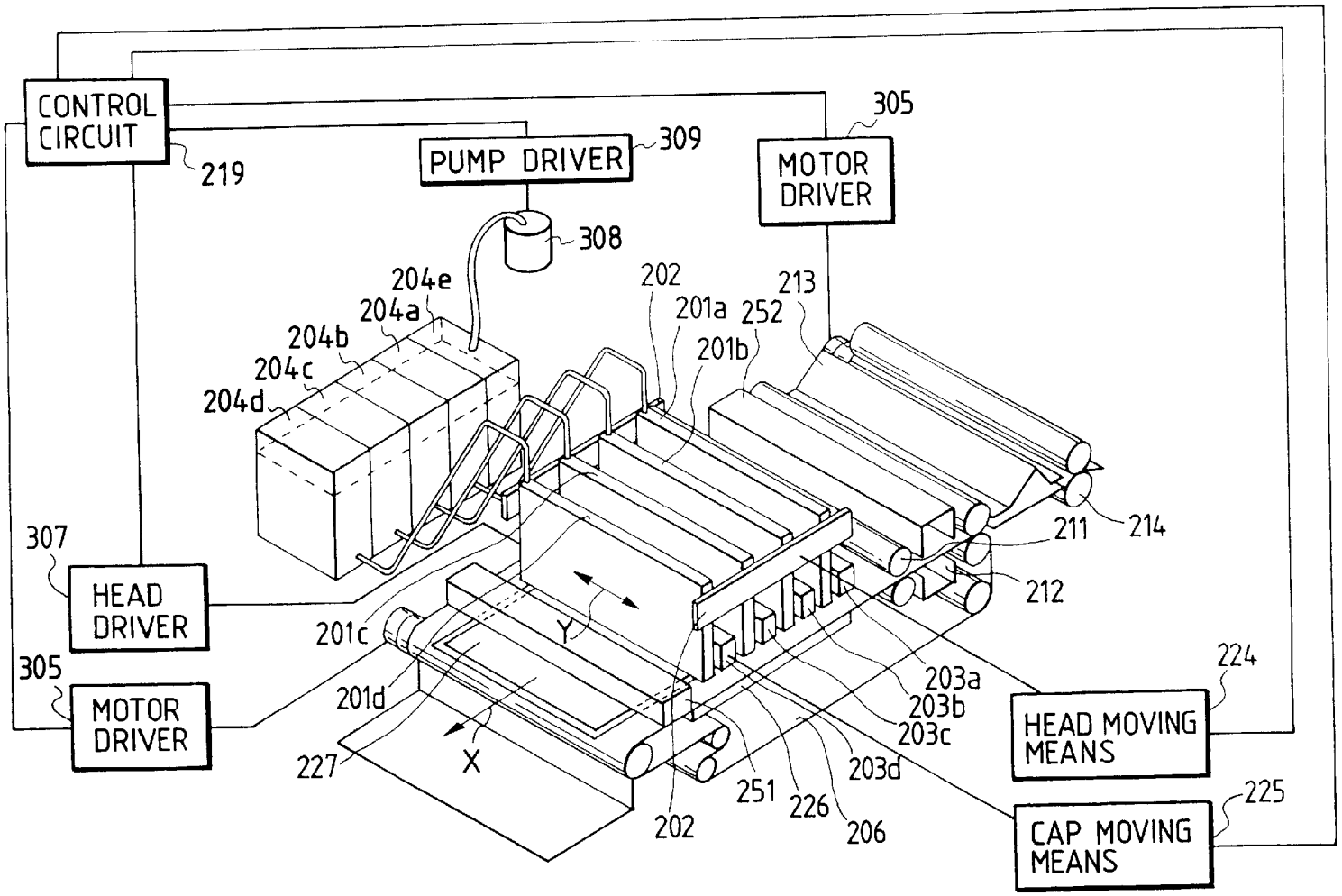
FIG. 35 is a drawing to show a liquid ejection recording system.

FIG. 35 is a schematic perspective view of an ink jet recording system employing the aforementioned liquid ejection head 201 in accordance with the present invention, and depicts its general structure. The liquid ejection head in this embodiment is a full-line type head, which comprises plural ejection orifices aligned with a density of 360 dpi so as to cover the entire recordable range of the recording medium 150. It comprises four heads, which are correspondent to four colors; yellow (Y), magenta (M), cyan (C) and black (Bk). These four heads are fixedly supported by a holder 1202, in parallel to each other and with predetermined intervals.

These heads are driven in response to the signals supplied from a head driver 307, which constitutes means for supplying a driving signal to each head.

Each of the four color inks (Y, M, C and Bk) is supplied to a correspondent head from an ink container 204*a*, 204*b*, 204*c* or 204*d*. A reference numeral 204*e* designates a bubble generation liquid container from which the bubble generation liquid is delivered to each head.

Below each head, a head cap 203*a*, 203*b*, 203*c* or 203*d* is disposed, which contains an ink absorbing member composed of sponge or the like. They cover the ejection orifices of the corresponding heads, protecting the heads, and also maintaining the head performance, during a non-recording period.

A reference numeral 206 designates a conveyer belt, which constitutes means for conveying the various recording medium such as those described in the preceding embodiments. The conveyer belt 206 is routed through a predetermined path by various rollers, and is driven by a driver roller connected to a motor driver 305. The liquid is circulated by the pump connected to the pump driver 309.

The ink jet recording system in this embodiment comprises a pre-printing processing apparatus 251 and a post-printing processing apparatus 252, which are disposed on the upstream and downstream sides, respectively, of the ink jet recording apparatus, along the recording medium conveyance path. These processing apparatuses 251 and 252 process the recording medium in various manners before or after recording is made, respectively.

The pre-printing process and the postprinting process vary depending on the type of recording medium, or the type of ink. For example, when recording medium composed of metallic material, plastic material, ceramic material or the like is employed, the recording medium is exposed to ultra-violet rays and ozone before printing, activating its surface. In a recording material tending to acquire electric charge, such as plastic resin material, the dust tends to deposit on the surface by static electricity. The dust may impede the desired recording. In such a case, the use is made with ionizer to remove the static charge of the recording material, thus removing the dust from the recording material. When a textile is a recording material, from the standpoint of feathering prevention and improvement of fixing or the like, a pre-processing may be effected wherein alkali property substance, water soluble property substance, composition polymeric, water soluble property metal salt, urea, or thiourea is applied to the textile. The pre-processing is not limited to this, and it may be the one to provide the recording material with the proper temperature.

On the other hand, the post-processing is a process for imparting, to the recording material having received the ink, a heat treatment, ultraviolet radiation projection to promote the fixing of the ink, or a cleaning for removing the process material used for the pre-treatment and remaining because of no reaction.

In this embodiment, the head is a full line head, but the present invention is of course applicable to a serial type wherein the head is moved along a width of the recording material.

Next explained is the sequence for circulating the liquid to the second liquid flow paths when the liquid ejecting head of the present invention is used as a recording head as supplying ink thereto. FIG. 36 to FIGS. 39B show flows for the circulation sequence of the liquid in the second liquid flow path.

Figure 36:
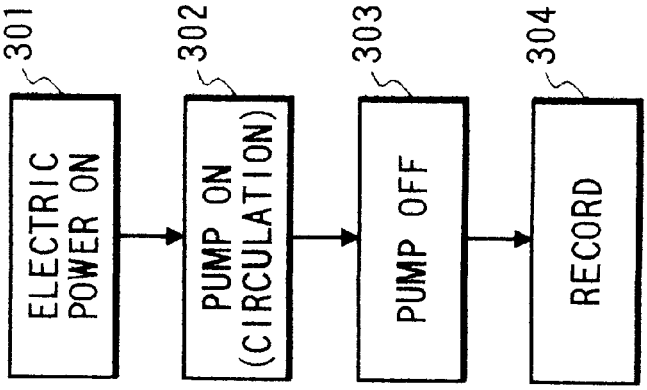
FIG. 36 is a drawing for explaining a liquid circulation flow after supply of power.

As described previously, the CPU executes through each driver the drive control of the pump for circulating the liquid, and the recording operation. FIG. 36 shows the sequence between the time when the power supply of the main body of the recording apparatus is turned on and start of recording. The power supply is turned on at step 301, and the pump is turned on at step 302 to circulate the liquid for a predetermined period in order to even states of the liquid in the second liquid flow paths in the head. Then the drive of the pump is turned off (at step 303), and the recording operation is started (at step 404). This sequence achieves a good state of the liquid in the second liquid flow paths before start of recording and start of stable recording operation.

Figure 37:
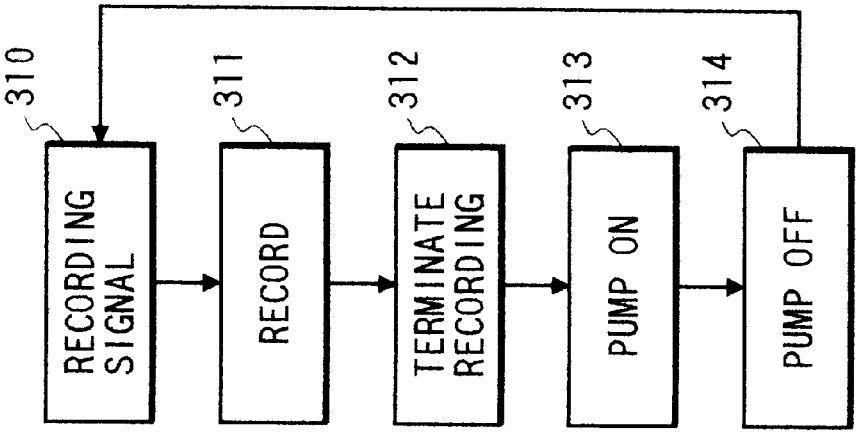
FIG. 37 is a drawing for explaining a liquid circulation flow before recording.

FIG. 37 shows the sequence for circulating the liquid during standby between recording and recording. Receiving a recording signal (at step 310), recording is carried out (at steps 311, 312) and the pump is turned on (at step 313) to effect circulation of the liquid for a predetermined period (at step 314). The next recording can be better performed by circulating the liquid during standby for recording in this manner.

Figure 38:
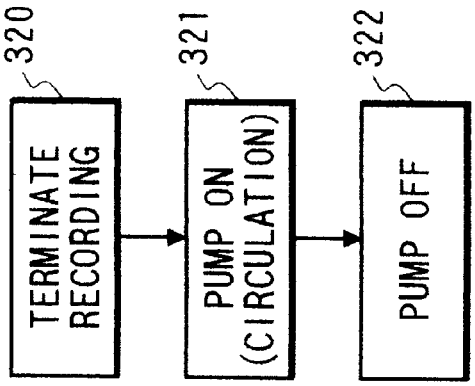
FIG. 38 is a drawing for explaining a liquid circulation flow after recording.

FIG. 38 shows the sequence of circulating the liquid for a predetermined period (at steps 321, 322) after end of recording (at step 320), thereby achieving the effect as discussed previously.

Figure 39A:
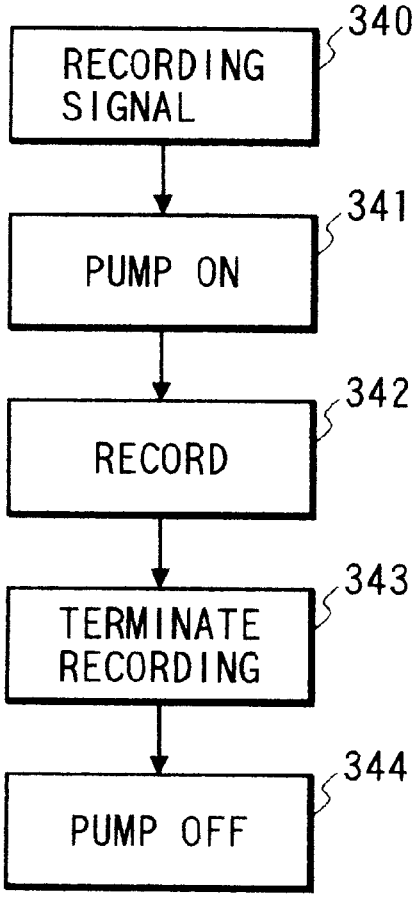
FIGS. 39A and 39B are drawings for explaining liquid circulation flows upon recording operation.
Figure 39B:
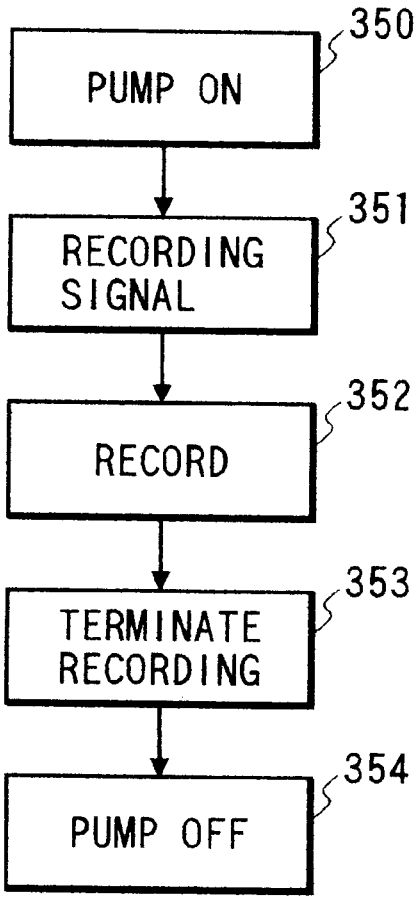

FIGS. 39A and 39B show the sequence for circulating the liquid during the recording operation. FIG. 39A shows the sequence in which the pump is turned on (at step 341) between reception of the recording signal (at step 340) and start of recording (at step 342) to perform recording as circulating the liquid in the second liquid flow paths (at step 343) and thereafter the pump operation is ended (at step 344).

On the other hand, FIG. 39B shows the sequence in which the operation of the pump is made on (at step 350) prior to reception of the recording signal (at step 351) and recording is carried out as circulating the liquid (at step 353).

By circulating the liquid in the second liquid flow paths during recording in this manner, the liquid subject to the heat generated during recording can be changed in order and the effect as discussed previously can be achieved.

The flow amount and rate of the liquid may be set variable in each sequence.

<Head Kit>

Figure 40:
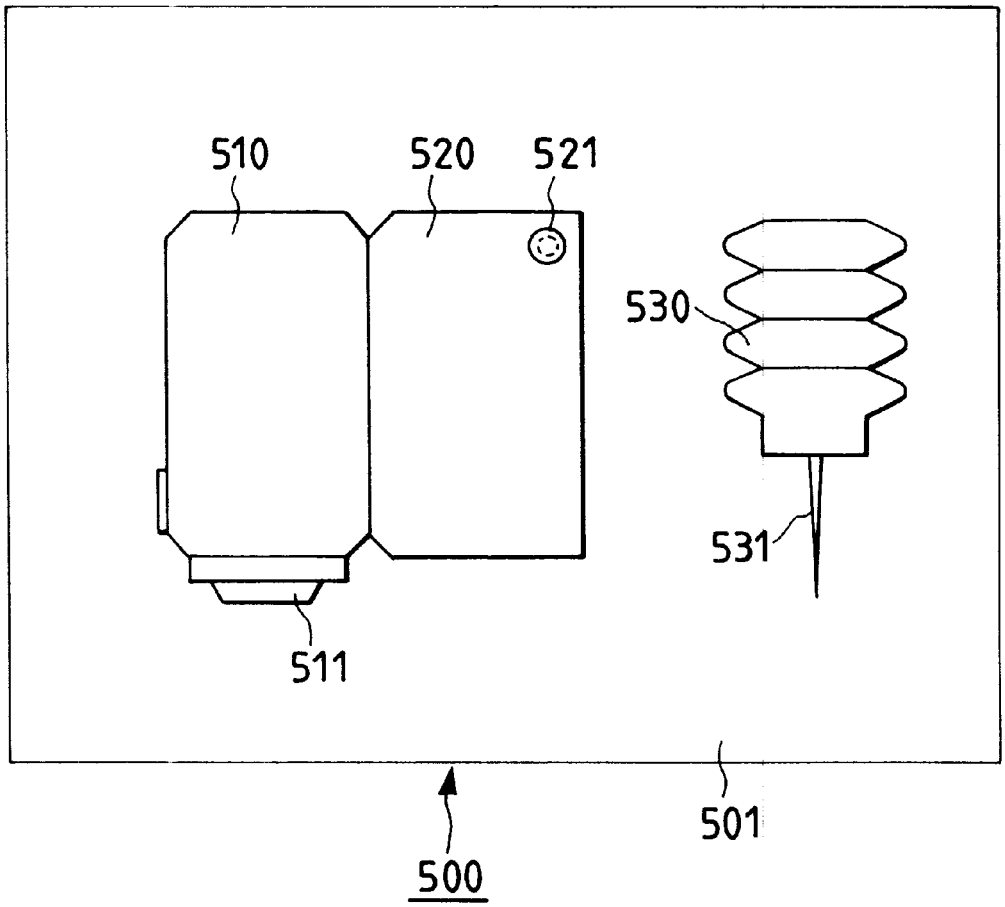
FIG. 40 is a schematic drawing of a head kit.

Hereinafter, a head kit will be described, which comprises the liquid ejection head in accordance with the present invention. FIG. 40 is a schematic view of such a head kit. This head kit is in the form of a head kit package 501, and contains: a head 510 in accordance with the present invention, which comprises an ink ejection section 511 for ejecting ink; an ink container 510, that is, a liquid container which is separable, or nonseparable, from the head; and ink filling means 530, which holds the ink to be filled into the ink container 520.

After the ink in the ink container 520 is completely depleted, the tip 530 (in the form of a hypodermic needle or the like) of the ink filling means is inserted into an air vent 521 of the ink container, the junction between the ink container and the head, or a hole drilled through the ink container wall, and the ink within the ink filling means is filled into the ink container through this tip 531.

When the liquid ejection head, the ink container, the ink filling means, and the like are available in the form of a kit contained in the kit package, the ink can be easily filled into the ink depleted ink container as described above; therefore, recording can be quickly restarted.

In this embodiment, the head kit contains the ink filling means. However, it is not mandatory for the head kit to contain the ink filling means; the kit may contain an exchangeable type ink container filled with the ink, and a head.

Even though FIG. 40 illustrates only the ink filling means for filling the printing ink into the ink container, the head kit may contain means for filling the bubble generation liquid into the bubble generation liquid container, in addition to the printing ink refilling means.

While the invention has been described with reference to the structures disclosed herein, it is not confined to the details set forth and this application is intended to cover such modifications or changes as may come within the purposes of the improvements or the scope of the following claims.

As detailed above, the following effects were achieved by providing the head structure for displacing the movable member with the free end by the bubble generated, with the guide path for flowing the liquid in the bubble generation region.

Namely, the ejection efficiency was improved, and the durability of the movable member and heat generating member was greatly improved. Further, the invention achieved the improvement in the response frequency and stability, which the conventional bubble jet technology failed to achieve. Further, the invention achieved the effect of effectively removing the bubbles in the flow path and the improvement in the reliability of ejection of liquid.

Since these effects were attained without wastefully consuming the liquid in the second liquid flow path, the running cost was largely curtailed.

In addition to the above-described effects, the liquid ejecting method, head, and so on according to the present invention, based on the novel ejection principle using the movable member, can attain the synergistic effect of the bubble generated and the movable member displaced thereby, so that the liquid near the ejection outlet can be efficiently ejected, thereby improving the ejection efficiency as compared with the conventional ejection methods, heads, and so on of the bubble jet method.

With the characteristic structures of the present invention, ejection failure can be prevented even after long-term storage at low temperature or at low moisture, or, even if ejection failure occurs, the head can be advantageously returned instantly into a normal condition only with a recovery process such as preliminary ejection or suction recovery. With this advantage, the invention can reduce the recovery time and losses of the liquid due to recovery, and thus can greatly decrease the running cost.

Especially, the structures of the present invention improving the refilling characteristics attained improvements in responsivity upon continuous ejection, stable growth of bubble, and stability of liquid droplet, thereby enabling high-speed recording or high-quality recording based on high-speed liquid ejection.

In the head of the two-flow path structure the freedom of selection of the ejection liquid was raised because the bubble generation liquid applied was a liquid likely to generate a bubble or a liquid unlikely to form a deposit (scorching or the like) on the heat generating element. It was confirmed that the head of the two-flow path structure was able to well eject the liquid, that the conventional heads failed to eject in the conventional bubble jet ejection method, for example, a high-viscosity liquid unlikely to generate a bubble, a liquid likely to form a deposit on the heat generating element, and so on.

Further, it was confirmed that the head of the two-flow path structure was able to eject a liquid weak against heat or the like without negative effect due to heat on the liquid.

When the liquid ejecting head of the present invention was used as a liquid ejection recording head for recording, further higher-quality recording was achieved.

The invention provided the liquid ejecting apparatus, recording system, and so on further improved in the ejection efficiency of liquid or the like, using the liquid ejecting head of the present invention.

Use or reuse of the head can be readily achieved using the head cartridge or the head kit of the present invention.

What is claimed is:

1. A liquid ejecting head for ejecting a liquid by generation of a bubble, comprising:

a first liquid flow path for direct fluid communication with an ejection outlet and a liquid chamber provided at an upstream region upstream the said ejection outlet so that the liquid is received in said first liquid flow path from the upstream region;

a second liquid flow path having a heat generating element for applying heat to the liquid to generate a bubble in the liquid for ejecting the liquid through the ejection outlet, and a liquid retaining region upstream of said heat generating element;

a movable member disposed between said first and said second liquid flow paths and facing said heat generating element, displaced to a side of said first liquid flow path based on a pressure generated when said heat generating element is driven, and having a fulcrum and a free end that is provided downstream from said fulcrum; and a supply and guide path for removing the liquid in said liquid retaining region in said second liquid flow path separated from said first liquid flow path and supplying new liquid from said supply path upon removal of the liquid.

2. A liquid ejecting head according to claim 1, wherein a cross-sectional area of a portion of said guide path is larger than a cross-sectional area of said second liquid flow path.

3. A liquid ejecting head according to claim 1 or claim 2, further comprising a throat portion between said second liquid flow path and said guide path.

4. A liquid ejecting head according to claim 1, wherein a plurality of such second liquid flow paths are provided and wherein one end of each second liquid flow path is in fluid communication with another second liquid flow path and the other end of said each second liquid flow path is in fluid communication with still another second liquid flow path.

5. A liquid ejecting head according to claim 1, wherein a plurality of such second liquid flow paths are provided and the guide path is in fluid communication in common with each of the second liquid flow paths.

6. A liquid ejecting head according to claim 1, wherein forcible flow means for flowing the liquid in the second liquid flow path is provided in a part of said guide path.

7. A liquid ejecting head according to claim 6, wherein said forcible flow means is a pump.

8. A liquid ejecting head according to claim 1, wherein heat conversion means is provided in said guide path.

9. A liquid ejecting head according to claim 8, wherein said thermal conversion means subjects the liquid flowing in said guide path to heat radiation.

10. A liquid ejecting head according to claim 8, wherein said heat conversion means subjects the liquid flowing in said guide path to heating.

11. A liquid ejecting head according to claim 1, wherein a bubble reservoir for storing a bubble different from a bubble formed by film boiling is provided in said guide path.

12. A liquid ejecting head according to claim 11, wherein a part of said bubble reservoir has a filter portion having a plurality of pores and said filter portion covers at least a part of said guide path.

13. A liquid ejecting head according to claim 1, wherein a supply portion for supplying the liquid is provided in said guide path.

14. A liquid ejecting head according to claim 1, wherein the liquid is ejected by expanding said bubble more on the downstream side than on the upstream side in a direction toward the ejection outlet by displacement of said movable member.

15. A liquid ejecting head according to claim 1, wherein said second liquid flow path is a liquid flow path having an internal wall substantially flat or gently sloped on the upstream side of said heat generating element, for supplying the liquid to above said heat generating element along said internal wall.

16. A liquid ejecting head according to claim 1, wherein said movable member is of a plate form.

17. A liquid ejecting head according to claim 16, wherein said movable member is constructed as a part of a partition wall disposed between said first flow path and second flow path.

18. A liquid ejecting head according to claim 17, wherein said partition wall is of a metal material, a resin material, or a ceramic material.

19. A liquid ejecting head according to claim 1, further comprising the first common liquid chamber for supplying a first liquid to a plurality of such first liquid flow paths and a second common liquid chamber for supplying a second liquid to a plurality of such second liquid flow paths.

20. A liquid ejecting head according to claim 1, wherein said bubble is generated by a film boiling phenomenon caused by transferring heat generated by the heat generating element to the liquid.

21. A liquid ejecting head according to claim 1, further comprising a pressure absorbing mechanism for restricting a pressure from being transferred into the guide path upon generation of a bubble in said second liquid flow path, said pressure absorbing mechanism being disposed in said second liquid flow path.

22. A liquid ejecting head according to claim 21, wherein said pressure absorbing mechanism has a valve and a regulating portion for regulating rotation of said valve.

23. A liquid ejecting head according to claim 21, wherein said pressure absorbing mechanism is of a flexible film.

24. A liquid ejecting head according to claim 1, wherein the liquid supplied to said first liquid flow path is the same as the liquid supplied to said second liquid flow path.

25. A liquid ejecting head according to claim 1, wherein the liquid supplied to said first liquid flow path is different from the liquid supplied to said second liquid flow path.

26. A liquid ejecting head according to claim 1, wherein said heat generating element is a heat generating resistor for generating heat when receiving an electric signal, said heat generating resistor being disposed on an element substrate.

27. A liquid ejecting head according to claim 26, wherein on said element substrate there are provided wiring for transmitting an electric signal to said heat generating resistor and a function element for selectively supplying an electric signal to said heat generating resistor.

28. A liquid ejecting head according to claim 1, wherein said second flow path is shaped in a shape having a throat portion upstream and downstream of the heat generating element.

29. A liquid ejecting head according to claim 1, wherein a distance between a surface of said heat generating element and said movable member is not more than 30 $\mu$m.

30. A liquid ejecting head according to claim 1, wherein the liquid ejected through said ejection outlet is ink.

31. A liquid ejecting head according to claim 30, wherein the ink is supplied to said first liquid flow path.

32. A head cartridge comprising:

the liquid ejecting head as set forth in claim 1;

a liquid container connected to said liquid ejecting head for containing liquid to be supplied to said liquid ejecting head; and liquid conveying means connected to said liquid ejecting head and said liquid container for conveying the liquid from said liquid container to said liquid ejecting head.

33. A head cartridge according to claim 32, wherein said liquid ejecting head is separable from said liquid container.

34. A head cartridge according to claim 32, wherein the liquid is refilled into said liquid container.

35. A head cartridge according to claim 32, wherein the liquid is filled in said liquid container.

36. A head cartridge comprising:

the liquid ejecting head as set forth in claim 1;

a liquid container connected to said liquid ejecting head for containing a first liquid to be supplied to a first liquid flow path, and a second liquid to be supplied to a second liquid flow path; and liquid conveying means connected to said liquid ejecting head and said liquid container for conveying the first and the second liquids from said liquid container to said liquid ejecting head.

37. A head cartridge according to claim 36, wherein the liquid is filled in said liquid container.

38. A liquid ejecting apparatus for ejecting a recording liquid by generation of a bubble, comprising:

the liquid ejecting head as set forth in claim 1; and driving signal supply means in electric communication with said heat generating element for supplying a driving signal to said heat generating element of said liquid ejecting head to eject the liquid from said liquid ejecting head.

39. A liquid ejecting apparatus according to claim 38, further comprising a circulation path for circulating the liquid to said second liquid flow path of said liquid ejecting head.

40. A liquid ejecting apparatus according to claim 38, further comprising forcible flow means for forcing the liquid to flow in said circulation path.

41. A liquid ejecting apparatus according to claim 38, wherein ink is ejected from said liquid ejecting head to be deposited on recording paper, textile, plastic resin material, metal, wood, or leather to effect recording thereon.

42. A liquid ejecting apparatus according to claim 38, wherein a plurality of recording liquids of different colors are ejected from said liquid ejecting head, whereby said recording liquids of different colors are deposited on a recording medium to effect color recording.

43. A liquid ejecting apparatus according to claim 38, wherein a plurality of such ejection outlets are disposed throughout a total width of a recordable region of a recording medium.

44. A liquid ejecting apparatus according to claim 38, wherein the liquid in the second liquid flow path is made to flow during recording or during non-1 recording.

45. A recording system comprising:

the liquid ejecting apparatus as set forth in claim 38; and a pre-processing apparatus upstream of said liquid ejecting apparatus or post-processing apparatus downstream of said liquid ejecting apparatus for promoting fixation of the liquid on a recording material after recording.

46. A liquid ejecting apparatus according to claim 38, wherein ink is ejected from said liquid ejecting head to be deposited on a recording sheet to effect recording thereon.

47. A liquid ejecting apparatus for ejecting a recording liquid by generation of a bubble, comprising:

the liquid ejecting head as set forth in claim 1; and recording medium carrying means for carrying a recording medium past said liquid ejecting head to receive the liquid ejected from said liquid ejecting head, said recording medium carrying means being so disposed as to allow the recording medium to receive the liquid ejected from said liquid ejecting head.

48. A liquid ejecting apparatus according to claim 47, further comprising a circulation path for circulating the liquid to said second liquid flow path of said liquid ejecting head.

49. A liquid ejecting apparatus according to claim 47, further comprising forcible flow means for forcing the liquid to flow in said circulation path.

50. A liquid ejecting apparatus according to claim 47, wherein ink is ejected from said liquid ejecting head to be deposited on a recording sheet to effect recording thereon.

51. A liquid ejecting apparatus according to claim 47, wherein the recording liquid is ejected from said liquid ejecting head to be deposited on recording paper, textile, plastic resin material, metal, wood, or leather to effect recording thereon.

52. A liquid ejecting apparatus according to claim 47, wherein a plurality of recording liquids of different colors are ejected from said liquid ejecting head, whereby said recording liquids of different colors are deposited on the recording medium to effect color recording thereon.

53. A liquid ejecting apparatus according to claim 47, wherein a plurality of such ejection outlets are disposed throughout a total width of a recordable region of the recording medium.

54. A liquid ejecting apparatus according to claim 47, wherein the liquid in the second liquid flow path is made to flow during a recording operation or during a non-recording operation.

55. A recording system comprising:

the liquid ejecting apparatus as set forth in claim 47; and a pre-processing apparatus or post-processing apparatus for promoting fixation of the liquid on the recording medium after recording.

56. A head kit comprising:

the liquid ejecting head as set forth in claim 1;

a liquid container connected to said liquid ejecting head for containing a liquid to be supplied to said liquid ejecting head; and liquid conveying means connected to said liquid ejecting head and said liquid container for conveying the liquid from said liquid container to said liquid ejecting head.

57. A head kit according to claim 56, wherein said liquid is ink for recording.

58. A head kit comprising:

the liquid ejecting head as set forth in claim 1;

a liquid container connected to said liquid ejecting head for containing a liquid to be supplied to said liquid ejecting head;

liquid filling means connectable to said liquid container for filling the liquid into said liquid container; and liquid conveying means connected to said liquid ejecting head and said liquid container for conveying the liquid from said liquid container to said liquid ejecting head.

59. A liquid ejecting head according to claim 1, wherein the liquid in the first liquid flow path is the same as the liquid in the second liquid flow path.

60. A liquid ejecting head as set forth in claim 1, wherein said guide path and said second liquid flow path are flat connected.

61. A liquid ejecting head for ejecting a liquid, comprising:

a first liquid flow path for direct fluid communication with an ejection outlet and a liquid chamber provided at an upstream region upstream to the ejection outlet so that the liquid is received in said first liquid flow path from the upstream region;

a second liquid flow path provided with energy generating means for generating a bubble in the liquid for ejecting the liquid through the ejection outlet, and a liquid retaining region upstream of said energy generating means;

a movable member disposed between said first and said second liquid flow paths and facing a bubble generation region of said energy generation means, displaced to a side of said first liquid flow path based on a pressure of the bubble, and having a fulcrum and a free end that is provided downstream from said fulcrum; and a supply and guide path for removing the liquid in said liquid retaining region in said second liquid flow path separated from said first liquid flow path and supplying new liquid from said supply path upon removal of the liquid.

62. A liquid ejecting head according to claim 61, wherein the liquid in the first liquid flow path is the same as the liquid in the second liquid flow path.

63. A liquid droplet ejecting head for ejecting a liquid droplet through an ejection outlet, based on a bubble generated by film boiling, comprising:

a first liquid flow path for direct fluid communication with an ejection outlet and a liquid chamber provided at an upstream region upstream of the ejection outlet so that the liquid is received in said first liquid flow path from the upstream region;

a second liquid flow path having a bubble generation region and a liquid retaining region upstream of said bubble generation region;

a movable member disposed between said first and said second liquid flow paths and having a fulcrum and a free end that is downstream of the fulcrum and which is displaceable at least by a bubble portion having a pressure component directly acting for ejection of the liquid droplet and, by being displaced, guiding the bubble portion of the bubble having the pressure component toward the ejection outlet; and a supply and guide path for removing the liquid in said liquid retaining region in said second liquid flow path separated from said first liquid flow path and supplying new liquid from said supply path upon removal of the liquid.

64. A liquid droplet ejecting head according to claim 63, wherein the liquid droplet is ejected by expanding said bubble more on the downstream side than on the upstream side in a direction toward the ejection outlet by displacement of said movable member.

65. A liquid droplet ejecting head according to claim 63, wherein the liquid in the first liquid flow path is the same as the liquid in the second liquid flow path.

66. A liquid ejecting head as set forth in claim 63, wherein said guide path and said second liquid flow path are flat connected.

67. A liquid droplet ejecting head as set forth in claim 64, wherein said guide path and said second liquid flow path are flat connected.

68. A head cartridge comprising:

the liquid droplet ejecting head as set forth in either claim 63 or claim 64;

a liquid container connected to said liquid droplet ejecting head for containing liquid to be supplied to said liquid droplet ejecting head; and liquid conveying means connected to said liquid droplet ejecting head and said liquid container for conveying the liquid from said liquid container to said liquid droplet ejecting head.

69. A head cartridge comprising:

the liquid droplet ejecting head as set forth in either claim 63 or claim 64;

a liquid container connected to said liquid droplet ejecting head for containing a first liquid to be supplied to a first liquid flow path, and a second liquid to be supplied to a second liquid flow path; and liquid conveying means connected to said liquid droplet ejecting head and said liquid container for conveying the first and the second liquids from said liquid container to said liquid droplet ejecting head.

70. A liquid ejecting apparatus for ejecting a recording liquid by generation of a bubble, comprising:

the liquid droplet ejecting head as set forth in either claim 63 or claim 64; and recording medium carrying means for carrying a recording medium past said liquid droplet ejecting head to receive the liquid ejected from said liquid droplet ejecting head, said recording medium carrying means being so disposed as to allow the recording medium to receive the liquid ejected from said liquid ejecting head.

71. A head kit comprising:

the liquid droplet ejecting head as set forth in either claim 63 or claim 64;

a liquid container connected to said liquid droplet ejecting head for containing a liquid to be supplied to said liquid droplet ejecting head; and liquid conveying means connected to said liquid droplet ejecting head and said liquid container for conveying the liquid from said liquid container to said liquid droplet ejecting head.

72. A head kit comprising:

the liquid droplet ejecting head as set forth in either claim 63 or claim 64;

a liquid container connected to said liquid droplet ejecting head for containing a liquid to be supplied to said liquid droplet ejecting head;

liquid filling means connectable to said liquid container for filling the liquid into said liquid container; and liquid conveying means connected to said liquid droplet ejecting head and said liquid container for conveying the liquid from said liquid container to said liquid droplet ejecting head.

73. A head cartridge according to claim 68, wherein said liquid droplet ejecting head is separable from said liquid container.

74. A head cartridge according to claim 68, wherein the liquid is refilled into said liquid container.

75. A head cartridge according to claim 68, wherein the liquid is filled in said liquid container.

76. A liquid ejecting apparatus for ejecting a recording liquid by generation of a bubble, comprising:

said liquid droplet ejecting head as set forth in either claim 63 or claim 64, further comprising a heat generating element; and driving signal supply means in electrical communication with said heating generation element for supplying a driving signal to said heat generating element of said liquid droplet ejecting head to eject the liquid from said liquid droplet ejecting head.

77. A head cartridge according to claim 69, wherein the liquid is filled in said liquid container.

78. A liquid ejecting apparatus according to claim 70, further comprising a circulation path for circulating the liquid to said second liquid flow path of said liquid droplet ejecting head.

79. A liquid ejecting apparatus according to claim 70, further comprising forcible flow means for forcing the liquid to flow in said circulation path.

80. A liquid ejecting apparatus according to claim 70, wherein ink is ejected from said liquid droplet ejecting head to be deposited on a recording sheet to effect recording thereon.

81. A liquid ejecting apparatus according to claim 70, wherein the recording liquid is ejected from said liquid droplet ejecting head to be deposited on recording paper, textile, plastic resin material, metal, wood, or leather to effect recording thereon.

82. A liquid ejecting apparatus according to claim 70, wherein a plurality of recording liquids of different colors are ejected from said liquid droplet ejecting head, whereby the recording liquids of different colors are deposited on the recording medium to effect color recording thereon.

83. A liquid ejecting apparatus according to claim 70, wherein a plurality of such ejection outlets are disposed throughout a total width of a recordable region of the recording medium.

84. A liquid ejecting apparatus according to claim 70, wherein the liquid in the second liquid flow path is made to flow during a recording operation or during a non-recording operation.

85. A recording system comprising:

the liquid ejecting apparatus as set forth in claim 70; and a pre-processing apparatus upstream of said liquid ejecting apparatus or post-processing apparatus downstream of said liquid ejecting apparatus for promoting fixation of the liquid on the recording medium after recording.

86. A head kit according to claim 71, wherein the liquid is ink for recording.

87. A liquid ejecting apparatus according to claim 76, further comprising a circulation path for circulating the liquid to said second liquid flow path of said liquid droplet ejecting head.

88. A liquid ejecting apparatus according to claim 76, further comprising forcible flow means for forcing the liquid to flow in said circulation path.

89. A liquid ejecting apparatus according to claim 76, wherein ink is ejected from said liquid droplet ejecting head to be deposited on recording paper, textile, plastic resin material, metal, wood, or leather to effect recording thereon.

90. A liquid ejecting apparatus according to claim 76, wherein a plurality of recording liquids of different colors are ejected from said liquid droplet ejecting head, whereby the recording liquids of different colors are deposited on a recording medium to effect color recording.

91. A liquid ejecting apparatus according to claim 76, wherein a plurality of such ejection outlets are disposed throughout a total width of a recordable region of a recording medium.

92. A liquid ejecting apparatus according to claim 76, wherein the liquid in the second liquid flow path is made to flow during recording or during non-recording.

93. A recording system comprising:

the liquid ejecting apparatus as set forth in claim 76; and a pre-processing apparatus upstream of said liquid ejecting apparatus or post-processing apparatus downstream of said liquid ejecting apparatus for promoting fixation of the liquid on a recording material after recording.

94. A liquid ejecting apparatus according to claim 76, wherein ink is ejected from said liquid droplet ejecting head to be deposited on a recording sheet to effect recording thereon.

95. A liquid ejecting head for ejecting a liquid by generation of a bubble, comprising:

a first liquid flow path for direct fluid communication with an ejection outlet and a liquid chamber provided at an upstream region upstream to the ejection outlet so that the liquid is received in said first liquid flow path from the upstream region;

a second liquid flow path having a heat generating element for applying heat to the liquid to generate a bubble in the liquid for ejecting the liquid through the ejection outlet, and a liquid retaining region upstream of said heat generating element;

a movable member disposed between said first and said second liquid flow paths and facing said heat generating element, displaced to a side of said first liquid flow path based on a pressure generated when said heat generating element is driven, and having a fulcrum and a free end that is provided downstream of said fulcrum; and a supply and guide path for removing the liquid in said liquid retaining region in said second liquid flow path separated from said first liquid flow path and supplying new liquid from said supply path upon removal of the liquid.

96. A liquid ejecting head according to claim 95, wherein the liquid in the first liquid flow path is the same as the liquid in the second liquid flow path.

97. A liquid ejecting head as set forth in claim 95, wherein said guide path and said second liquid flow path are flat connected.

98. A liquid ejecting method for ejecting a liquid by generation of a bubble, comprising the steps of:

using a head having a first liquid flow path for direct fluid communication with an ejection outlet and a liquid chamber provided at an upstream region upstream of the ejection outlet so that the liquid is received in the first liquid flow path from the upstream region, a second liquid flow path having a heat generating element for applying heat to the liquid to generate a bubble in the liquid and a liquid retaining region upstream of the heat generating element, a movable member disposed between the first and the second liquid flow paths and facing the heat generating element and having a fulcrum and a free end that is provided downstream of the fulcrum, and a supply and guide path for removing the liquid in the liquid retaining region in the second liquid flow path separated from the first liquid flow path and supplying new liquid from the supply path upon removal of the liquid;

causing the liquid on the heat generating element of the second liquid flow path separated from the first liquid flow path to be removed and new liquid to be supplied from the supply path upon removal of the liquid; and displacing the movable member to a side of the first liquid flow path, based on a pressure generated when the heat generating element is driven, thereby ejecting the liquid in the first liquid flow path.

99. A liquid ejecting method according to claim 98, wherein the liquid in the first liquid flow path is the same as the liquid in the second liquid flow path.

100. A liquid ejecting method as set forth in claim 98, wherein said guide path and said second liquid flow path are flat connected.

101. A liquid ejecting method for ejecting a liquid droplet through an ejection outlet, based on a bubble generated by film boiling, comprising the steps of:

using a liquid ejecting head having a first liquid flow path for direct fluid communication with an ejection outlet and a liquid chamber provided at an upstream region upstream to the ejection outlet so that the liquid is received in the first liquid flow path from the upstream region, a second liquid flow path having a bubble generation region and a liquid retaining region upstream of the bubble generation region, a movable member, which faces the bubble generation region and which has a fulcrum and a free end that is provided downstream of the fulcrum and which is displaceable at least by a bubble portion having a pressure component directly acting for ejection of the liquid droplet, and a supply and guide path for removing the liquid in the liquid retaining region in the second liquid flow path separated from the first liquid flow path and supplying new liquid from the supply path upon removal of the liquid;

displacing the movable member, thereby guiding the bubble portion of the bubble having the pressure component toward the ejection outlet; and causing the liquid in the bubble generation region in the second liquid flow path separated from said first liquid flow path to be removed and new liquid to be supplied from the supply path upon removal of the liquid.

102. A liquid ejecting method according to claim 98 or claim 101, wherein the liquid in said second liquid flow path is circulated.

103. A liquid ejecting method according to claim 101, wherein the liquid ejecting head further comprises a heat generating element located at a position facing the movable member, and a region between the movable member and the heat generating element is the bubble generation region.

104. A liquid ejecting method according to claim 98 or claim 101, wherein a part of the bubble generated extends into said first liquid flow path with displacement of said movable member.

105. A liquid ejecting method according to claim 98 or claim 101, wherein the liquid is ejected by expanding the bubble more on the downstream side than on the upstream side in a direction toward the ejection outlet, by displacement of said movable member.

106. A liquid ejecting method according to claim 101, wherein the liquid supplied to said first liquid flow path is the same as the liquid supplied to said second liquid flow path.

107. A liquid ejecting method according to claim 101, wherein the liquid supplied to said first liquid flow path is different from the liquid supplied to said second liquid flow path.

108. A liquid ejecting method according to claim 101, wherein the liquid supplied to said second liquid flow path is a liquid more excellent in at least one property of low viscosity, bubble-generating property, and thermal stability than the liquid supplied to said first liquid flow path.

109. A liquid ejecting method according to claim 101, wherein the liquid in said second liquid flow path is made to flow during a recording operation or during a non-recording operation.

110. A liquid ejecting method according to claim 101, wherein the liquid in the first liquid flow path is the same as the liquid in the second liquid flow path.

111. A liquid ejecting method as set forth in claim 101, wherein said guide path and said second liquid flow path are flat connected.

112. A liquid ejecting method according to claim 102, wherein a plurality of such first liquid flow paths are paired each with a plurality of such second liquid flow paths and wherein said plurality of second liquid flow paths are connected in series with each other and said liquid flows in said second liquid flow paths in order.

113. A liquid ejecting method according to claim 102, wherein a plurality of such first liquid flow paths are paired each with a plurality of such second liquid flow paths and wherein said plurality of second liquid flow paths are connected in parallel with each other and said liquid flows in parallel in said second liquid flow paths.

114. A liquid ejecting method according to claim 103, wherein said bubble is generated by a film boiling phenomenon caused by transferring heat generated by the heat generating element to the liquid.

115. A liquid ejecting method according to claim 103, wherein the liquid is supplied along an internal wall substantially flat or gently sloped on the upstream side of the heat generating element, to above said heat generating element.

116. A liquid ejection recording method for ejecting a recording liquid through an ejection outlet by generation of a bubble so as to effect recording, comprising the steps of:

using a head having a first liquid flow path for direct fluid communication with the ejection outlet and a liquid chamber provided at an upstream region upstream of the ejection outlet so that the liquid is received in the first liquid flow path from the upstream region, a second liquid flow path having a heat generating element for applying heat to the liquid to generate a bubble in the liquid, a movable member disposed between the first and the second liquid flow paths and facing the heat generating element and having a fulcrum and a free end that is provided downstream from the fulcrum, and a supply and guide path for removing the liquid in the liquid retaining region in the second liquid flow path separated from the first liquid flow path and supplying new liquid from the supply path upon removal of the liquid;

causing the liquid on the heat generating element of the second liquid f low path separated from the first liquid flow path to be removed and new liquid to be supplied from the supply path upon removal of the liquid; and displacing the movable member to a side of the first liquid flow path, based on a pressure generated when the heat generating element is driven, thereby ejecting the recording liquid in the first liquid flow path.

117. A liquid ejection recording method according to claim 116, wherein the liquid in the first liquid flow path is the same as the liquid in the second liquid flow path.

118. A liquid ejecting recording method as set forth in claim 116, wherein said guide path and said second liquid flow path are flat connected.

* * * * *

UNITED STATES PATENT AND TRADEMARK OFFICE

CERTIFICATE OF CORRECTION

PATENT NO. : 6,331,050 B1
DATED : December 18, 2001
INVENTOR(S) : Yoshie Nakata et al.

It is certified that error appears in the above-identified patent and that said Letters Patent is hereby corrected as shown below:

Column 1,
Line 22, "tion" should read -- tion of --; and
Line 58, "another" should read -- other --.

Column 2,
Line 19, "know" should read -- known --; and
Line 28, "depends" should read -- extends --.

Column 9,
Line 39, "contributable" should read -- contributes --.

Column 14,
Line 19, "easiler" should read -- easily --; and
Line 20, "be followed" should read -- follow --.

Column 21,
Line 66, "another" should read -- other --.

Column 23,
Line 38, "liquid" should read -- liquids --.

Column 24,
Line 22, "reduces" should read -- reduced --;
Line 45, "cerculated" should read -- circulated --; and
Line 54, "outlow" should read -- outflow --.

Column 27,
Line 27, "Glycine" should read -- Glyceline --.

Column 33,
Line 17, "upstream" (second occurrence) should read -- upstream to --.

UNITED STATES PATENT AND TRADEMARK OFFICE

CERTIFICATE OF CORRECTION

PATENT NO. : 6,331,050 B1
DATED : December 18, 2001
INVENTOR(S) : Yoshie Nakata et al.

It is certified that error appears in the above-identified patent and that said Letters Patent is hereby corrected as shown below:

Column 34,
Line 34, "sloped." should read -- sloped --.

Column 42,
Line 52, "f low" should read -- flow --.

Signed and Sealed this

Seventh Day of May, 2002

*Attest:*

*Attesting Officer*

JAMES E. ROGAN
*Director of the United States Patent and Trademark Office*